US010368626B2

(12) United States Patent
Roque et al.

(10) Patent No.: US 10,368,626 B2
(45) Date of Patent: Aug. 6, 2019

(54) CARRIER SYSTEM AND SUBASSEMBLY THEREOF

(71) Applicant: Point Blank Enterprises, Inc., Pompano Beach, FL (US)

(72) Inventors: Leomar Roque, Coconut Creek, FL (US); Matthew Asher, Aventura, FL (US); Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 116 days.

(21) Appl. No.: 15/142,901

(22) Filed: Apr. 29, 2016

(65) Prior Publication Data

US 2016/0316895 A1 Nov. 3, 2016

Related U.S. Application Data

(60) Provisional application No. 62/155,336, filed on Apr. 30, 2015, provisional application No. 62/155,329, filed on Apr. 30, 2015.

(51) Int. Cl.

| | |
|---|---|
| ***A45F 3/08*** | (2006.01) |
| ***A45F 3/04*** | (2006.01) |
| *A45F 3/14* | (2006.01) |

(52) U.S. Cl.

CPC ..... *A45F 3/08* (2013.01); *A45F 3/04* (2013.01); *A45F 2003/045* (2013.01); *A45F 2003/146* (2013.01)

(58) Field of Classification Search

CPC ..... A45F 3/04; A45F 3/08; A45F 2003/146

USPC ..... 224/631

See application file for complete search history.

(56) References Cited

U.S. PATENT DOCUMENTS

| | | | | |
|---|---|---|---|---|
| 4,074,839 | A | 2/1978 | Wood et al. | |
| 4,982,884 | A * | 1/1991 | Wise | A45F 3/04 224/197 |
| 5,806,741 | A * | 9/1998 | Kirk | A45F 5/00 224/634 |
| 5,954,253 | A * | 9/1999 | Swetish | A45F 3/08 224/628 |
| 6,276,584 | B1 * | 8/2001 | McLachlan | A45F 3/04 224/262 |
| 6,892,915 | B2 * | 5/2005 | Mares | A45F 3/04 224/148.5 |
| 7,770,766 | B2 * | 8/2010 | Foissac | A45F 3/047 224/262 |
| 8,181,833 | B2 * | 5/2012 | Wangeby | A45F 3/14 224/262 |

(Continued)

*Primary Examiner* — Derek J Battisti

(74) *Attorney, Agent, or Firm* — Honigman LLP

(57) ABSTRACT

A subassembly is disclosed. The subassembly includes a cradle portion defining a cavity and a spine portion. The spine portion includes a lower portion, an intermediate portion and an upper portion located between the lower portion and the upper portion. The lower portion of the spine extends into the cavity by way of an opening formed by the cradle portion. The lower portion of the spine is non-removably-coupled to and free-floatingly-disposed within the cavity of the cradle portion. The intermediate portion and the upper portion of the spine portion are connected to a load-interfacing portion. A carrier system is also disclosed. An assembly is also disclosed.

21 Claims, 41 Drawing Sheets

(56) References Cited

U.S. PATENT DOCUMENTS

| | | | | |
|---|---|---|---|---|
| 8,182,439 | B2 * | 5/2012 | Glenn | F41H 1/02 224/637 |
| 8,672,203 | B2 | 3/2014 | Staudecker et al. | |
| 8,857,681 | B2 * | 10/2014 | Burnett | A44B 11/005 224/197 |
| 8,991,671 | B2 | 3/2015 | Gill et al. | |
| 8,997,262 | B2 | 4/2015 | Klein | |
| 9,629,443 | B2 * | 4/2017 | Searle | A45F 3/10 |
| 2010/0116861 | A1 | 5/2010 | Burrowes | |
| 2012/0187172 | A1 | 7/2012 | Heaword | |
| 2013/0283492 | A1 | 10/2013 | Ernst, Jr. et al. | |
| 2013/0312150 | A1 * | 11/2013 | Klein | A45F 3/06 2/2.5 |
| 2014/0151424 | A1 * | 6/2014 | Hexels | A45F 3/06 224/637 |

* cited by examiner

CARRIER SYSTEM AND SUBASSEMBLY THEREOF

CROSS-REFERENCE TO RELATED APPLICATION

This U.S. patent application claims priority to U.S. Provisional Applications 62/155,329 and 62/155,336 both filed on Apr. 30, 2015.

TECHNICAL FIELD

This disclosure relates to a subassembly of a carrier system, a carrier system and an assembly.

BACKGROUND

Carrier systems are known. While existing carrier systems perform adequately for their intended purpose, improvements to carrier systems are continuously being sought in order to advance the arts.

SUMMARY

One aspect of the disclosure provides a subassembly. The carrier system includes a cradle portion, and a spine portion. The cradle portion defines a cavity. The spine portion includes a lower portion, an intermediate portion and an upper portion located between the lower portion and the upper portion. The lower portion of the spine extends into the cavity by way of an opening formed by the cradle portion. The lower portion of the spine is non-removably-coupled to and free-floatingly-disposed within the cavity of the cradle portion. The intermediate portion and the upper portion of the spine portion are connected to a load-interfacing portion.

Implementations of the disclosure may include one or more of the following optional features. For example, the cradle portion includes a first cradle portion half joined to a second cradle portion half. Each of the first cradle portion half and the second cradle portion half includes a substantially rigid body portion having a base portion and a pair of guide members extending from the base portion. The pair of guide members includes a first guide member and a second guide member arranged in a spaced-apart relationship defining a non-constant spacing that defines the cavity.

In some implementations, each of the first cradle portion half and the second cradle portion half is defined by a rear surface, a front surface, a lower edge, an upper edge, a first side edge and a second side edge. The first guide member extends away from the base portion along the first side edge. The second guide member extends away from the base portion along the second side edge. The cavity is further defined by a substantially constant spacing extending between the rear surface of the first cradle portion half and the rear surface of the second cradle portion half.

In some examples, the substantially rigid body portion is defined by a thickness extending between the rear surface and the front surface. The thickness is defined by a first thickness portion and a second thickness portion. The second thickness portion is greater than the first thickness portion. The first thickness portion is defined by the base portion. The second thickness portion is defined by each of the first guide member and the second guide member extending away from the base portion.

In some implementations, the substantially rigid body portion is defined by a thickness extending between the rear surface and the front surface. The thickness is defined by a first thickness portion, a second thickness portion and a third thickness portion. The second thickness portion is greater than the first thickness portion. The third thickness portion is greater than the second thickness portion. The first thickness portion is defined by the base portion. The second thickness portion defines a pair of opposing intermediate step portions arranged respectively between the base portion and each of the first guide member and the second guide member. The third thickness portion is defined by each of the first guide member and the second guide member extending away from the base portion. An inner side surface of each intermediate step portion defines a substantially constant gap or spacing therebetween to define a substantially linear guide channel for the spine portion.

In some implementations, each of the first guide member and the second guide member include an outer side surface and an inner side surface. The inner side surface of each of the first guide member and the second guide member is defined by: an upper arcuate surface segment extending from the upper edge, a lower arcuate surface segment extending from the lower edge, and a substantially linear surface segment connecting the upper arcuate surface segment to the lower arcuate surface segment.

In some examples, the first guide member and the second guide member are arranged in an opposing, spaced apart relationship, converging at an angle or arranged in a substantially parallel relationship as the first guide member and the second guide member extend from the lower edge toward the upper edge to define the non-constant spacing between the inner side surface of each of the first guide member and the second guide member.

In some implementations, the non-constant spacing is defined by a first non-constant spacing, a second non-constant spacing and a third non-constant spacing. The first non-constant spacing is defined by a spaced-apart, opposing relationship of the upper arcuate surface segment of each of the first guide member and the second guide member. The second non-constant spacing is defined by a spaced-apart, opposing relationship of the substantially linear surface segment of each of the first guide member and the second guide member. The third non-constant spacing is defined by a spaced-apart, opposing relationship of the substantially linear surface segment of each of the first guide member and the second guide member. The second non-constant spacing is greater than third non-constant spacing. The third non-constant spacing is greater than the first non-constant spacing.

In some examples, the opening is defined by the upper edge of the substantially rigid body portion defined by the base portion of each of the first cradle portion half and the second cradle portion half and a portion of the upper arcuate surface segment of each of the first guide member and the second guide member that extends from the upper edge.

In some implementations, the opening is defined by a dimension substantially equal to the first non-constant spacing defined by the spaced-apart, opposing relationship of the upper arcuate surface segment of each of the first guide member and the second guide member. The first non-constant spacing is less than a width dimension defined by a head portion of the of the spine portion to prevent the head portion of the spine portion to be removed from the cavity. The first non-constant spacing is less than a width dimension defined by a shoulder portion of the of the spine portion to prevent the shoulder portion of the spine portion to be inserted into the cavity. The first non-constant spacing is greater than a width dimension defined by a neck portion of the of the spine portion to permit the neck portion of the spine portion to be movably-disposed within the opening.

In some implementations, at least a portion of each upper arcuate surface segment is further defined by a first roller member and a second roller member. The first roller member is rotatably-disposed between the base portion of each of the first cradle portion half and the second cradle portion half and opposite the first guide member proximate the upper edge of the substantially rigid body portion. The second roller member is rotatably-disposed between the base portion of each of the first cradle portion half and the second cradle portion half and opposite the second guide member proximate the upper edge of the substantially rigid body portion.

In some examples, the intermediate portion of the spine portion is removably-connected to a substantially rigid body of the load-interfacing portion by arranging the intermediate portion of the spine portion within at least one passage formed by the substantially rigid body portion.

In some implementations, the upper portion of the spine portion is removably-connected to a substantially rigid body of the load interfacing portion. The spine portion defines a plurality of vertically-aligned passages. Each passage of the plurality of vertically-aligned passages is sized for receiving at least one male portion of a plurality of vertically-aligned male portions extending from the substantially rigid body portion of the load-interfacing portion for removably-connecting the spine portion to the load-interfacing portion for defining a vertical adjustment system that permits the spine to be removably-connected to the substantially rigid body portion of the load-interfacing portion in a selectively-fixed vertical orientation of a plurality of vertically-fixed orientations.

In some examples, the load interfacing portion further includes a substantially flexible portion connected to the substantially rigid body. The substantially flexible portion includes: a base portion, a first flexible finger portion extending from the base portion, and a second flexible finger portion extending from the base portion.

In some implementations, the first flexible finger portion extends substantially diagonally away from the base portion. The second flexible finger portion extends substantially diagonally away from the base portion. The first flexible finger portion and the second flexible finger portion divergently extend from an upper edge of the base portion of the substantially flexible portion at an angle thereby defining the substantially flexible portion to have a V-shaped geometry.

In some examples the subassembly includes a vertical adjustment system connected to the cradle portion. The vertical adjustment system includes a rail portion and a clamping portion. The clamping portion is slidably-adjustable along the rail portion.

In some implementations, the rail portion is fixed to the cradle portion. The clamping portion is fixed to the spine portion.

In some examples, the load interfacing portion further includes a first flexible finger portion and a second flexible finger portion. The first flexible finger portion is integrally connected to and extends away from the upper edge of the substantially flexible body portion of the spine portion. The second flexible finger portion is integrally connected to and extends away from the upper edge of the substantially flexible body portion of the spine portion.

In some implementations, the first flexible finger portion extends substantially diagonally away from the upper edge of the substantially flexible body portion of the spine portion. The second flexible finger portion extends substantially diagonally away from the upper edge of the substantially flexible body portion of the spine portion. The first flexible finger portion and the second flexible finger portion divergently extend from the upper edge of the substantially flexible body portion of the spine portion at an angle.

Another aspect of the disclosure provides a carrier system. The carrier system includes a subassembly. The subassembly includes a cradle portion defining a cavity and a spine portion. The spine portion includes a lower portion, an intermediate portion and an upper portion located between the lower portion and the upper portion. The lower portion of the spine extends into the cavity by way of an opening formed by the cradle portion. The lower portion of the spine is non-removably-coupled to and free-floatingly-disposed within the cavity of the cradle portion. The intermediate portion and the upper portion of the spine portion are connected to a load-interfacing portion. The carrier system also includes a belt connected to the cradle portion.

Implementations of the disclosure may include one or more of the following optional features. For example, the carrier system further includes a load distribution assembly connected to the belt. The belt is indirectly connected to the cradle portion by way of the load distribution assembly.

In some examples, the carrier system further includes a vertical adjustment system. The vertical adjustment system is defined by a rail portion and a clamping portion. The clamping portion is slidably-adjustable along the rail portion.

In some implementations, the rail portion is fixed to the load distribution assembly. The clamping portion is fixed to the cradle portion.

In yet another aspect of the disclosure provides an assembly. The assembly includes a subassembly. The subassembly includes a cradle portion defining a cavity and a spine portion. The spine portion includes a lower portion, an intermediate portion and an upper portion located between the lower portion and the upper portion. The lower portion of the spine extends into the cavity by way of an opening formed by the cradle portion. The lower portion of the spine is non-removably-coupled to and free-floatingly-disposed within the cavity of the cradle portion. The intermediate portion and the upper portion of the spine portion are connected to a load-interfacing portion. The assembly also includes a load portion connected to the load-interfacing portion. The assembly also includes a belt connected to the cradle portion.

Implementations of the disclosure may include one or more of the following optional features. For example, the assembly includes a load distribution assembly connected to the belt. The belt is indirectly connected to the cradle portion by way of the load distribution assembly.

In some implementations, the load portion is a backpack removably-joined to the load interfacing portion. The backpack includes a first shoulder strap and a second shoulder strap. The load interfacing portion is disposed with a first passage formed by the first shoulder strap of the load portion and a second passage formed by the second shoulder strap of the load portion.

In some examples, the assembly further includes a vertical adjustment system. The vertical adjustment system is defined by a rail portion and a clamping portion. The clamping portion is slidably-adjustable along the rail portion.

In some instances, the rail portion is fixed to the load distribution assembly. The clamping portion is fixed to the cradle portion.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 7' is a rear view of an exemplary spine portion of a carrier system.

FIG. 10' is a rear view of one half of an exemplary cradle portion.

Like reference symbols in the various drawings indicate like elements.

DETAILED DESCRIPTION

The following disclosure defines a plurality of exemplary subassemblies 75 (see, e.g., FIG. 13), 75' (see, e.g., FIG. 13'), 75" (see, e.g., FIG. 22), 75'''(see, e.g., FIG. 24 or 25) including a plurality of interconnected components. Any of the exemplary subassemblies 75, 75', 75", 75''' may be included in a carrier system (see, e.g., 10 in FIG. 1) that may be removably-connected to a load portion (see, e.g., L, which may be, for example, a backpack, rucksack or the like) to define an assembly 50. Referring to FIGS. 17A-17D, the carrier system (including the load portion L attached thereto) may be arranged upon a user U such that most of the weight of the load portion L is distributed about the hips H (and not the torso T) of the user U by the carrier system 10.

Figure 1:
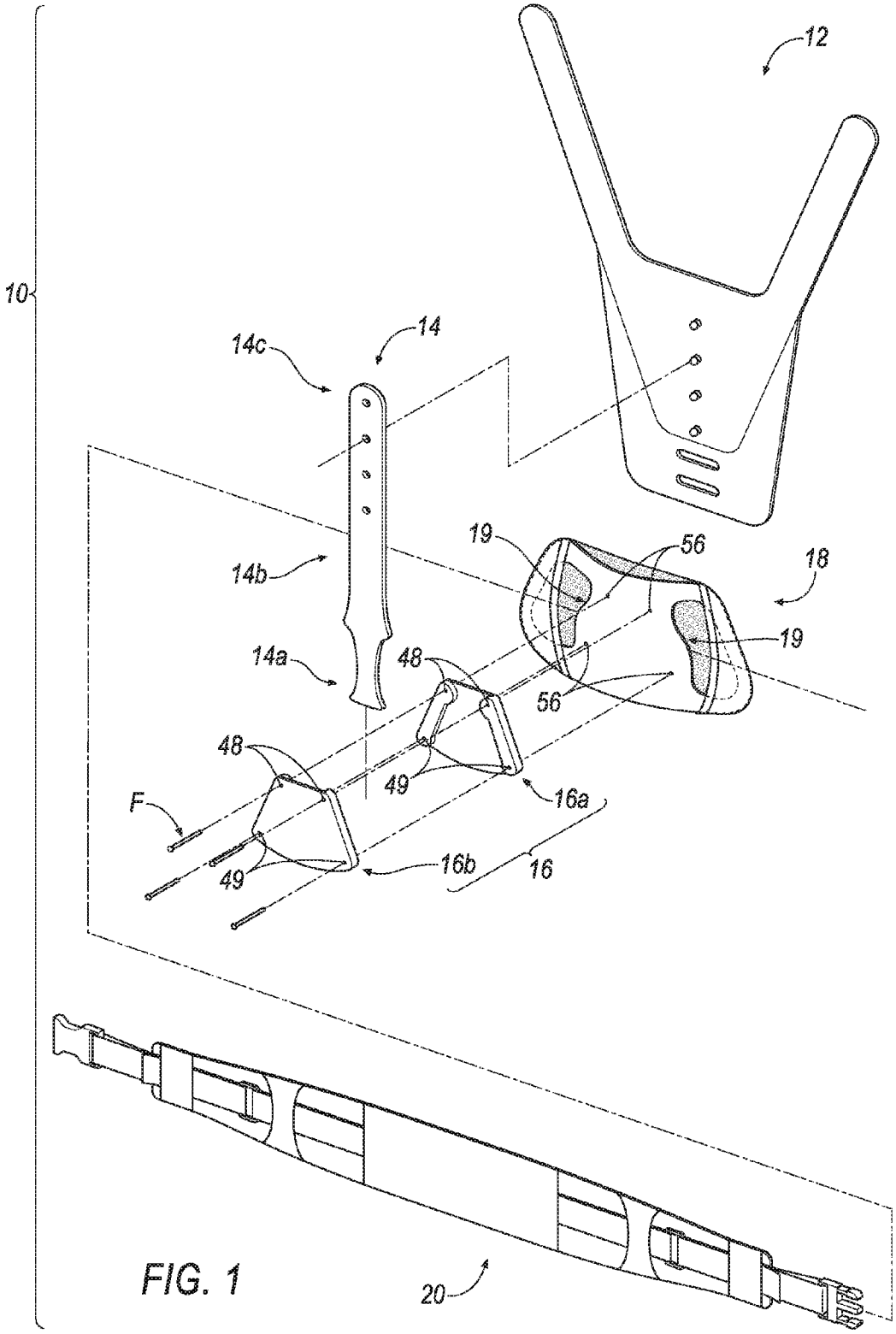
FIG. 1 is an exploded rear perspective view of an exemplary carrier system.
Figure 2A:
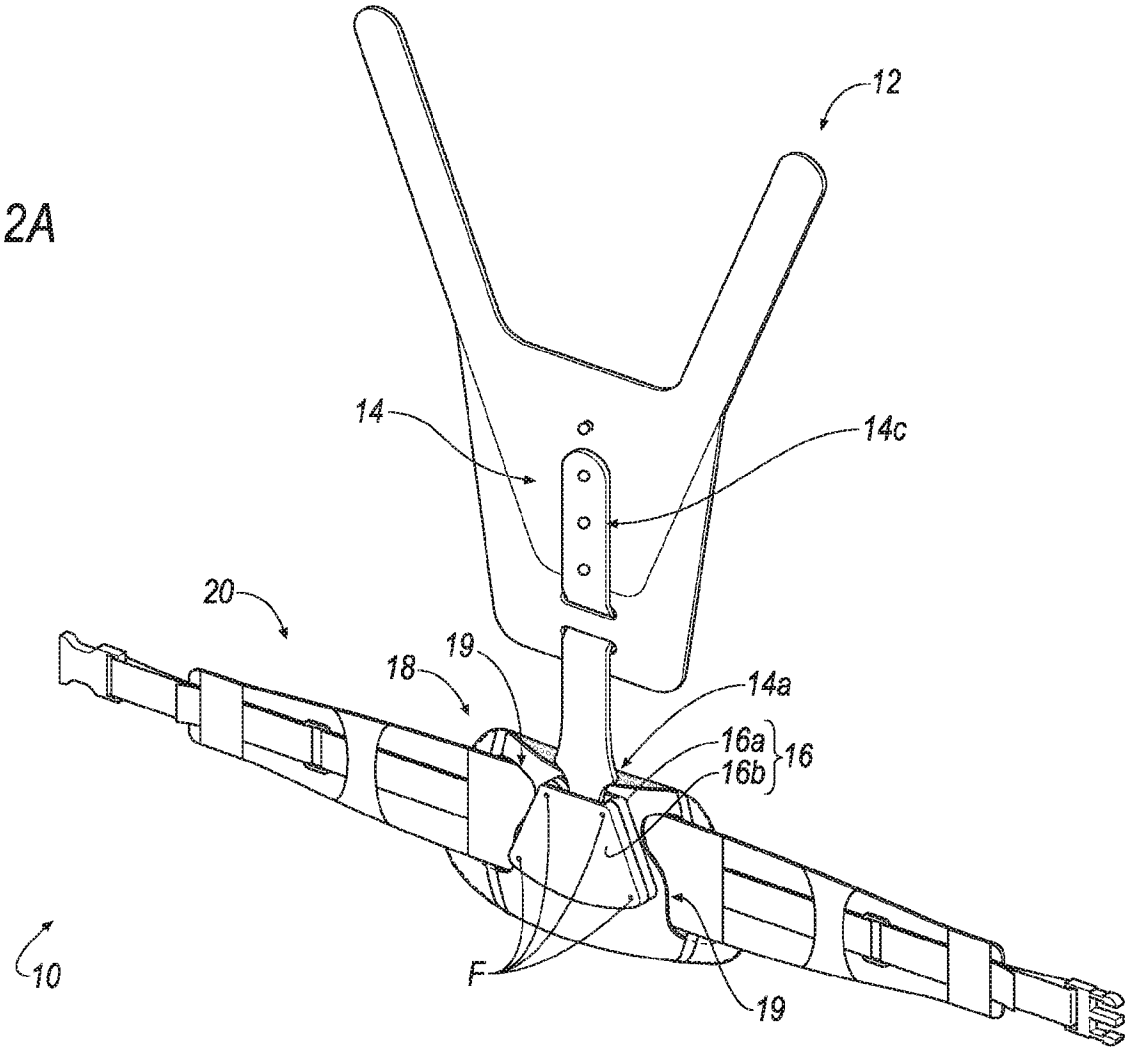
FIG. 2A is an assembled rear perspective view of the carrier system of FIG. 1.
Figure 2B:
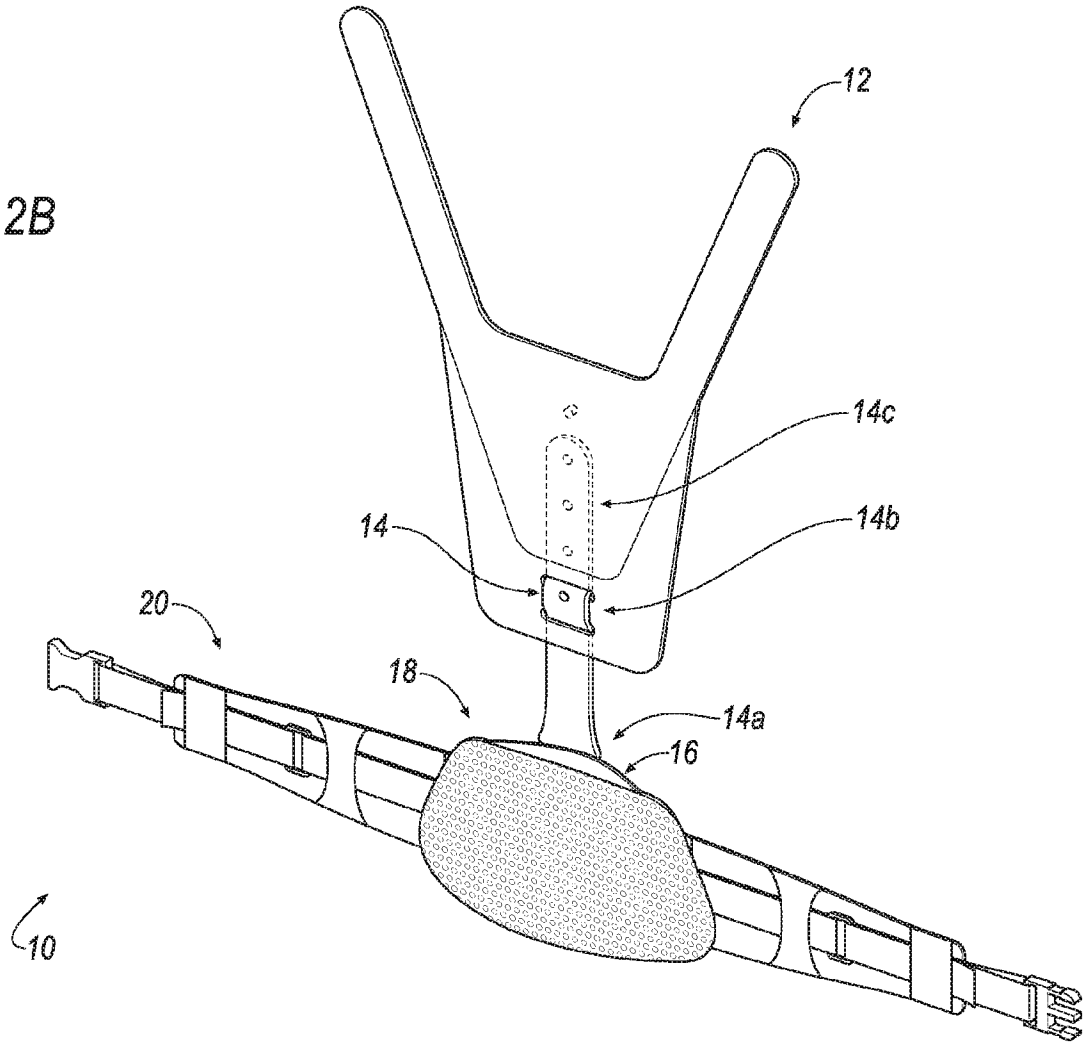
FIG. 2B is an assembled front perspective view of the carrier system of FIG. 1.
Figure 3:
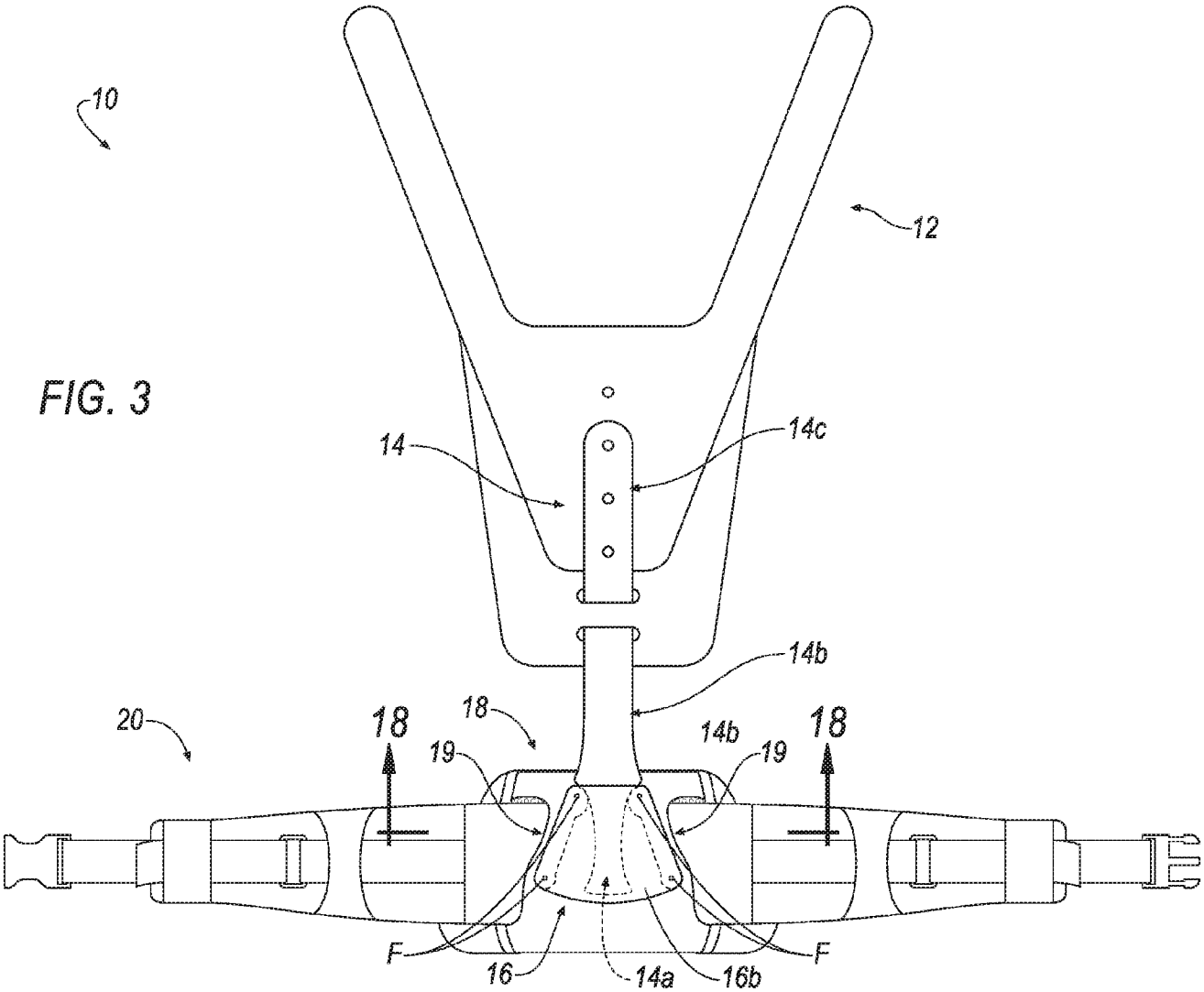
FIG. 3 is assembled rear view of the carrier system of FIG. 1.
Figure 15:
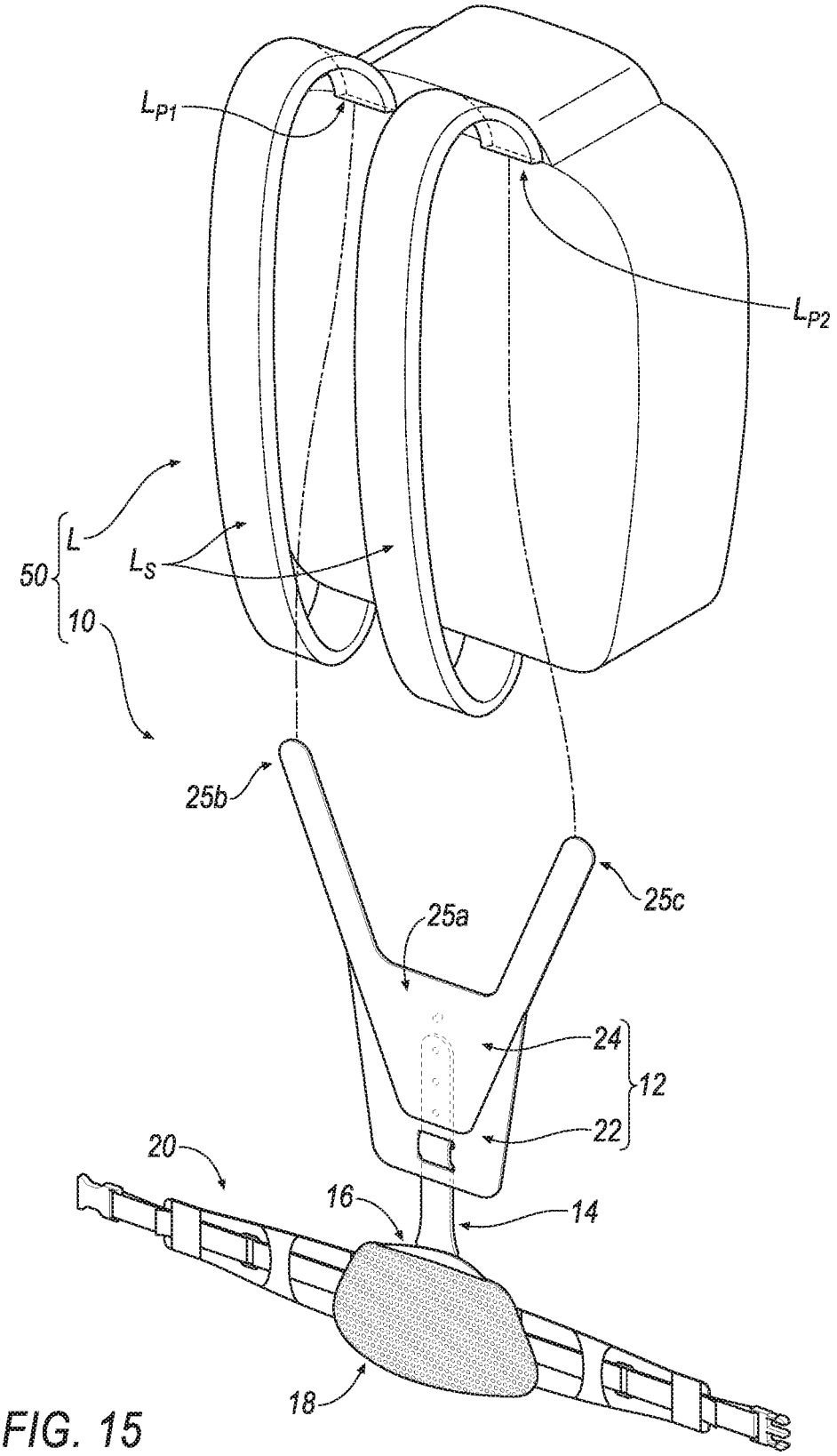
FIG. 15 is an exploded perspective view of an assembly including the carrier system of FIG. 2B and a load portion.
Figure 16:
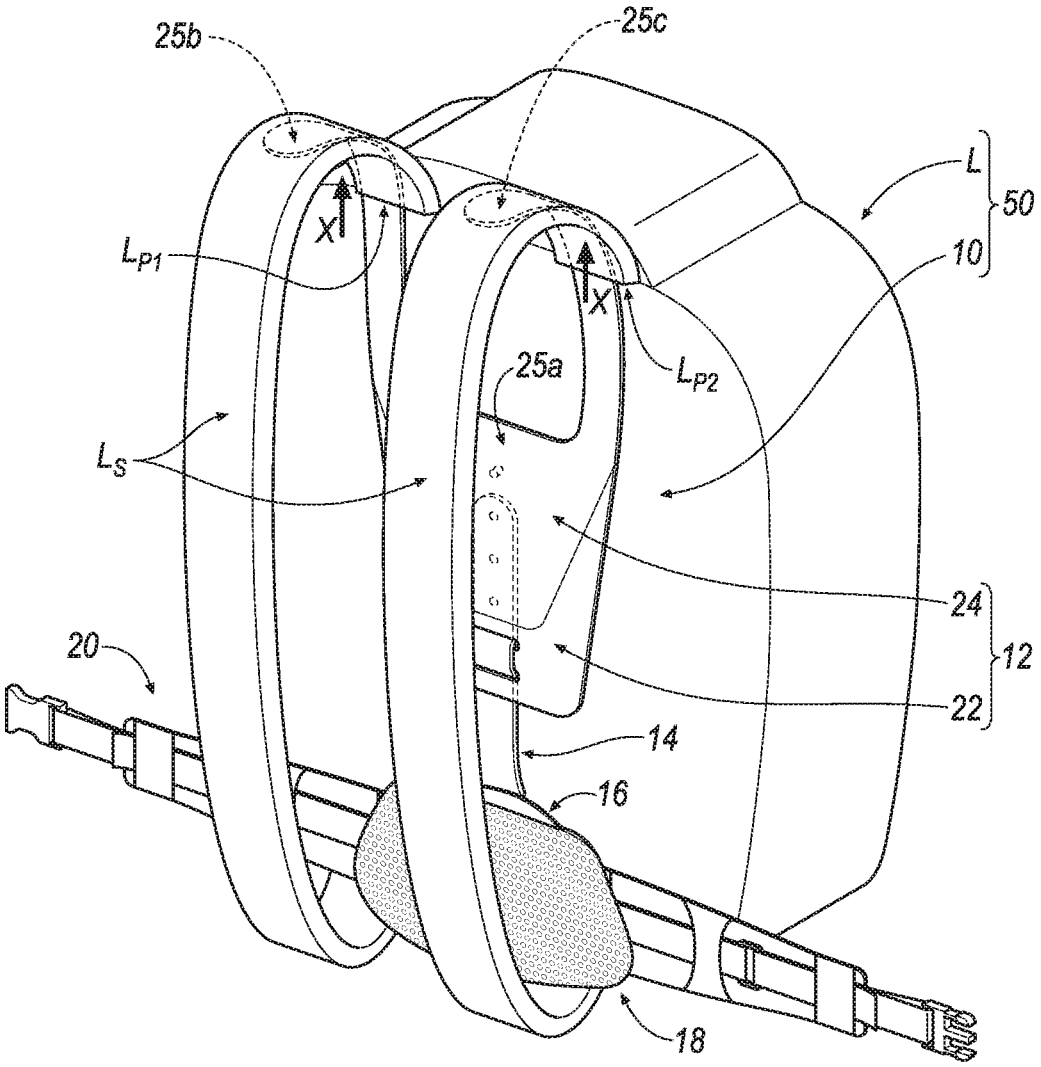
FIG. 16 is an assembled perspective view of the assembly of FIG. 15.
Figure 17B:
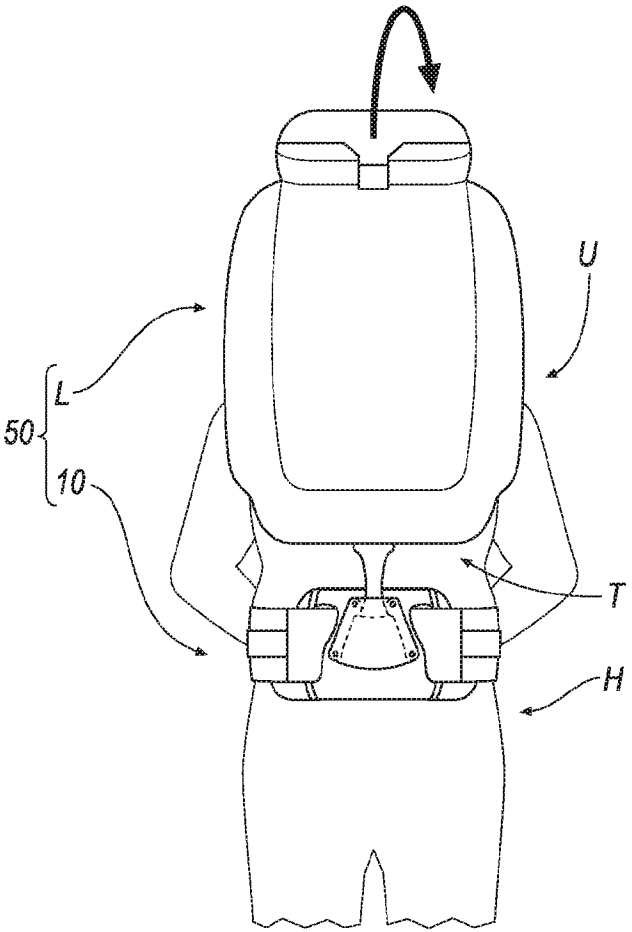
FIGS. 17A-17D are views of the assembly of FIG. 16 arranged upon a user.
Figure 17A:
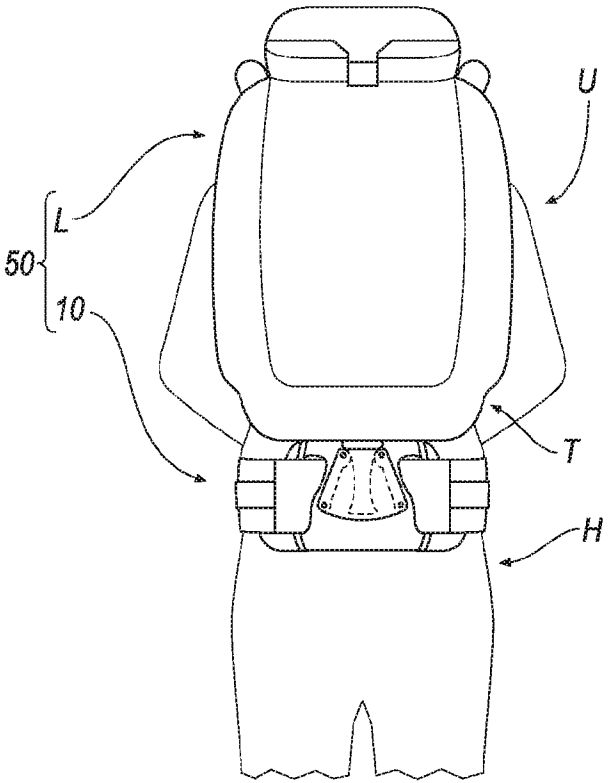
Figure 17D:
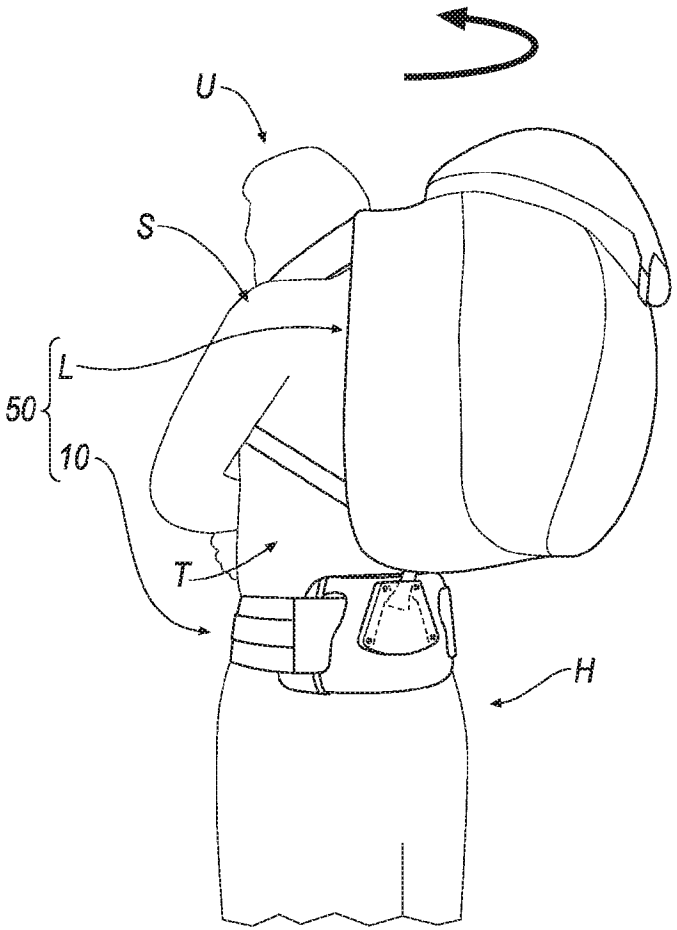
Figure 17C:
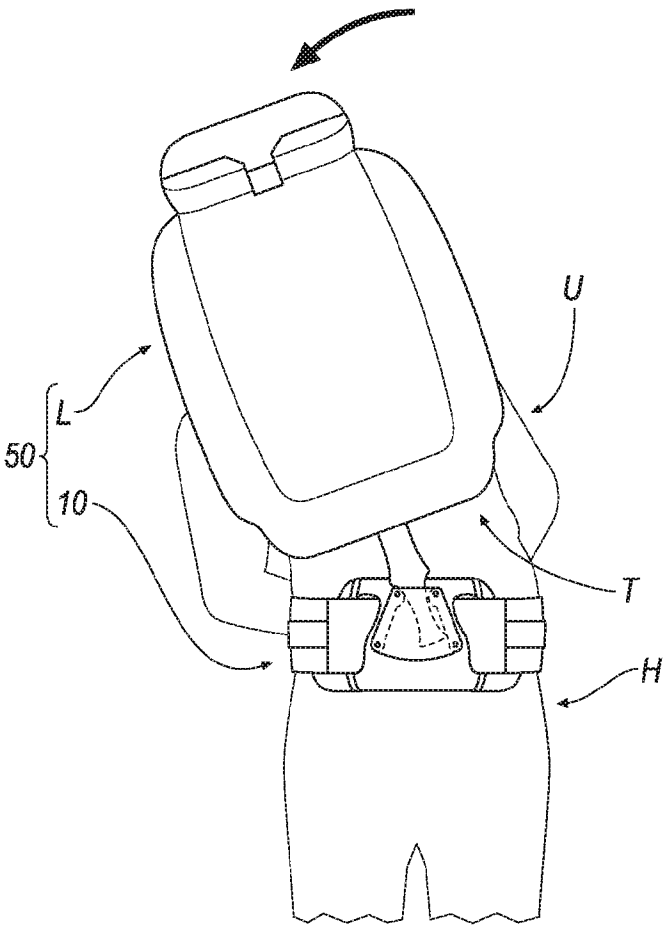

Referring to FIGS. 1-3, an exemplary carrier system is shown generally at 10. The carrier system 10 includes a plurality of interconnected components 12-20. As seen in FIGS. 15-16, the carrier system 10 may be removably-connected to a load portion L (e.g., a backpack, rucksack or the like) to define an assembly 50. Referring to FIGS. 17A-17D, the carrier system 10 (including the load portion L attached thereto) may be arranged upon a user U such that most of the weight of the load portion L is distributed about the hips H (and not the torso T) of the user U by the carrier system 10.

As will be described in the following disclosure (at, e.g., FIGS. 13 and 19A-20E), in some implementations, some of the interconnected components 12-20 defining the carrier system 10 may include a vertical adjustment system (see, e.g., 80 in FIG. 13 and/or 82 in FIGS. 19A-19E, 20A-20E) for selectively arranging some of the interconnected components 12-20 in a desired spatial configuration in order to accommodate a variety of user body profiles (i.e., differing heights of a number of users U). Furthermore, in some examples, some of the interconnected components 12-20 may be arranged/configured in a free-floating (see, e.g. FIGS. 14A-14D) and/or flexible, non-rigid configuration (see, e.g., FIGS. 17A-17D), thereby permitting the carrier system 10 to be twisted, turned, pitched, bent, torqued and/or extended when forces corresponding to one or more of a twisting, turning, pitching, bending, torquing and/or extending motion is/are imparted to the carrier system 10 by the user U.

Figure 13:
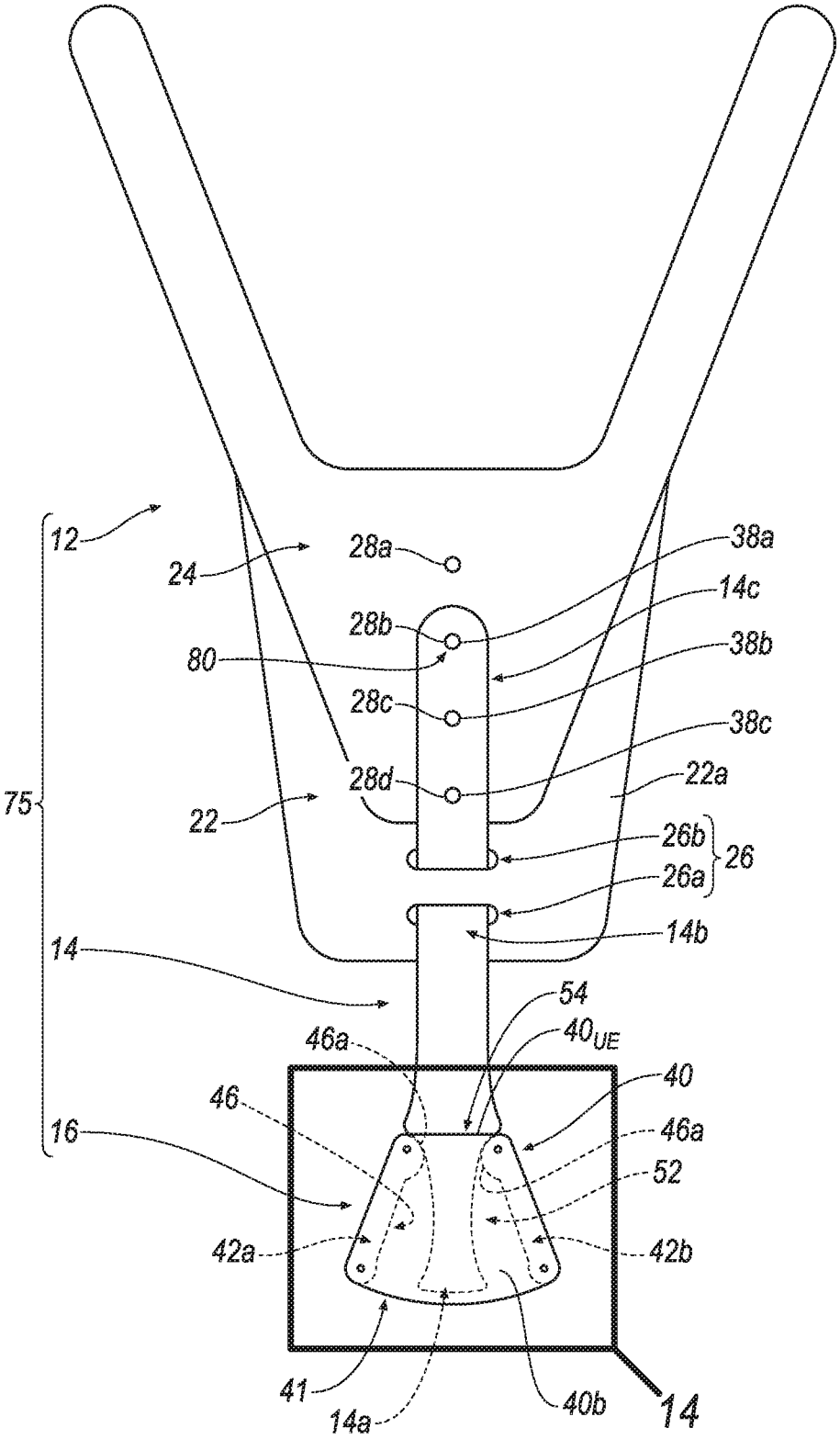
FIG. 13 is rear view of a subassembly including the load-interfacing portion of FIGS. 4A-6, the spine portion of FIGS. 7-9 and a cradle portion formed by two of the half cradle portion of FIGS. 10-12.

As seen in FIG. 1, the plurality of interconnected components defining the carrier system 10 may include a load-interfacing portion 12, a spine portion 14 and a cradle portion 16; in some examples the load-interfacing portion 12 is connected to the cradle portion 16 by the spine portion 14 for defining a subassembly 75 (see e.g., FIG. 13 of the carrier system 10). Optionally, the plurality of interconnected components 12-20 defining the carrier system 10 may also include a load distribution assembly 18 that is, for example, sized for arrangement over a lumbar area of the torso T of the user U. Exemplary configurations of the load distribution assembly 18 are described in U.S. Non-Provisional application Ser. No. 15/141,369 filed on Apr. 28, 2016 and are herein incorporated by reference. In some instances, the plurality of interconnected components 12-20 defining the carrier system 10 may also include a belt 20.

With reference to FIGS. 1-3, the belt 20 is shown coupled to the load distribution assembly 18 by inserting the belt 20 through openings 19 (see, e.g., FIGS. 1, 2A, 3) formed by the load distribution assembly 18. If, however, the load distribution assembly 18 is not optionally included in the design of the carrier system 10, the belt 20 may be connected to the cradle portion 16; the connection of the belt 20 to the cradle portion 16 may be conducted in any desirable manner (e.g., passing the belt 20 through passages formed by the cradle portion 16 or with an adhesive, fasteners, ultrasonic welding or the like).

Referring to FIGS. 4A-6, the load-interfacing portion 12 includes a substantially rigid body portion 22 and a substantially flexible portion 24. Although the load-interfacing portion 12 may be defined by a first component (i.e., the substantially rigid body portion 22) and a second component (i.e., the substantially flexible portion 24) as seen in, for example, FIG. 4A, the substantially rigid body portion 22 and the substantially flexible portion 24 may be integrated into a single component defining the load-interfacing portion 12. As will be shown and described in FIGS. 15-16, the substantially flexible portion 24 of the load-interfacing portion 12 of the carrier system 10 may be removably-joined with the load portion L for forming the assembly 50.

The load-interfacing portion 12 may comprise any desirable material. In some instances, the load-interfacing portion 12 may include plastic. In other examples, the load-interfacing portion 12 may include metal. In yet other examples, the load-interfacing portion 12 may include plastic and metal (e.g., the rigid body portion 22 may include plastic and the substantially flexible portion 24 may include metal that imparts a spring force; conversely, in some examples, the rigid body portion 22 may include metal and the substantially flexible portion 24 may include plastic that imparts a spring force).

Figure 4A:
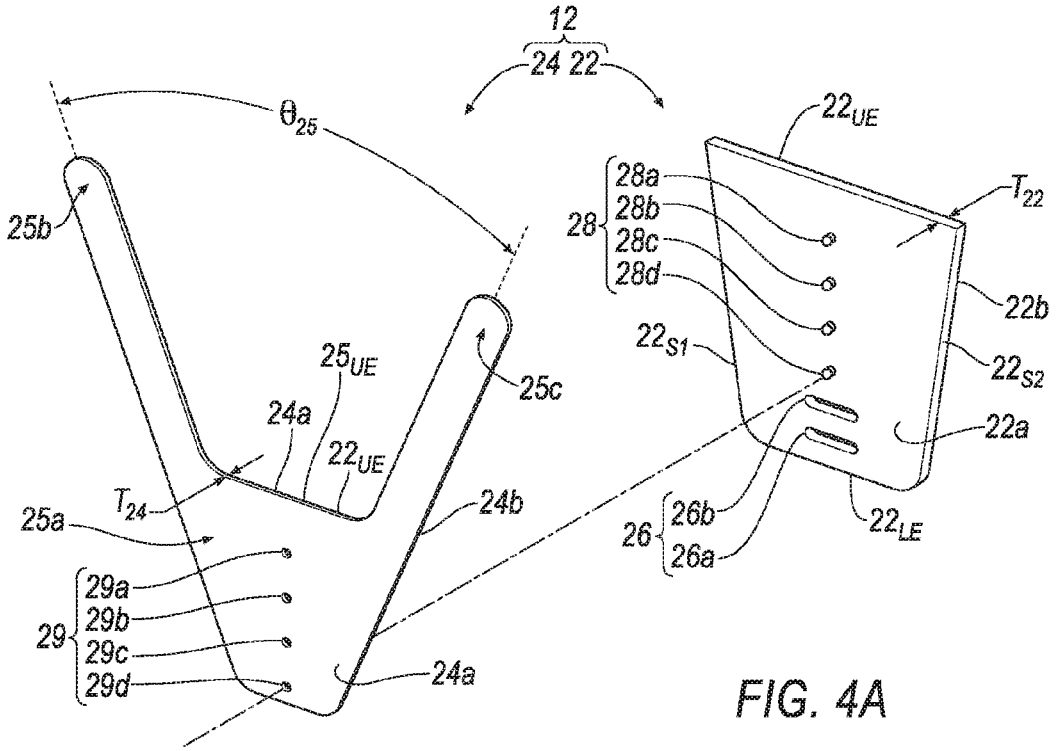
FIG. 4A is a rear exploded perspective view of a load-interfacing portion of the carrier system of FIG. 1.
Figure 4B:
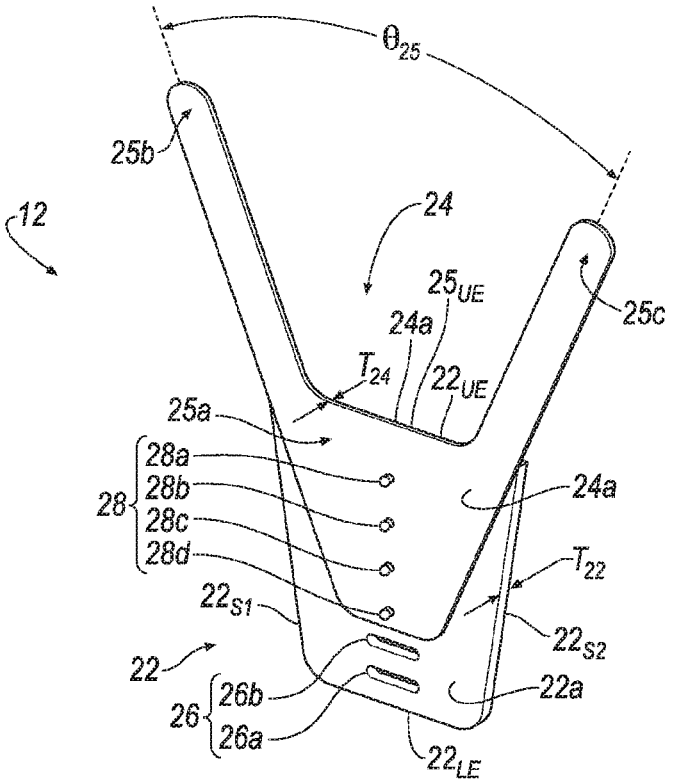
FIG. 4B is a rear assembled perspective view of the load-interfacing portion of FIG. 4A.
Figure 5:
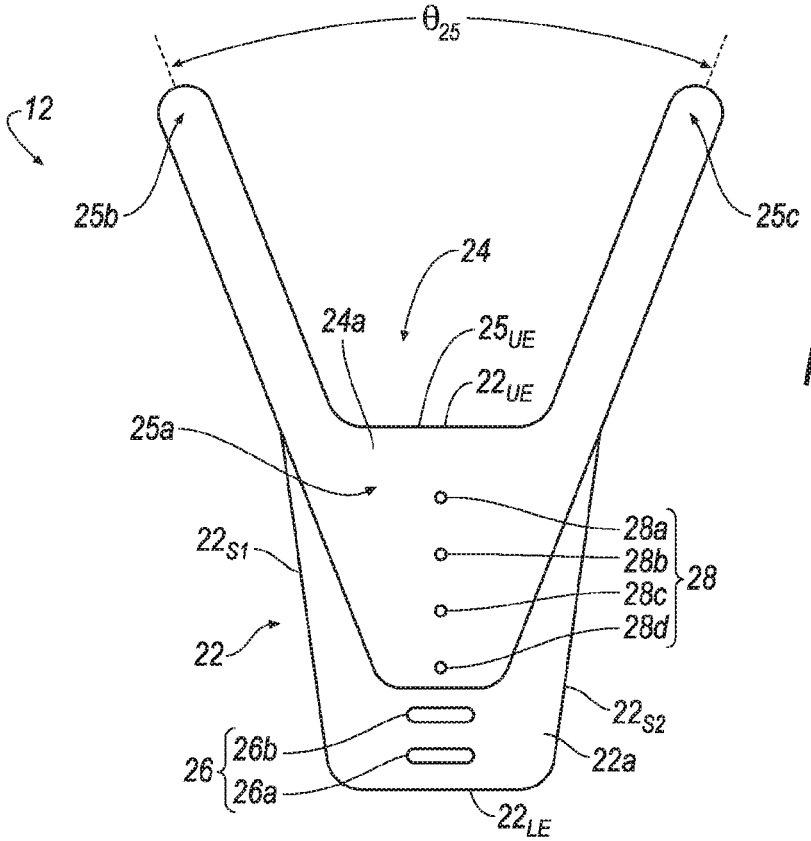
FIG. 5 is a rear view of the load-interfacing portion of FIGS. 4A-4B.
Figure 6:
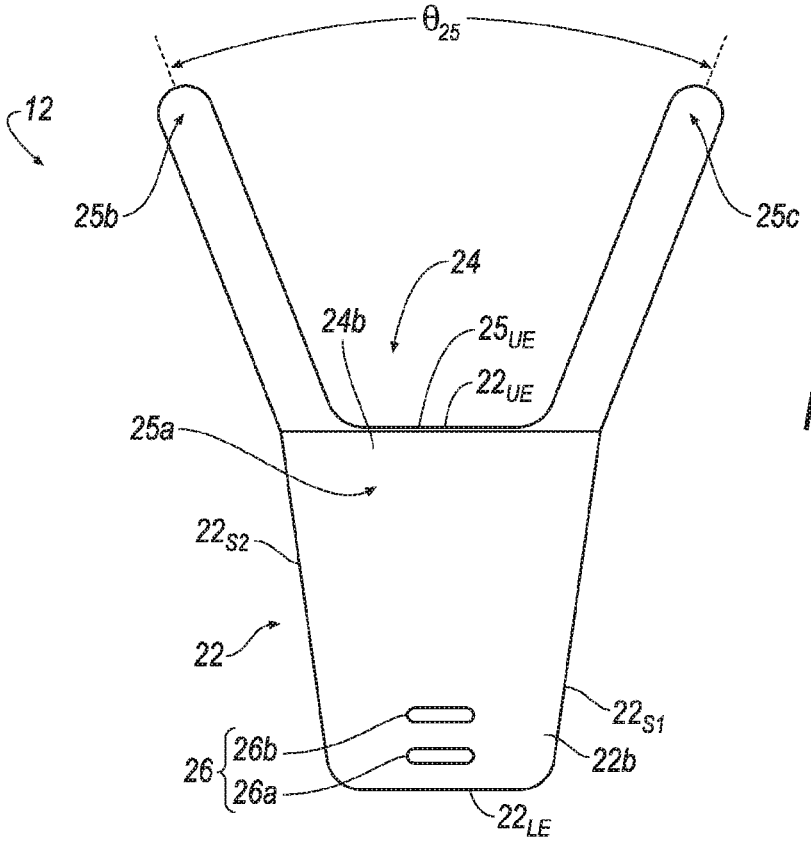
FIG. 6 is a front view of the load-interfacing portion of FIGS. 4A-4B.

In some examples, the substantially rigid body portion 22 may be defined by a substantially square-shaped geometry or a trapezoidal-shaped geometry having a rear surface 22*a* and a front surface 22*b*. Referring to FIG. 4A, the substantially rigid body portion 22 may be defined by a thickness $T_{22}$ extending between the rear surface 22*a* and the front surface 22*b*.

In some instances, the substantially flexible portion 24 may be defined by a V-shaped geometry or A-shaped geometry having a rear surface 24*a* and a front surface 24*b*. The A-shaped or V-shaped geometry may be defined by a base portion 25*a*, a first flexible finger portion 25*b* extending diagonally away from the base portion 25*a* and a second flexible finger portion 25*c* extending diagonally away from the base portion 25*a*. The first flexible finger portion 25*b* and the second flexible finger portion 25*c* may divergently diagonally extend from an upper edge $\mathbf{25}_{UE}$ of the base portion 25*a* at an angle $\theta_{25}$. Furthermore, the substantially flexible portion 24 may be defined by a thickness $T_{24}$ extending between the rear surface 22*a* and the front surface 22*b*.

In some instances, the thickness $T_{24}$ of the substantially flexible portion 24 may be less than the thickness $T_{22}$ of the substantially rigid body portion 22. The thickness $T_{24}$ of the substantially flexible portion 24 may be selectively sized in order to permit each of the first flexible finger portion 25*b* and the second flexible finger portion 25*c* to bend, imparting a spring force to the load portion L when the first flexible finger portion 25*b* and the second flexible finger portion 25*c* are removably-interfaced with the load portion L (as seen in, e.g., FIGS. 15-16).

The substantially rigid body portion 22 may be defined by a lower edge $\mathbf{22}_{LE}$ and an upper edge $\mathbf{22}_{UE}$; the lower edge $\mathbf{22}_{LE}$ is arranged opposite the upper edge $\mathbf{22}_{UE}$. The substantially rigid body portion 22 may also be defined by a first side edge $\mathbf{22}_{S1}$ and a second side edge $\mathbf{22}_{S2}$; the first side edge $\mathbf{22}_{S1}$ is arranged opposite the second side edge $\mathbf{22}_{S2}$. Each of the first side edge $\mathbf{22}_{S1}$ and the second side edge $\mathbf{22}_{S2}$ connect the lower edge $\mathbf{22}_{LE}$ to the upper edge $\mathbf{22}_{UE}$.

The substantially rigid body portion 22 may define a pair of vertically-aligned passages 26 that are located proximate the lower edge $\mathbf{22}_{LE}$. The pair of vertically-aligned passages 26 extend through the thickness $T_{22}$ of the substantially rigid body portion 22.

As seen in FIG. 4A, the substantially rigid body portion 22 may also include a plurality of vertically-aligned male portions 28. In some instances, the plurality of vertically-aligned male portions 28 may extend away from the rear surface 22*a* of the substantially rigid body portion 22. In some examples, a first male portion 28*a* of the plurality of vertically-aligned male portions 28 may be located proximate the upper edge $\mathbf{22}_{UE}$ and subsequent male portions 28*b*-28*d* of the plurality of vertically-aligned male portions 28 may be located progressively closer to the lower edge $\mathbf{22}_{LE}$ such that a last male portion 28*d* of the plurality of vertically-aligned male portions 28 may be located opposite the second passage 26*b* of the of pair of vertically-aligned passages 26.

Referring to FIG. 4A, the substantially flexible portion 24 may include a plurality of vertically-aligned passages 29 that are sized for receiving the plurality of vertically-aligned male portions 28 for connecting the substantially flexible portion 24 to the substantially rigid portion 22. Each male portion 28*a*-28*d* of the plurality of vertically-aligned male portions 28 is defined by a thickness that is greater than the thickness $T_{24}$ of the substantially flexible portion 24 such that upon inserting the plurality of vertically-aligned male portions 28 through the plurality of vertically-aligned passages 29, the plurality of vertically-aligned male portions 28 extend beyond the rear surface 24*a* of the substantially flexible portion 24.

Figure 9:
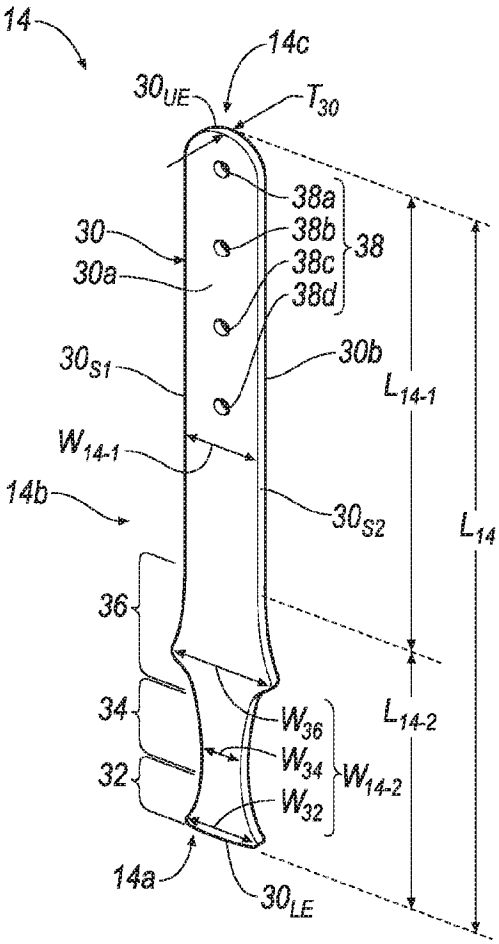
FIG. 9 is a rear or front perspective view of the spine portion of FIG. 7.
Figure 8:
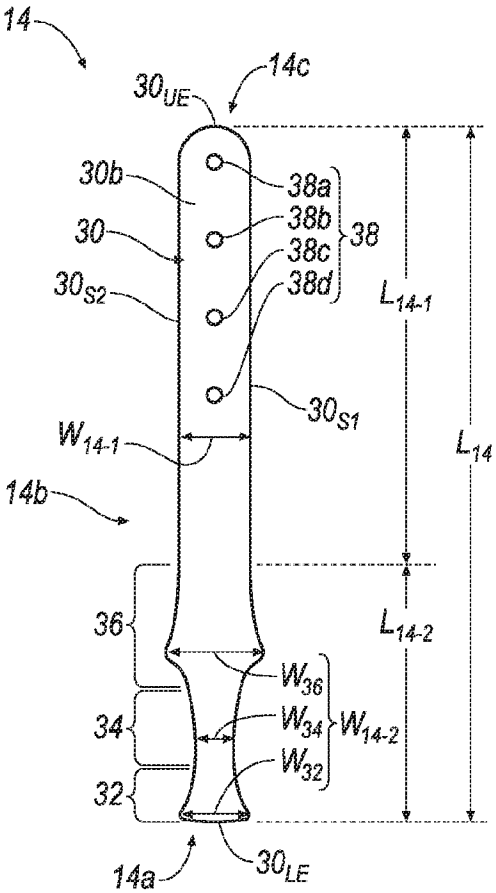
FIG. 8 is a front view of the spine portion of FIG. 7.
Figure 7:
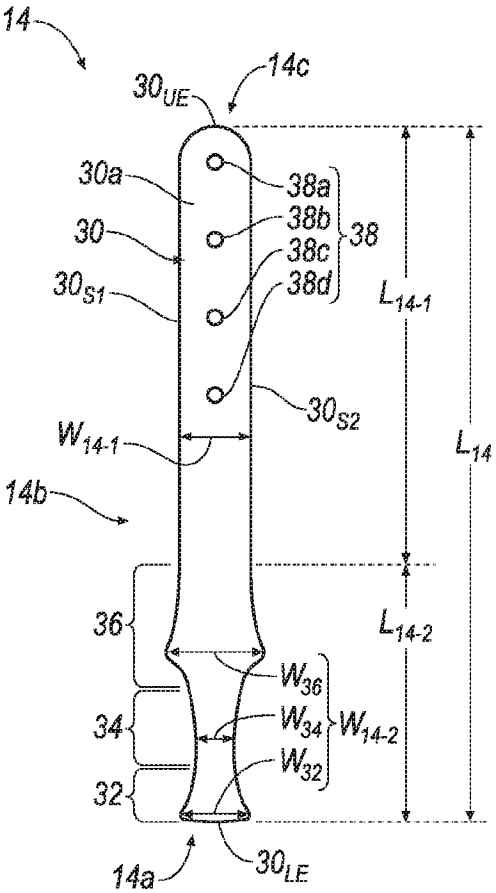
FIG. 7 is a rear view of an exemplary spine portion of the carrier system of FIG. 1.

Referring to FIGS. 7-9, the spine portion 14 includes a substantially flexible body portion 30. In some examples, the substantially flexible body portion 30 may be defined by a rectangular-shaped geometry having a rear surface 30*a* (see, e.g., FIG. 7) and a front surface 30*b* (see, e.g., FIG. 8). The substantially flexible body portion 30 may be defined by a thickness $T_{30}$ (see, e.g., FIG. 9) extending between the rear surface 30*a* and the front surface 30*b*.

The substantially flexible body portion 30 may be defined by a lower edge $\mathbf{30}_{LE}$ and an upper edge $\mathbf{30}_{UE}$; the lower edge $\mathbf{30}_{LE}$ is arranged opposite the upper edge $\mathbf{30}_{UE}$. The substantially flexible body portion 30 may also be defined by a first side edge $\mathbf{30}_{S1}$ and a second side edge $\mathbf{30}_{S2}$; the first side edge $\mathbf{30}_{S1}$ is arranged opposite the second side edge $\mathbf{30}_{S2}$. Each of the first side edge $\mathbf{30}_{S1}$ and the second side edge $\mathbf{30}_{S2}$ connect the lower edge $\mathbf{30}_{LE}$ to the upper edge $\mathbf{30}_{UE}$.

The first side edge $\mathbf{30}_{S1}$ and the second side edge $\mathbf{30}_{S2}$ define the substantially flexible body portion 30 to have a first, substantially constant width $W_{14-1}$ extending along a first portion $L_{14-1}$ of a length $L_{14}$ of the spine portion 14 and a second, non-constant width $W_{14-2}$ extending along a second portion $L_{14-2}$ of the length $L_{14}$ of the spine portion 14. The first portion $L_{14-1}$ of the length $L_{14}$ of the spine portion 14 extends away from the upper edge $\mathbf{30}_{UE}$ of the substantially flexible body portion 30. The second portion $L_{14-2}$ of the length $L_{14}$ of the spine portion 14 extends away from the lower edge $\mathbf{30}_{LE}$ of the substantially flexible body portion 30.

The second, non-constant width $W_{14-2}$ defines the second portion $L_{14-2}$ of the length $L_{14}$ of the spine portion 14 to form a head portion 32, a neck portion 34 and a shoulder portion 36. The head portion 32 extends away from the lower edge $\mathbf{30}_{LE}$ of the substantially flexible body portion 30 and may be defined by a non-constant width $W_{32}$. The neck portion 34 extends away from the head portion 32 and may be defined by a non-constant width $W_{34}$. The shoulder portion 36 extends away from the neck portion 34 and may be defined by a non-constant width $W_{36}$.

The non-constant width $W_{36}$ of the shoulder portion 36 may be greater than the non-constant width $W_{32}$ of the head portion 32, and, the non-constant width $W_{32}$ of the head portion 32 may be greater than the non-constant width $W_{34}$ of the neck portion 34. The non-constant widths $W_{32}$, $W_{34}$, $W_{36}$ of the head portion 32, the neck portion 34 and the shoulder portion 36 collectively defines the second, non-constant width $W_{14-2}$ extending along the second portion $L_{14-2}$ of the length $L_{14}$ of the spine portion 14.

The substantially flexible body portion 30 may define a plurality of vertically-aligned passages 38. A first passage 38*a* of the plurality of vertically-aligned passages 38 is located proximate the upper edge $\mathbf{30}_{UE}$ and subsequent passages 38*b*-38*d* of the plurality of vertically-aligned passages 38 may be located progressively closer to the lower edge $\mathbf{30}_{LE}$. In some examples, the plurality of vertically-aligned passages 38 are arranged along the first portion $L_{14-1}$ of the length $L_{14}$ of the spine portion 14 defined by the first, substantially constant width $W_{14-1}$. The plurality of vertically-aligned passages 38 extend through the thickness $T_{30}$ of the substantially flexible body portion 30.

Figure 12:
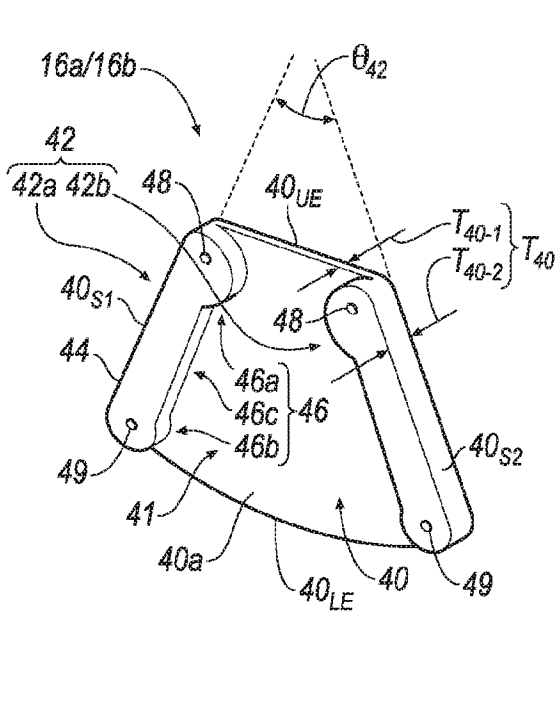
FIG. 12 is a rear perspective view of the half of the cradle portion of FIG. 10.
Figure 11:
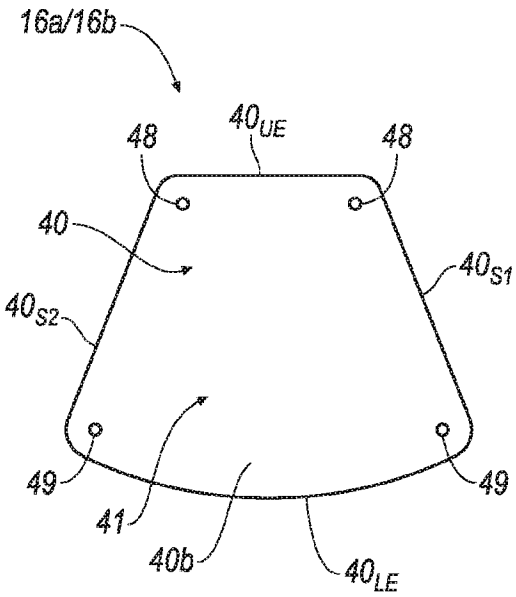
FIG. 11 is a front view of the half of the cradle portion of FIG. 10.
Figure 10:
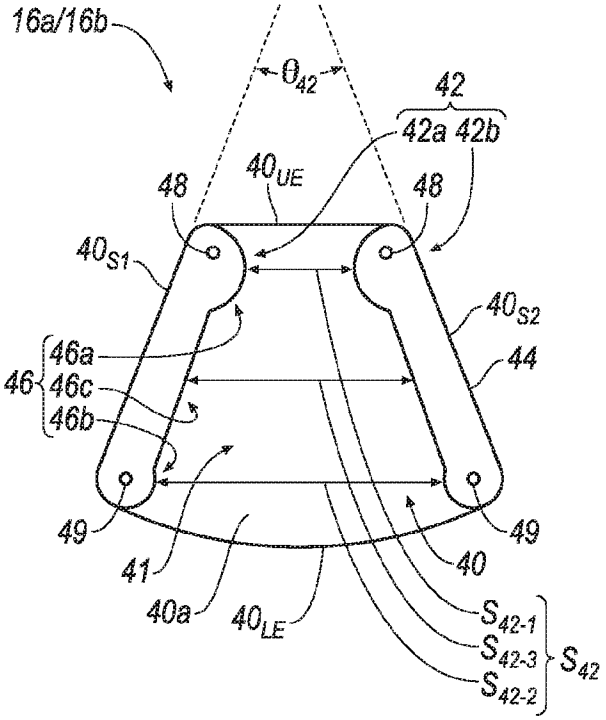
FIG. 10 is a rear view of one half of an exemplary cradle portion of the carrier system of FIG. 1.

Referring to FIGS. 10-12, a first cradle portion half 16*a*/a second cradle portion half 16*b* is shown; as seen in FIGS. 1, 2A and 3, when a first cradle portion half 16*a* and a second cradle portion half 16*b* are joined together, by, for example, fasteners F (see, e.g., FIG. 1), the first cradle portion half 16*a* and the second cradle portion half 16*b* collectively define the cradle portion 16. Because the first cradle portion half 16*a* and the second cradle portion half 16*b* are substantially identical, the following disclosure refers to a "cradle portion half 16*a*/16*b*" when describing the subject matter disclosed at FIGS. 10-12.

The cradle portion half 16*a*/16*b* is defined by a substantially rigid body portion 40. In some examples, the substantially rigid body portion 40 is defined by a substantially trapezoidal-shaped geometry having a rear surface 40*a* and a front surface 40*b*. The substantially rigid body portion 40 may be defined by a lower edge $\mathbf{40}_{LE}$ and an upper edge $\mathbf{40}_{UE}$; the lower edge $\mathbf{40}_{LE}$ is arranged opposite the upper edge $\mathbf{40}_{UE}$. The substantially rigid body portion 40 may also be defined by a first side edge $\mathbf{40}_{S1}$ and a second side edge $\mathbf{40}_{S2}$; the first side edge $\mathbf{40}_{S1}$ is arranged opposite the second side edge $\mathbf{40}_{S2}$. Each of the first side edge $\mathbf{40}_{S1}$ and the second side edge $\mathbf{40}_{S2}$ connect the lower edge $\mathbf{40}_{LE}$ to the upper edge $\mathbf{40}_{UE}$.

The substantially rigid body portion 40 may be defined by a thickness $T_{40}$ (see, e.g., FIGS. 12, 18) extending between the rear surface 40*a* and the front surface 40*b*. The thickness $T_{40}$ is defined by a first thickness portion $T_{40-1}$ and a second thickness portion $T_{40-2}$. The second thickness portion $T_{40-2}$ is greater than the first thickness portion $T_{40-1}$.

Figure 18:
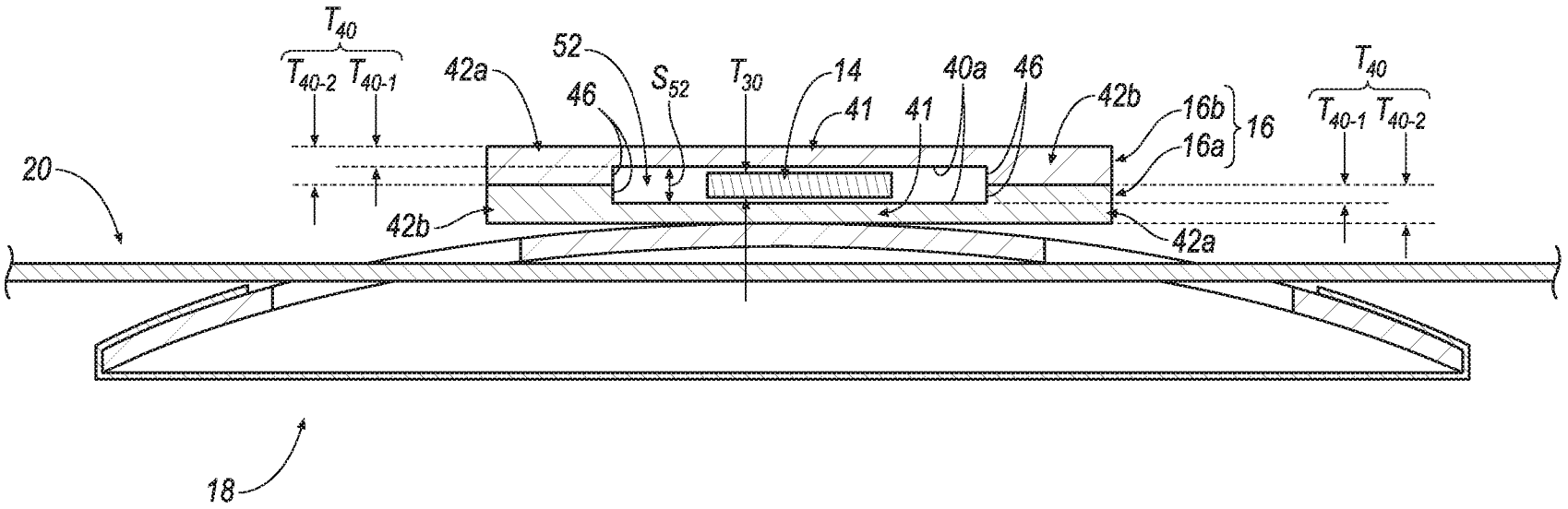
FIG. 18 is a cross-sectional view of carrier system according to line 18-18 of FIG. 3.

Furthermore, the first thickness portion $T_{40-1}$ may define the substantially rigid body portion 40 to include a base portion 41, and the second thickness portion $T_{40-2}$ may define a pair of guide members 42 extending from the base portion 41. The pair of guide members 42 include a first guide member 42*a* extending along the first side edge $\mathbf{40}_{S1}$ and a second guide member 42*b* extending along the second side edge $\mathbf{40}_{S2}$. Yet even further, as seen in FIG. 18, when first cradle portion half 16*a* and the second cradle portion half 16*b* are joined together by the fasteners F, the difference of the thicknesses $T_{40-1}$, $T_{40-2}$, and the arrangement of the first cradle portion half 16*a* disposed adjacent the second cradle portion half 16*b* results in the cradle portion 16 forming a cavity 52, which will be described in greater detail in the following disclosure.

Referring back to FIGS. 10-12, each of the first guide member 42*a* and the second guide member 42*b* include an outer side surface 44 and an inner side surface 46. The inner side surface 46 of each of the first guide member 42*a* and the second guide member 42*b* is defined by: (1) an upper arcuate surface segment 46*a* extending from the upper edge $\mathbf{40}_{UE}$, (2) a lower arcuate surface segment 46*b* extending from the lower edge $\mathbf{40}_{LE}$, and (3) a substantially linear surface segment 46*c* connecting the upper arcuate surface segment 46*a* to the lower arcuate surface segment 46*b*.

Each of the first guide member 42*a* and the second guide member 42*b* may define an upper fastener passage 48 and a lower fastener passage 49. The upper fastener passage 48 may be formed proximate the upper arcuate surface segment 46*a*. The lower fastener passage 49 may be formed proximate the lower arcuate surface segment 46*b*. Each of the upper fastener passage 48 and the lower fastener passage 49 may extend through the first thickness portion $T_{40-1}$ defined by the base portion 41 and the second thickness portion $T_{40-2}$ defined by each of the first guide member 42*a* and the second guide member 42*b*.

The first guide member 42*a* and the second guide member 42*b* are arranged in an opposing, spaced apart relationship, converging at an angle $\theta_{42}$ as the first guide member 42*a* and the second guide member 42*b* extend from the lower edge $\mathbf{40}_{LE}$ toward the upper edge $\mathbf{40}_{UE}$. In some examples, the first guide member 42*a* and the second guide member 42*b* define a non-constant gap or spacing $S_{42}$ (see, e.g., FIG. 10) between the inner side surface 46 of each of the first guide member 42*a* and the second guide member 42*b*.

As seen in FIG. 10, the non-constant gap or spacing $S_{42}$ is generally defined by a first non-constant spacing $S_{42-1}$, a second non-constant spacing $S_{42-2}$, and a third non-constant spacing $S_{42-3}$. The first non-constant spacing $S_{42-1}$ is defined by a spaced-apart, opposing relationship of the upper arcuate surface segment 46*a* of each of the first guide member 42*a* and the second guide member 42*b*. The second non-constant spacing $S_{42-2}$ is defined by a spaced-apart, opposing relationship of the lower arcuate surface segment 46*b* of each of the first guide member 42*a* and the second guide member 42*b*. The third non-constant spacing $S_{42-3}$ is defined by a spaced-apart, opposing relationship of the substantially linear surface segment 46*c* of each of the first guide member 42*a* and the second guide member 42*b*. The second non-constant spacing $S_{42-2}$ is greater than third non-constant spacing $S_{42-3}$, and, the third non-constant spacing $S_{42-3}$ is greater than the first non-constant spacing $S_{42-1}$.

With reference back to FIG. 1, the spine portion 14 generally includes a lower portion 14*a*, an intermediate portion 14*b* and an upper portion 14*c*. The intermediate portion 14*b* is located between the lower portion 14*a* and the upper portion 14*c*.

Referring to FIG. 13, a subassembly 75 of the carrier system 10 is generally defined by a connection of the load-interfacing portion 12 to the cradle portion 16 by the spine portion 14. In an example, the lower portion 14*a* of the spine portion 14 is non-removably-coupled to and free-floatingly-disposed within the cavity 52 (see also, e.g., FIG. 18) formed by the cradle portion 16. With reference to FIGS. 13 and 18, the cavity 52 may be generally defined by: (1) opposing inner side surfaces 46 of each of the first guide member 42*a* and the second guide member 42*b* of both of the first cradle portion half 16*a* and the second cradle portion half 16*b* and (2) opposing rear surfaces 40*a* of the base portion 41 of each of the first cradle portion half 16*a* and the second cradle portion half 16*b*. Furthermore, as seen in FIG. 18, the cavity 52 may be defined by a substantially constant spacing $S_{S2}$ extending between the opposing rear surfaces 40*a* of the base portion 41 of each of the first cradle portion half 16*a* and the second cradle portion half 16*b*; in order to permit the free-floating arrangement of the spine portion 14 relative the cradle portion 16, the substantially constant spacing $S_{S2}$ extending between the opposing rear surfaces 40*a* of the base portion 41 of each of the first cradle portion half 16*a* and the second cradle portion half 16*b* is greater than the thickness $T_{30}$ extending between the rear surface 30*a* and the front surface 30*b* of the spine portion 14.

Referring back to FIG. 13, access to the cavity 52 is permitted by an upper opening 54 formed by the cradle portion 16. In an example, the upper opening 54 is defined by: (1) the upper edge $\mathbf{40}_{UE}$ of the substantially rigid body portion 40 defined by the base portion 41 of each of the first cradle portion half 16*a* and the second cradle portion half 16*b* and (2) a portion of the upper arcuate surface segment 46*a* of each of the first guide member 42*a* and the second guide member 42*b* that extends from the upper edge $\mathbf{40}_{UE}$.

As seen in each of FIGS. 14A-14D, because the upper opening 54 is defined, in part, by a portion of the upper arcuate segment 46*a* of each of the first guide member 42*a* and the second guide member 42*b* that extends from the upper edge $\mathbf{40}_{UE}$, the upper opening 54 may be defined by a dimension substantially equal to the first non-constant spacing $S_{42-1}$. Comparatively, as seen in FIGS. 14A-14D, a largest width of the non-constant width $W_{32}$ defined by the head portion 32 of the of the spine portion 14 is greater than the smallest spacing of the first non-constant spacing $S_{42-1}$ that defines the upper opening 54. Further, comparatively, as seen in FIGS. 14A-14D, a largest width of the non-constant width $W_{36}$ defined by the shoulder portion 36 of the of the spine portion 14 is greater than the smallest spacing of the first non-constant spacing $S_{42-1}$ that defines the upper opening 54. Yet even further, any portion of the non-constant width $W_{34}$ of the neck portion 34 of the spine portion 14 is less than the smallest spacing of the first non-constant spacing $S_{42-1}$ that defines the upper opening 54.

As a result of the relative dimensions of the smallest spacing of the first non-constant spacing $S_{42-1}$ that defines the upper opening 54 of the cradle portion 16 and: (1) the largest width of the non-constant width $W_{32}$ of the head portion 32 and (2) any portion of the non-constant width $W_{34}$ of the neck portion 34, the neck portion 34 is permitted to be movably-disposed within the upper opening 54 (as seen in FIGS. 14B-14C) while the head portion 32 is not permitted to pass through the upper opening 54 (as seen in, e.g., FIG. 14D) such that the head portion 32 is retained within the cavity 52. Furthermore, as a result of the relative dimensions of the smallest spacing of the first non-constant spacing $S_{42-1}$ that defines the upper opening 54 of the cradle portion 16 and: (1) the largest width of the non-constant width $W_{36}$ of the shoulder portion 36 and (2) any portion of the non-constant width $W_{34}$ of the neck portion 34, the neck portion 34 is permitted to be movably-disposed within the upper opening 54 (as seen in FIGS. 14B-14C) while the shoulder portion 36 is not permitted to pass through the upper opening 54 and into the cavity 52 (as seen in, e.g., FIG. 14A).

Referring back to FIG. 13, the intermediate portion 14*b* of the spine portion 14 is shown connected to the of the substantially rigid body portion 22 of the load-interfacing portion 12 for further defining the subassembly 75 of the carrier system 10. In an example the intermediate portion 14*b* of the spine portion 14 is inserted: (1) through a first passage 26*a* of the pair of vertically-aligned passages 26 from the rear surface 22*a* of the substantially rigid body portion 22 of the load-interfacing portion 12 toward the front surface 22*b* of the substantially rigid body portion 22 of the load-interfacing portion 12 and then (2) through a second passage 26*b* of the pair of vertically-aligned passages 26 from the front surface 22*b* of the substantially rigid body portion 22 of the load-interfacing portion 12 toward the rear surface 22*a* of the substantially rigid body portion 22 of the load-interfacing portion 12 for connecting intermediate portion 14*b* of the spine portion 14 to the load-interfacing portion 12.

With continued reference to FIG. 13, the upper portion 14*c* of the spine portion 14 is shown connected to the substantially rigid body portion 22 of the load-interfacing portion 12 for further defining the subassembly 75 of the carrier system 10. Each passage 38*a*-38*d* of the plurality of vertically-aligned passages 38 formed by the spine portion 14 is sized for receiving at least one male portion 28*a*-28*d* of the plurality of vertically-aligned male portions 28 of the substantially rigid body portion 22 of the load-interfacing portion 12 for removably-connecting the spine portion 14 to the load-interfacing portion 12 in one vertically-fixed orientation of a plurality of vertically-fixed orientations. The plurality of vertically-aligned male portions 28 extending from the load-interfacing portion 12 cooperating with the plurality of vertically-aligned passages 38 formed by the spine portion 14 may define a vertical adjustment system 80 of the carrier system 10 for accommodating differing heights of a number of users U.

In an example, as seen in FIG. 13, three of the male portions 28*b*-28*d* of the plurality of vertically-aligned male portions 28 are shown arranged within the first three passages 38*a*-38*c* of the plurality of vertically-aligned passages 38. The provision of the ability to removably-connect the spine portion 14 to the load-interfacing portion 12 in one vertically-fixed orientation of a plurality of vertically-fixed orientations permits the carrier system 10 to be selectively vertically extended or retracted in order to accommodate a variety of user body profiles (i.e., differing heights of a number of users U). The number of vertically-fixed orientations provided by the carrier system 10 may be refined by providing an additional or lesser amount of male portions 28*a*-28*d* of the plurality of vertically-aligned male portions 28 and passages 38*a*-38*d* of the plurality of vertically-aligned passages 38.

Although an exemplary spine portion 14 and an exemplary cradle portion 16 of the exemplary subassembly 75 of the exemplary carrier system 10 has been respectively described above at FIGS. 7-9 and 10-12, the exemplary subassembly 75 of the exemplary carrier system 10 is not limited to including the exemplary spine portion 14 and the exemplary cradle portion 16 described above respectively at FIGS. 7-9 and 10-12. In an example, an exemplary spine portion 14' is shown and described at FIGS. 7'-9' and an exemplary cradle portion 16' is shown and described at FIGS. 10'-12'. The exemplary spine portion 14' and the exemplary cradle portion 16' may be incorporated into an exemplary subassembly 75' (see, e.g., FIG. 13'); as similarly described above, the subassembly 75' may be attached to one or more of a load distribution assembly 18 and a belt 20 for forming an exemplary carrier system 10. Similarly, as described above, the carrier system 10 (including the subassembly 75') may be removably-joined to the load portion L for forming an assembly 50.

Referring to FIGS. 7'-9', the spine portion 14' includes a substantially flexible body portion 30'. In some examples, the substantially flexible body portion 30' may be defined by a rectangular-shaped geometry having a rear surface 30*a*' (see, e.g., FIG. 7') and a front surface 30*b*' (see, e.g., FIG. 8'). The substantially flexible body portion 30' may be defined by a thickness $T_{30}$' (see, e.g., FIG. 9') extending between the rear surface 30*a*' and the front surface 30*b'*.

The substantially flexible body portion 30' may be defined by a lower edge $\mathbf{30}_{LE}$' and an upper edge $\mathbf{30}_{UE}$'; the lower edge $\mathbf{30}_{LE}$' is arranged opposite the upper edge $\mathbf{30}_{UE}$'. The substantially flexible body portion 30' may also be defined by a first side edge $\mathbf{30}_{S1}$' and a second side edge $\mathbf{30}_{S2}$'; the first side edge $\mathbf{30}_{S1}$' is arranged opposite the second side edge $\mathbf{30}_{S2}$'. Each of the first side edge $\mathbf{30}_{S1}$' and the second side edge $\mathbf{30}_{S2}$' connect the lower edge $\mathbf{30}_{LE}$' to the upper edge $\mathbf{30}_{UE}$'.

The first side edge $\mathbf{30}_{S1}$' and the second side edge $\mathbf{30}_{S2}$' define the substantially flexible body portion 30' to have a first, substantially constant width $W_{14-1}$' extending along a first portion $L_{14-1}$' of a length $L_{14}$' of the spine portion 14' and a second, non-constant width $W_{14-2}$' extending along a second portion $L_{14-2}$' of the length $L_{14}$' of the spine portion 14'. The first portion $L_{14-1}$' of the length $L_{14}$' of the spine portion 14' extends away from the upper edge $\mathbf{30}_{UE}$' of the substantially flexible body portion 30'. The second portion $L_{14-2}$' of the length $L_{14}$' of the spine portion 14' extends away from the lower edge $\mathbf{30}_{LE}$' of the substantially flexible body portion 30'.

The second, non-constant width $W_{14-2}$' defines the second portion $L_{14-2}$' of the length $L_{14}$' of the spine portion 14' to form a head portion 32', a neck portion 34' and a shoulder portion 36'. The head portion 32' extends away from the lower edge $\mathbf{30}_{LE}$' of the substantially flexible body portion 30' and may be defined by a non-constant width $W_{32}$'. The neck portion 34' extends away from the head portion 32' and may be defined by a non-constant width $W_{34}$'. The shoulder portion 36' extends away from the neck portion 34' and may be defined by a non-constant width $W_{36}$'.

The non-constant width $W_{36}$' of the shoulder portion 36' may be greater than the non-constant width $W_{32}$' of the head portion 32', and, the non-constant width $W_{32}$' of the head portion 32' may be greater than the non-constant width $W_{34}$' of the neck portion 34'. The non-constant widths $W_{32}$', $W_{34}$', $W_{36}$' of the head portion 32', the neck portion 34' and the shoulder portion 36' collectively defines the second, non-constant width $W_{14-2}$' extending along the second portion $L_{14-2}$' of the length $L_{14}$' of the spine portion 14'.

The substantially flexible body portion 30' may define a plurality of vertically-aligned passages 38'. A first passage 38*a*' of the plurality of vertically-aligned passages 38' is located proximate the upper edge $\mathbf{30}_{UE}$' and subsequent passages 38*b*'-38*d*' of the plurality of vertically-aligned passages 38' may be located progressively closer to the lower edge $\mathbf{30}_{LE}$'. In some examples, the plurality of vertically-aligned passages 38' are arranged along the first portion $L_{14-1}$' of the length $L_{14}$' of the spine portion 14' defined by the first, substantially constant width $W_{14-1}$'. The plurality of vertically-aligned passages 38' extend through the thickness $T_{30}$' of the substantially flexible body portion 30'.

Referring to FIGS. 10'-12', a first cradle portion half 16*a*'/a second cradle portion half 16*b*' is shown; in a substantially similar as described above at FIGS. 1, 2A and 3 in association with the cradle portion 16 including the first cradle portion half 16*a* and the second cradle portion half 16*b*, when a first cradle portion half 16*a*' and a second cradle portion half 16*b*' are joined together, by, for example, fasteners F (see, e.g., FIG. 1), the first cradle portion half 16*a*' and the second cradle portion half 16*b*' collectively define the cradle portion 16'. Because the first cradle portion half 16*a*' and the second cradle portion half 16*b*' are substantially identical, the following disclosure refers to a "cradle portion half 16*a*'/16*b*'" when describing the subject matter disclosed at FIGS. 10'-12'.

The cradle portion half 16*a*'/16*b*' is defined by a substantially rigid body portion 40'. In some examples, the substantially rigid body portion 40' is defined by a substantially rectangular-shaped geometry having a rear surface 40*a*' and a front surface 40*b*'. The substantially rigid body portion 40' may be defined by a lower edge $\mathbf{40}_{LE}$' and an upper edge $\mathbf{40}_{UE}$'; the lower edge $\mathbf{40}_{LE}$' is arranged opposite the upper edge $\mathbf{40}_{UE}$'. The substantially rigid body portion 40' may also be defined by a first side edge $\mathbf{40}_{S1}$' and a second side edge $\mathbf{40}_{S2}$'; the first side edge $\mathbf{40}_{S1}$' is arranged opposite the second side edge $\mathbf{40}_{S2}$'. Each of the first side edge $\mathbf{40}_{S1}$' and the second side edge $\mathbf{40}_{S2}$' connect the lower edge $\mathbf{40}_{LE}$' to the upper edge $\mathbf{40}_{UE}$'.

The substantially rigid body portion 40' may be defined by a thickness $T_{40}$' (see, e.g., FIG. 12) extending between the rear surface 40*a*' and the front surface 40*b*'. The thickness $T_{40}$' is defined by a first thickness portion $T_{40-1}$', a second thickness portion $T_{40-2}$' and a third thickness portion $T_{40-3}$'. The third thickness portion $T_{40-3}$' is greater than the second thickness portion $T_{40-2}$'; the second thickness portion $T_{40-2}$' is greater than the first thickness portion $T_{40-1}$'.

Furthermore, the first thickness portion $T_{40-1}$' may define the substantially rigid body portion 40' to include a base portion 41', and the third thickness portion $T_{40-3}$' may define a pair of guide members 42' extending from the base portion 41'. The second thickness portion $T_{40-2}$' may an intermediate step portion 43' between the base portion 41' and each guide member 42*a*', 42*b*' of the pair of guide members 42'. The pair of guide members 42' include a first guide member 42*a*' extending along the first side edge $\mathbf{40}_{S1}$' and a second guide member 42*b*' extending along the second side edge $\mathbf{40}_{S2}$'. When first cradle portion half 16*a*' and the second cradle portion half 16*b*' are joined together by the fasteners F, the difference of the thicknesses $T_{40-1}$, $T_{40-2}$, $T_{40-3}$ and the arrangement of the first cradle portion half 16*a*' disposed adjacent the second cradle portion half 16*b*' results in the cradle portion 16' forming a cavity 52' (see, e.g., FIG. 13'), which will be described in greater detail in the following disclosure.

Referring back to FIGS. 10'-12', each of the first guide member 42*a*' and the second guide member 42*b*' include an outer side surface 44' and an inner side surface 46'. The inner side surface 46' of each of the first guide member 42*a*' and the second guide member 42*b*' is defined by: (1) an upper arcuate surface segment 46*a*' extending from the upper edge $\mathbf{40}_{UE}$', (2) a lower arcuate surface segment 46*b*' extending from the lower edge $\mathbf{40}_{LE}$', and (3) a substantially linear surface segment 46*c*' connecting the upper arcuate surface segment 46*a*' to the lower arcuate surface segment 46*b*'.

Each of the first guide member 42*a*' and the second guide member 42*b*' may define an upper fastener passage 48' and a lower fastener passage 49'. The upper fastener passage 48' may be formed proximate the upper arcuate surface segment 46*a*'. The lower fastener passage 49' may be formed proximate the lower arcuate surface segment 46*b*'. Each of the upper fastener passage 48' and the lower fastener passage 49' may extend through the first thickness portion $T_{40-1}$' defined by the base portion 41' and the third thickness portion $T_{40-3}$' defined by each of the first guide member 42*a*' and the second guide member 42*b*'.

The first guide member 42*a*' and the second guide member 42*b*' are arranged in an opposing, spaced apart relationship; unlike the first guide member 42*a* and the second guide member 42*b* described above, the first guide member 42*a*' and the second guide member 42*b*' do not converge at an angle, but, rather, are arranged in a substantially parallel relationship, extending from the lower edge $\mathbf{40}_{LE}$' toward the upper edge $\mathbf{40}_{UE}$'. In some examples, the first guide member 42*a*' and the second guide member 42*b*' define a non-constant gap or spacing $S_{42}$' (see, e.g., FIG. 10') between the inner side surface 46' of each of the first guide member 42*a*' and the second guide member 42*b*'. In some instances, each step portion 43' between the base portion 41' and each guide member 42*a*', 42*b*' of the pair of guide members 42' is also defined by an inner side surface 47'; the inner side surface 47' of the opposing step portions 43' define a substantially constant gap or spacing $S_{47}$' (see, e.g., FIG. 10') therebetween to define a substantially linear guide channel 51' for the head portion 32' of the spine portion 14'.

As seen in FIG. 10', the non-constant gap or spacing $S_{42}$' is generally defined by a first non-constant spacing $S_{42-1}$', a second non-constant spacing $S_{42-2}$', and a third non-constant spacing $S_{42-3}$'. The first non-constant spacing $S_{42-1}$' is defined by a spaced-apart, opposing relationship of the upper arcuate surface segment 46*a*' of each of the first guide member 42*a*' and the second guide member 42*b*'. The second non-constant spacing $S_{42-2}$' is defined by a spaced-apart, opposing relationship of the lower arcuate surface segment 46*b*' of each of the first guide member 42*a*' and the second guide member 42*b*'. The third non-constant spacing $S_{42-3}$' is defined by a spaced-apart, opposing relationship of the substantially linear surface segment 46*c*' of each of the first guide member 42*a*' and the second guide member 42*b*'. The second non-constant spacing $S_{42-2}$' is greater than third non-constant spacing $S_{42-3}$', and, the third non-constant spacing $S_{42-3}$' is greater than the first non-constant spacing $S_{42-1}$'.

With reference back to FIGS. 7'-9', the spine portion 14' generally includes a lower portion 14*a*', an intermediate portion 14*b*' and an upper portion 14*c*'. The intermediate portion 14*b*' is located between the lower portion 14*a*' and the upper portion 14*c*'.

Referring to FIG. 13', a subassembly 75' of the carrier system 10 is generally defined by a connection of the load-interfacing portion 12 (described above in, for example, FIGS. 4A-6) to the cradle portion 16' by the spine portion 14'. In an example, the lower portion 14*a*' of the spine portion 14' is non-removably-coupled to and free-floatingly-disposed within the cavity 52' formed by the cradle portion 16'. The cavity 52' may be generally defined by: (1) opposing inner side surfaces 46' of each of the first guide member 42*a*' and the second guide member 42*b*' of both of the first cradle portion half 16*a*' and the second cradle portion half 16*b*', (2) opposing inner side surfaces 47' of the step portions 43', and (3) opposing rear surfaces 40*a*' of the base portion 41' of each of the first cradle portion half 16*a*' and the second cradle portion half 16*b*'. Furthermore, the cavity 52' may be defined by a substantially constant spacing (not shown but substantially similar to $S_{52}$ described at FIG. 18) extending between the opposing rear surfaces 40*a*' of the base portion 41' of each of the first cradle portion half 16*a*' and the second cradle portion half 16*b*'; in order to permit the free-floating arrangement of the spine portion 14' relative the cradle portion 16', the substantially constant spacing extending between the opposing rear surfaces 40*a*' of the base portion 41' of each of the first cradle portion half 16*a*' and the second cradle portion half 16*b*' is greater than the thickness $T_{30}$' extending between the rear surface 30*a*' and the front surface 30*b*' of the spine portion 14'.

As seen in FIG. 13', access to the cavity 52' is permitted by an upper opening 54' formed by the cradle portion 16'. In an example, the upper opening 54' is defined by: (1) the upper edge $\mathbf{40}_{UE}$' of the substantially rigid body portion 40' defined by the base portion 41' of each of the first cradle portion half 16*a*' and the second cradle portion half 16*b*' and (2) a portion of the upper arcuate surface segment 46*a*' of each of the first guide member 42*a*' and the second guide member 42*b*' that extends from the upper edge $\mathbf{40}_{UE}$'.

Figure 14A:
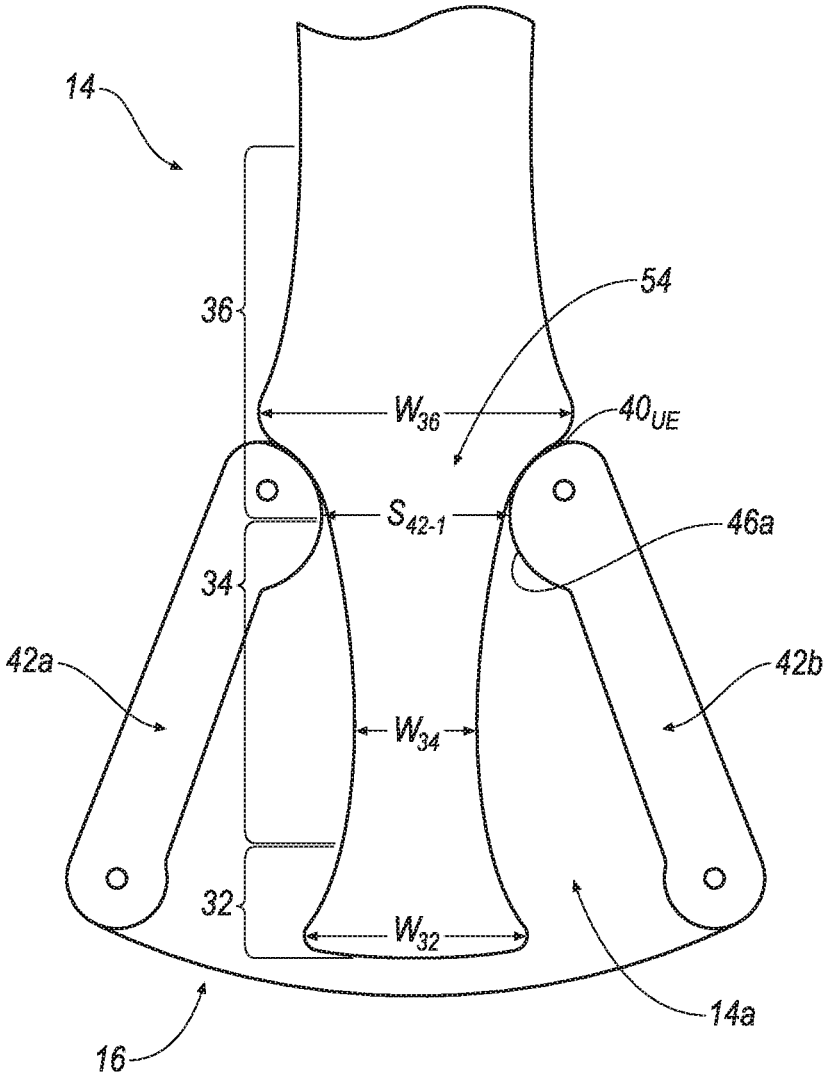
FIGS. 14A-14D are views of a lower portion of the spine portion of FIGS. 7-9 movably-interfaced with the cradle portion of FIGS. 10-12.
Figure 14B:
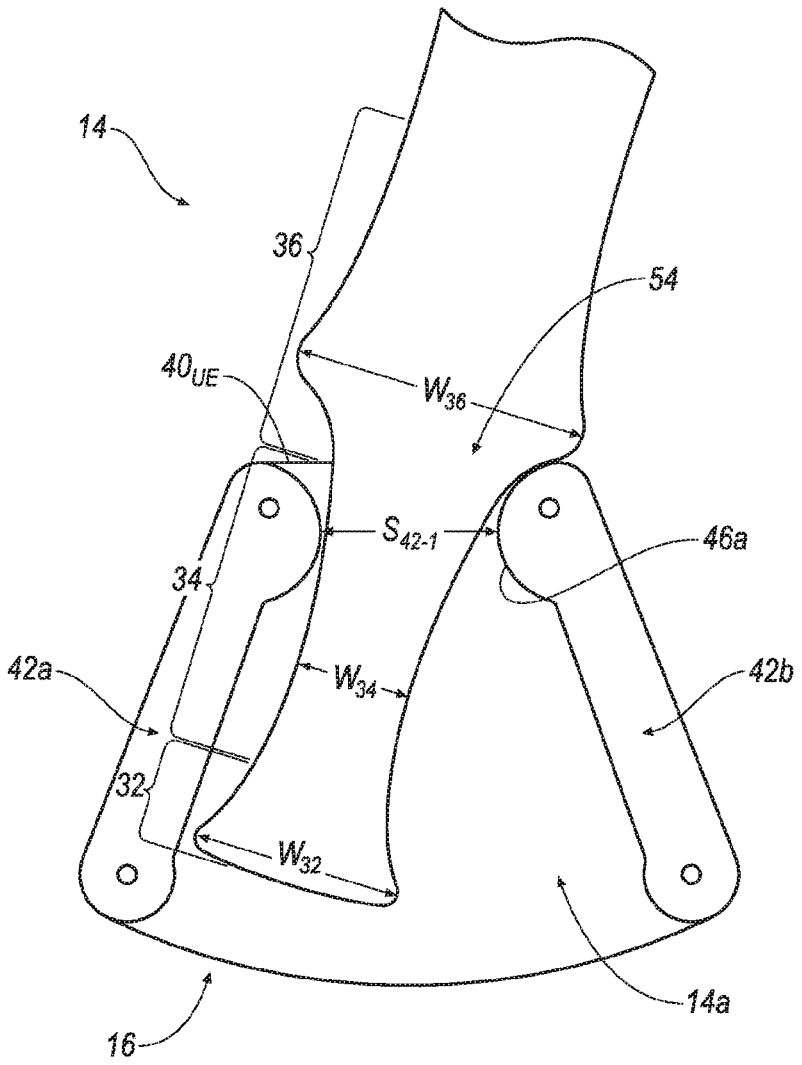
Figure 14C:
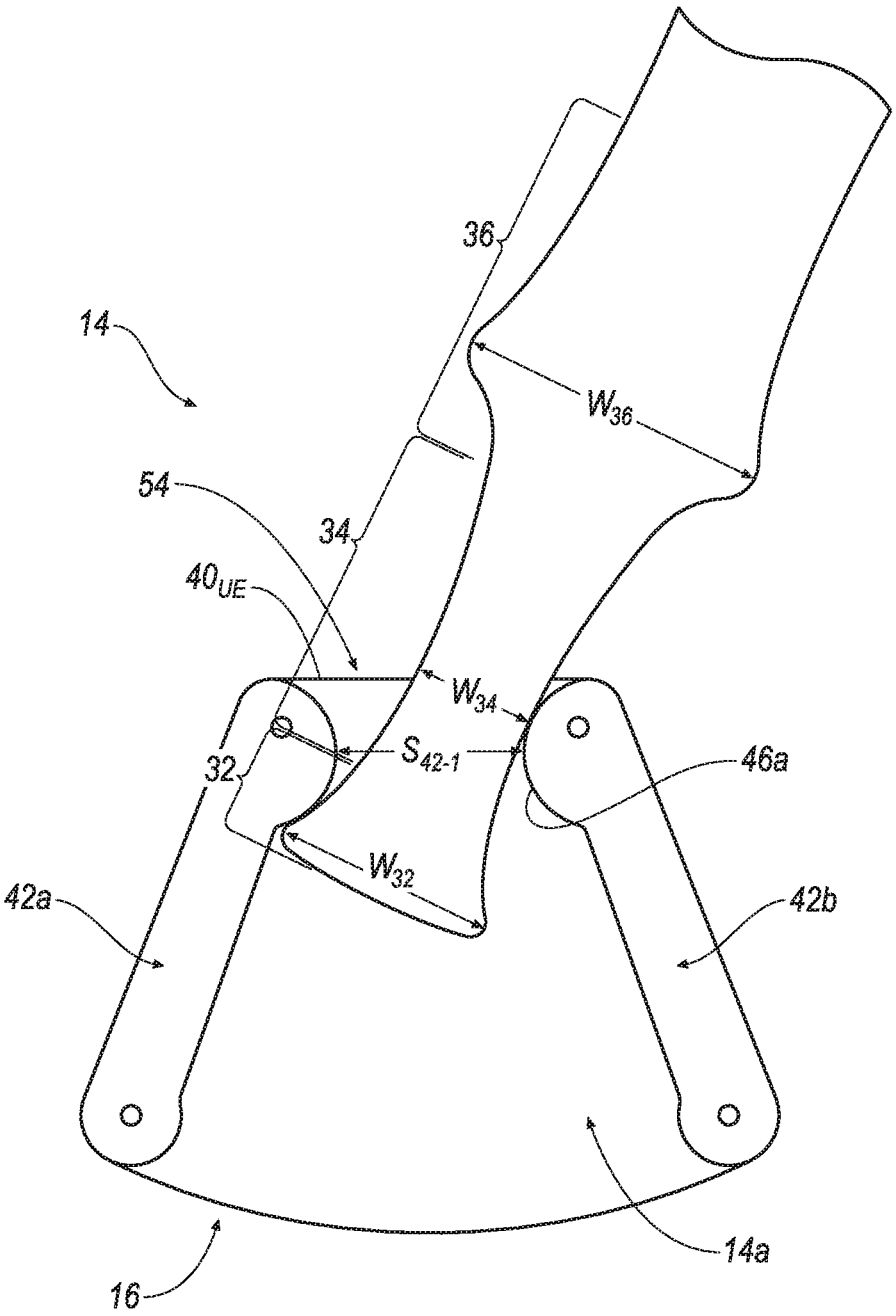
Figure 14D:
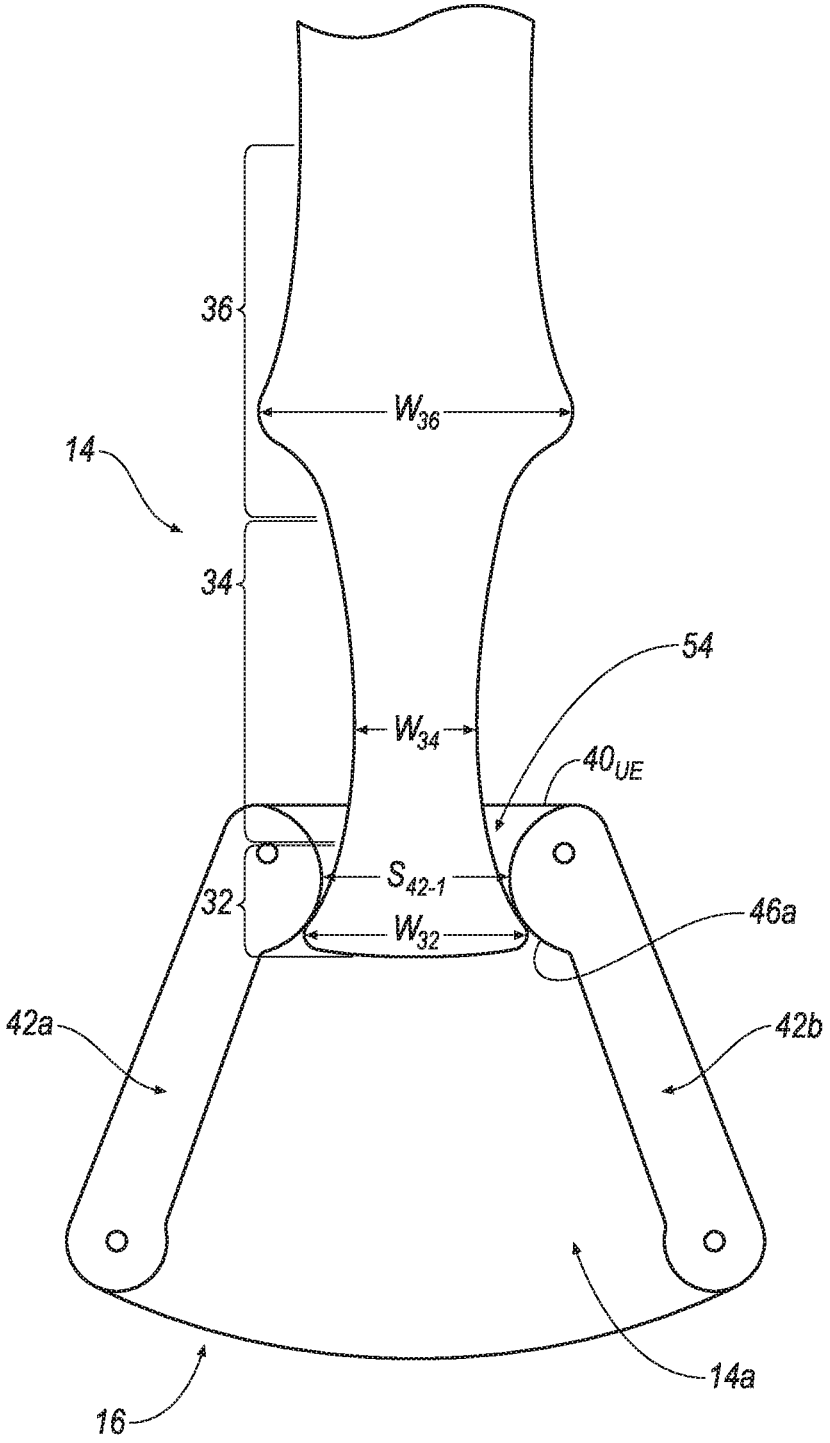
Figure 9:
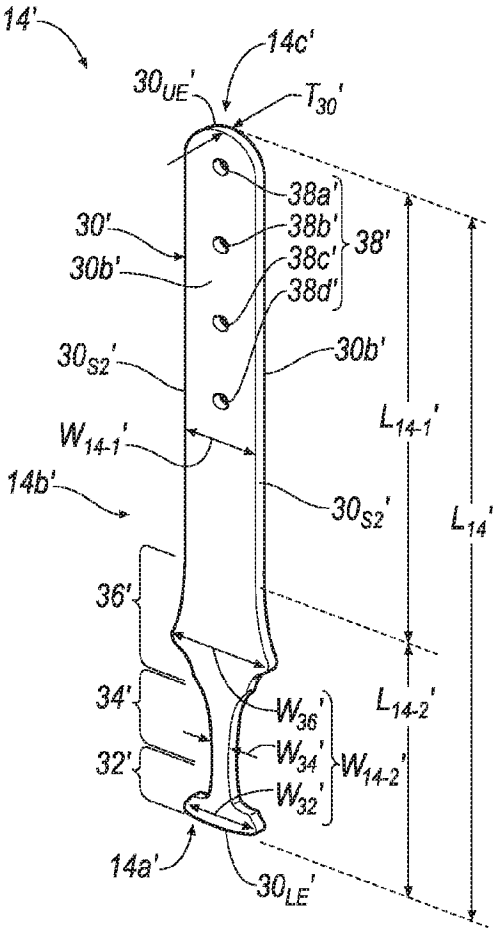
Figure 8:
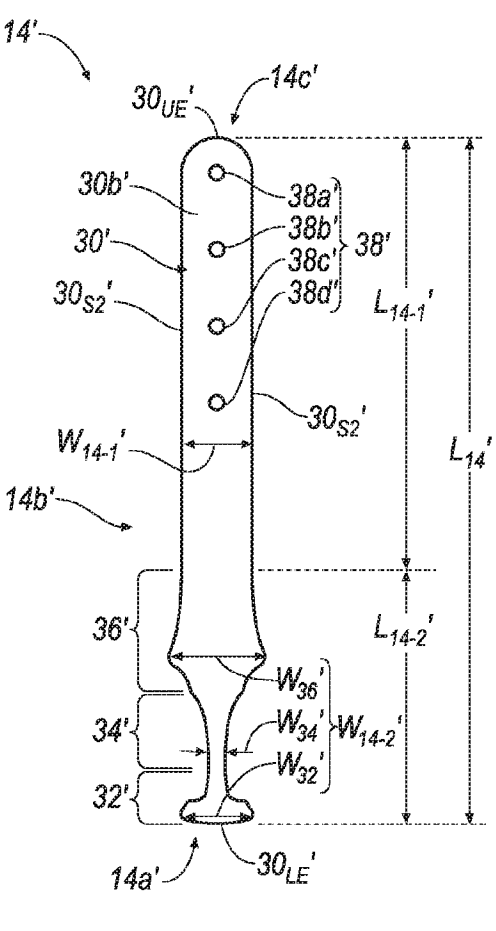
Figure 7:
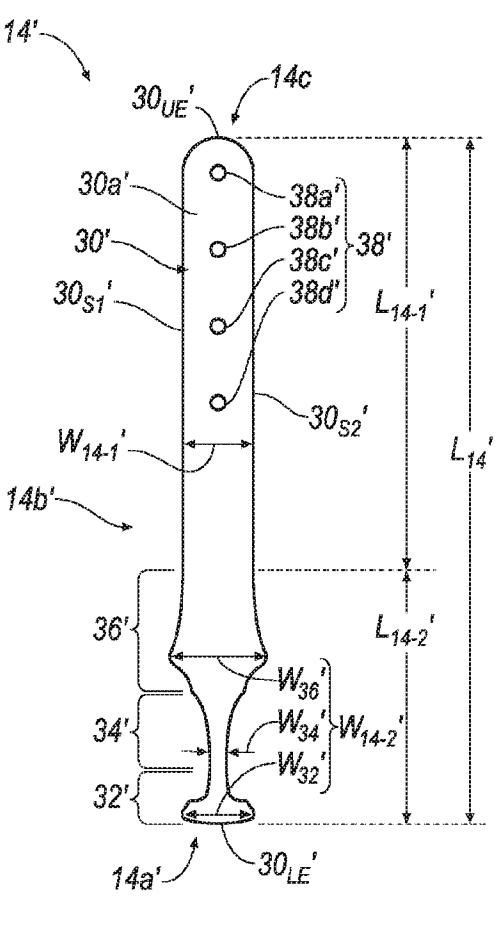
Figure 12:
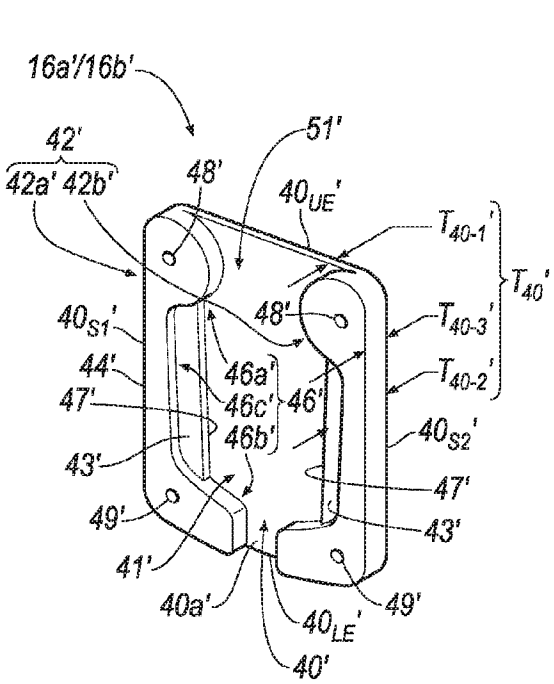
Figure 11:
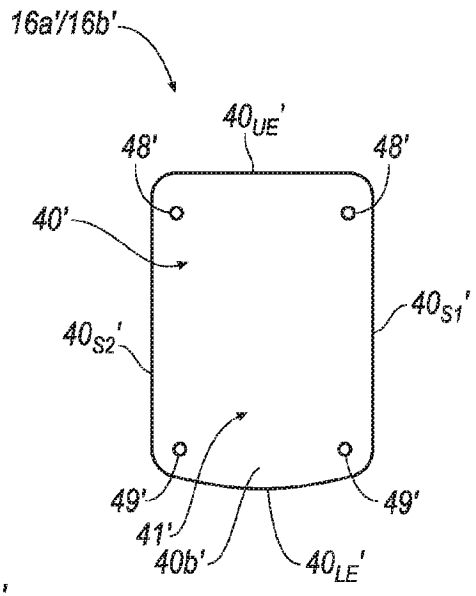
Figure 10:
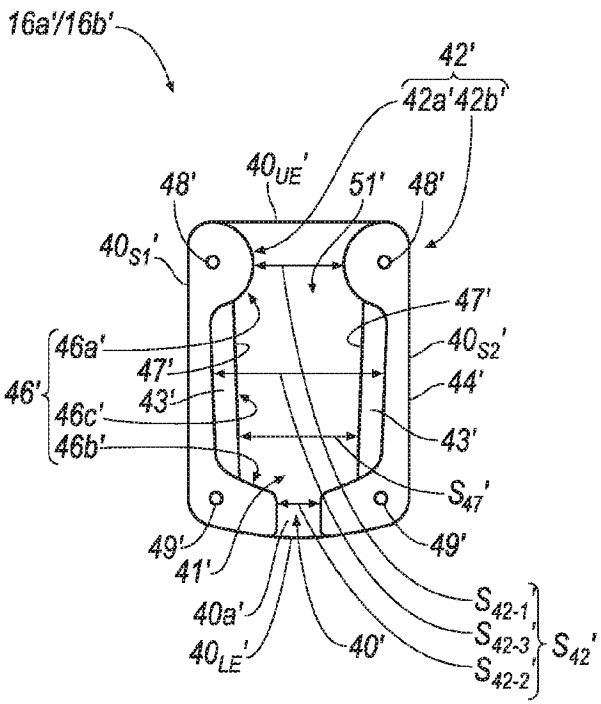
Figure 13:
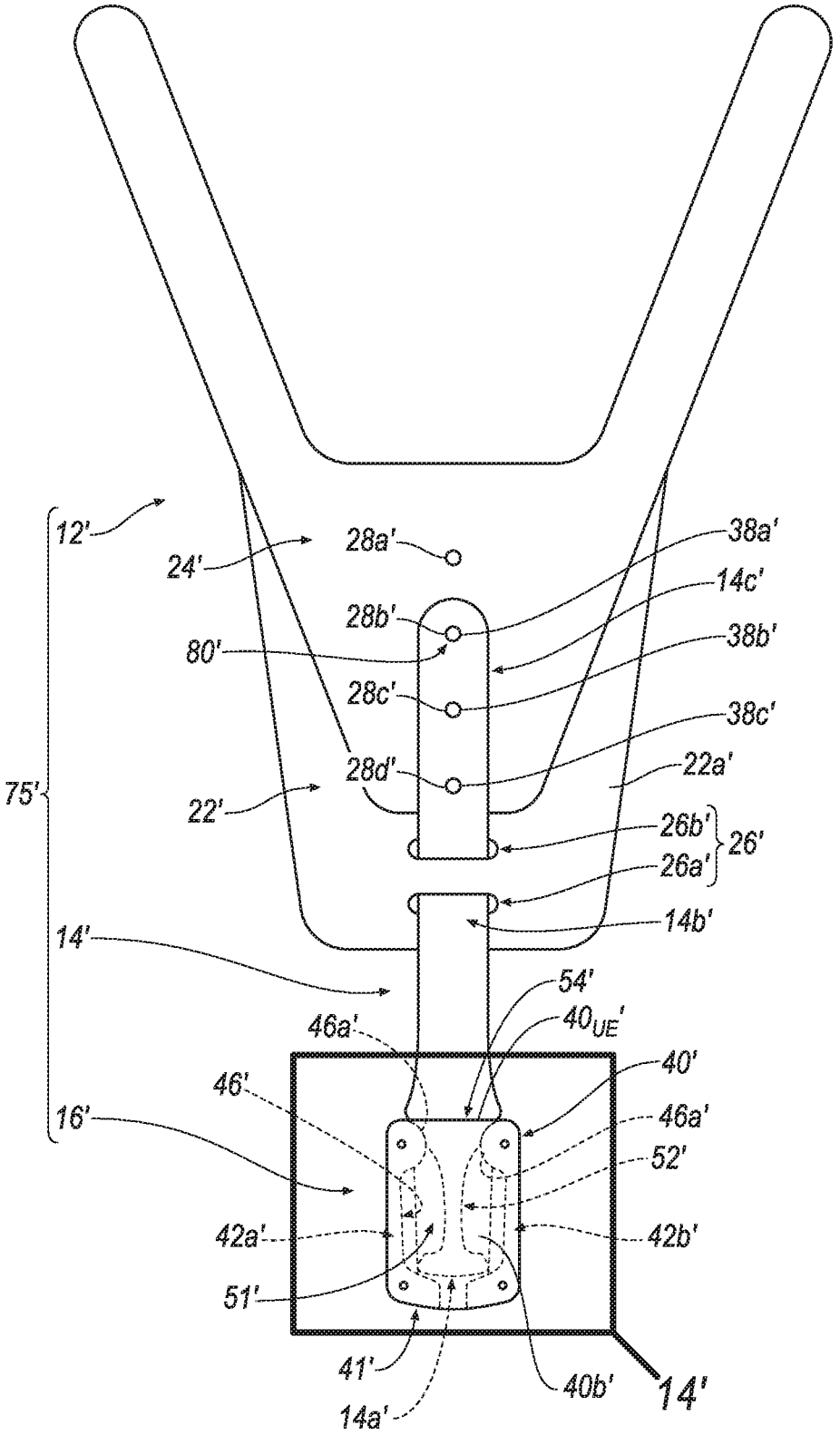
Figure 14A:
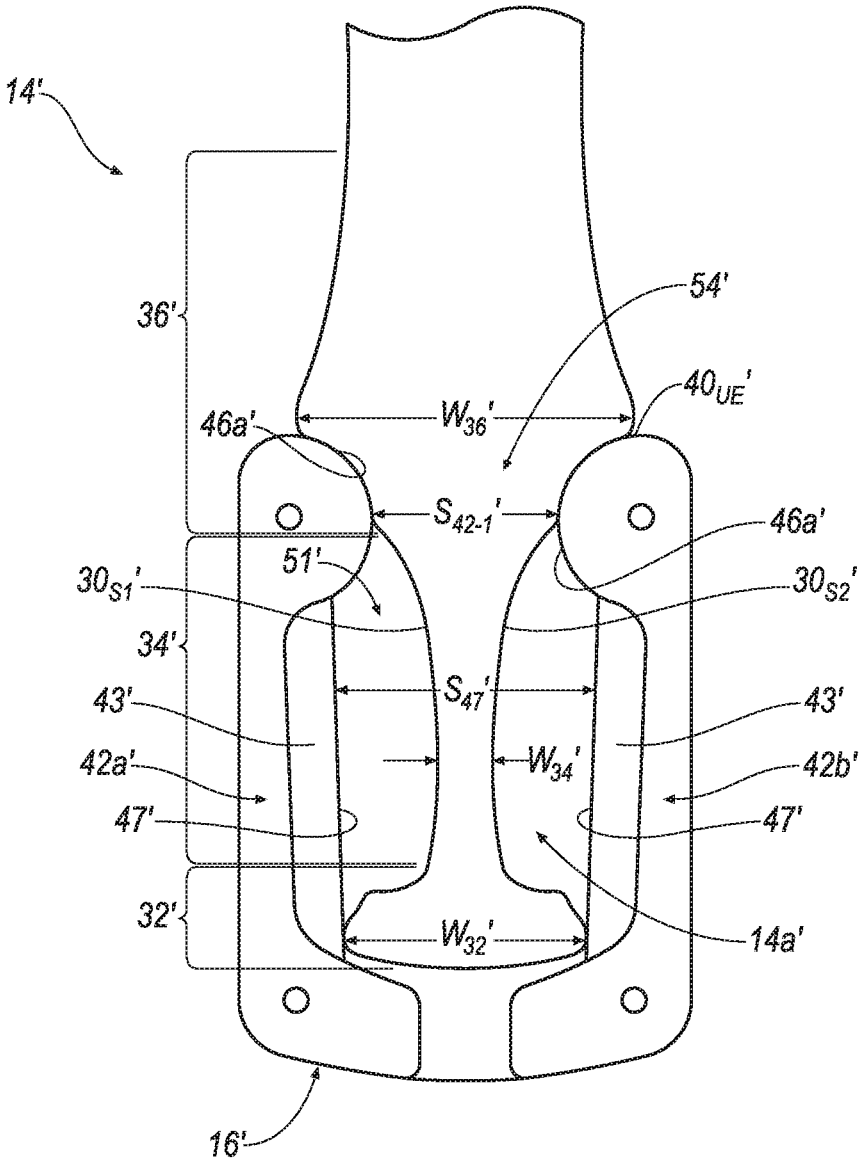
Figure 14B:
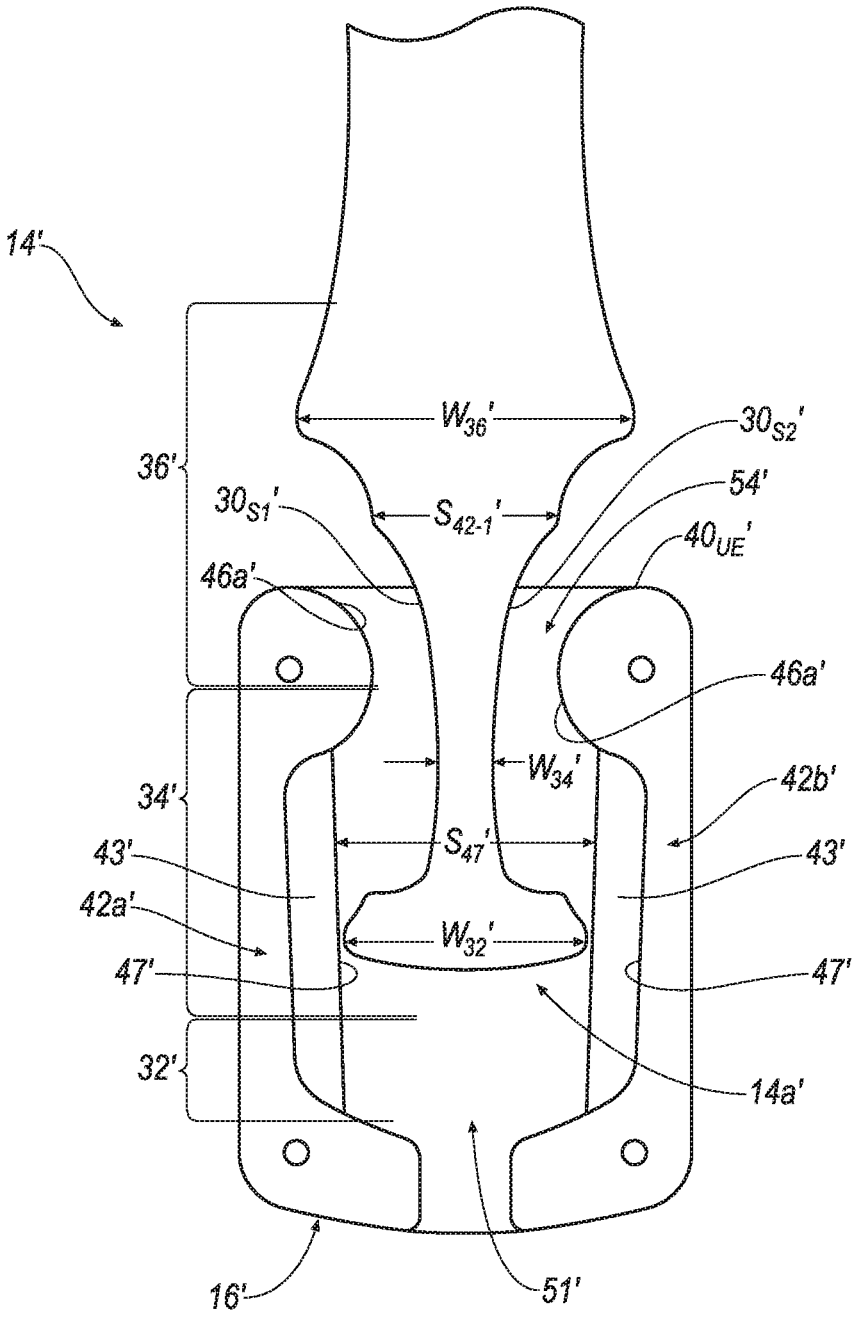
Figure 14C:
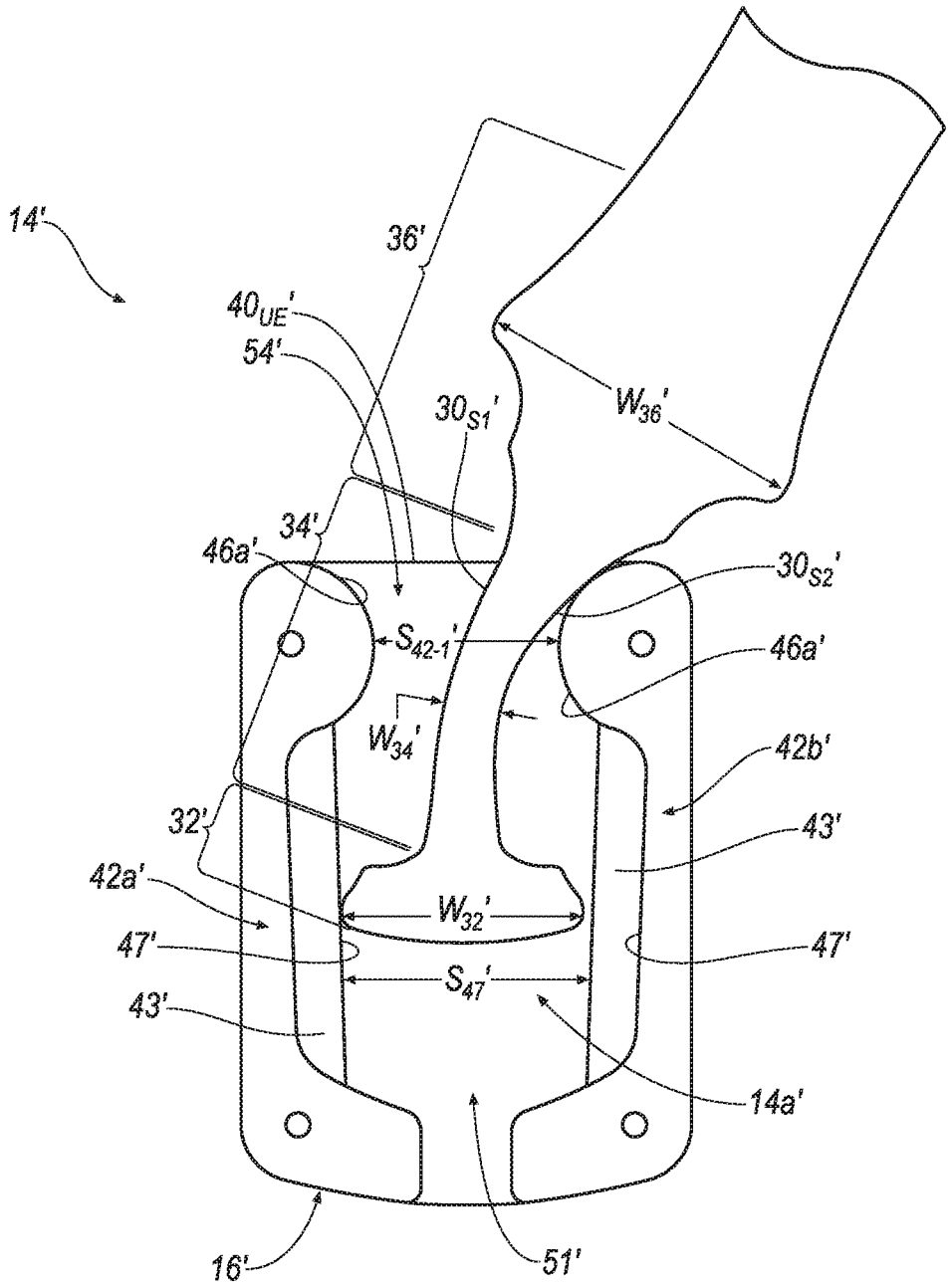
Figure 14D:
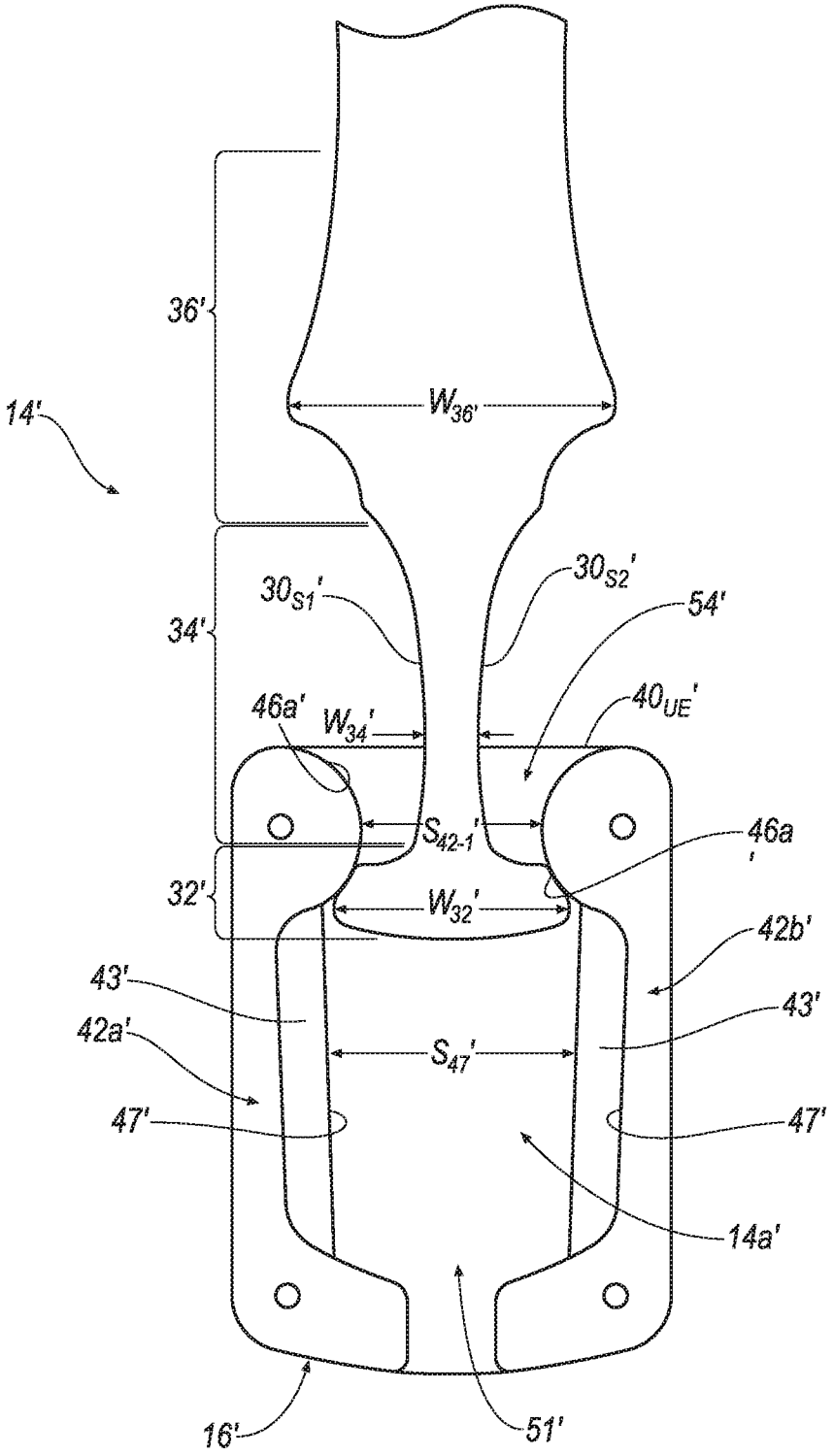

As seen in each of FIGS. 14A'-14D', because the upper opening 54' is defined, in part, by a portion of the upper arcuate segment 46*a*' of each of the first guide member 42*a*' and the second guide member 42*b*' that extends from the upper edge $\mathbf{40}_{UE}$', the upper opening 54' may be defined by a dimension substantially equal to the first non-constant spacing $S_{42-1}$'. Comparatively, as seen in FIGS. 14A'-14D', a largest width of the non-constant width $W_{32}$' defined by the head portion 32' of the of the spine portion 14' is greater than the smallest spacing of the first non-constant spacing $S_{42-1}$' that defines the upper opening 54'. Further, comparatively, as seen in FIGS. 14A'-14D', a largest width of the non-constant width $W_{36}$' defined by the shoulder portion 36' of the of the spine portion 14' is greater than the smallest spacing of the first non-constant spacing $S_{42-1}$' that defines the upper opening 54'. Yet even further, any portion of the non-constant width $W_{34}$' of the neck portion 34' of the spine portion 14' is less than the smallest spacing of the first non-constant spacing $S_{42-1}$' that defines the upper opening 54'.

As a result of the relative dimensions of the smallest spacing of the first non-constant spacing $S_{42-1}$' that defines the upper opening 54' of the cradle portion 16' and: (1) the largest width of the non-constant width $W_{32}$' of the head portion 32' and (2) any portion of the non-constant width $W_{34}$' of the neck portion 34', the neck portion 34' is permitted to be movably-disposed within the upper opening 54' (as seen in FIGS. 14B'-14C') while the head portion 32' is not permitted to pass through the upper opening 54' (as seen in, e.g., FIG. 14D') such that the head portion 32' is retained within the cavity 52'. Furthermore, as a result of the relative dimensions of the smallest spacing of the first non-constant spacing $S_{42\text{-}1}$' that defines the upper opening 54' of the cradle portion 16' and: (1) the largest width of the non-constant width $W_{36}$' of the shoulder portion 36' and (2) any portion of the non-constant width $W_{34}$' of the neck portion 34', the neck portion 34' is permitted to be movably-disposed within the upper opening 54' (as seen in FIGS. 14B'-14C') while the shoulder portion 36' is not permitted to pass through the upper opening 54' and into the cavity 52' (as seen in, e.g., FIG. 14A').

Furthermore, as seen in FIG. 14C', when: (1) the neck portion 34' of the spine portion 14' is movably-disposed within the upper opening 54' and (2) and either of the first side edge $\mathbf{30}_{S1}$' or the second side edge $\mathbf{30}_{S2}$' of the spine portion 14' is arranged adjacent either of the upper arcuate surface segment 46*a*' of either of the first guide member 42*a*' and the second guide member 42*b*' of the cradle portion 16', the neck portion 34' is permitted to be bent about either of the first guide member 42*a*' and the second guide member 42*b*' (unlike, for example the spine portion 14 as seen in FIGS. 14B-14C whereby engagement of either of the first side edge $\mathbf{30}_{S1}$ or the second side edge $\mathbf{30}_{S2}$ of the spine portion 14 adjacent either of the upper arcuate surface segment 46*a* of either of the first guide member 42*a* and the second guide member 42*b* of the cradle portion 16 results in the spine portion 14 being pivoted about the cradle portion 16). In order to permit the neck portion 34' of the spine portion 14' to be bent about either of the first guide member 42*a*' and the second guide member 42*b*', the spine portion 14' is formed from a bendable material that is less rigid than, for example, the material defining the spine portion 14.

Yet even further, as seen in FIGS. 14A'-14D', the substantially constant gap or spacing $S_{47}$' defined by the inner side surfaces 47' of the opposing step portions 43' is slightly greater than but approximately equal to a greatest width of the non-constant width $W_{32}$' defined by head portion 32' of the spine portion 14'. Therefore, as seen in FIGS. 14A'-14D', the head portion 32' may be limited to slide in a substantially axial direction within the substantially linear guide channel 51', and, if any radial movement is imparted to the spine portion 14' (as seen in, e.g., FIG. 14C'), the neck portion 34' of the spine portion 14' is permitted to be bent about either of the first guide member 42*a*' and the second guide member 42*b*' as described above.

Referring back to FIG. 13', the intermediate portion 14*b*' of the spine portion 14' is shown connected to the of the substantially rigid body portion 22' of the load-interfacing portion 12' for further defining the subassembly 75' of the carrier system 10. In an example the intermediate portion 14*b*' of the spine portion 14' is inserted: (1) through a first passage 26*a*' of the pair of vertically-aligned passages 26' from the rear surface 22*a*' of the substantially rigid body portion 22' of the load-interfacing portion 12' toward the front surface 22*b*' of the substantially rigid body portion 22' of the load-interfacing portion 12' and then (2) through a second passage 26*b*' of the pair of vertically-aligned passages 26' from the front surface 22*b*' of the substantially rigid body portion 22' of the load-interfacing portion 12' toward the rear surface 22*a*' of the substantially rigid body portion 22' of the load-interfacing portion 12' for connecting intermediate portion 14*b*' of the spine portion 14' to the load-interfacing portion 12'.

With continued reference to FIG. 13', the upper portion 14*c*' of the spine portion 14' is shown connected to the substantially rigid body portion 22' of the load-interfacing portion 12' for further defining the subassembly 75' of the carrier system 10. Each passage 38*a*'-38*d*' of the plurality of vertically-aligned passages 38' formed by the spine portion 14' is sized for receiving at least one male portion 28*a*'-28*d*' of the plurality of vertically-aligned male portions 28' of the substantially rigid body portion 22' of the load-interfacing portion 12' for removably-connecting the spine portion 14' to the load-interfacing portion 12' in one vertically-fixed orientation of a plurality of vertically-fixed orientations. The plurality of vertically-aligned male portions 28' extending from the load-interfacing portion 12' cooperating with the plurality of vertically-aligned passages 38' formed by the spine portion 14' may define a vertical adjustment system 80 of the carrier system 10 for accommodating differing heights of a number of users U.

In an example, as seen in FIG. 13', three of the male portions 28*b*'-28*d*' of the plurality of vertically-aligned male portions 28' are shown arranged within the first three passages 38*a*'-38*c*' of the plurality of vertically-aligned passages 38'. The provision of the ability to removably-connect the spine portion 14' to the load-interfacing portion 12' in one vertically-fixed orientation of a plurality of vertically-fixed orientations permits the carrier system 10 to be selectively vertically extended or retracted in order to accommodate a variety of user body profiles (i.e., differing heights of a number of users U). The number of vertically-fixed orientations provided by the carrier system 10 may be refined by providing an additional or lesser amount of male portions 28*a*'-28*d*' of the plurality of vertically-aligned male portions 28' and passages 38*a*'-38*d*' of the plurality of vertically-aligned passages 38'.

Referring to FIG. 15, once the subassembly 75 of the carrier system 10 is arranged as described above, the load distribution assembly 18 and the belt 20 may be connected to the cradle portion 16. In an example as seen in FIG. 1, the load distribution assembly 18 may be connected to the cradle portion 16 by passing the fasteners F through and beyond the upper fastener passages 48 and the lower fastener passages 49 formed by each of the first cradle portion half 16*a* and the second cradle portion half 16*b* of the cradle portion 16 and into fastener passages 56 formed by the load distribution assembly 18. Once the load distribution assembly 18 is optionally joined to the cradle portion 16, the belt 20 may be passed through the openings 19 formed by the load distribution assembly 18.

As seen in FIGS. 15-16, the carrier system 10 may be removably-joined to the load portion L for forming the assembly 50. In an example, the carrier system 10 is removably-joined to the load portion L by inserting: (1) the first flexible finger portion 25*b* of the substantially flexible portion 24 of the load-interfacing portion 12 into a first passage $L_{P1}$ formed by the load portion L and (2) the second flexible finger portion 25*c* of the substantially flexible portion 24 of the load-interfacing portion 12 into a second passage $L_{P2}$ formed by the load portion L. In an example, when the load portion L is a backpack, rucksack or the like, the first passage $L_{P1}$ and the second passage $L_{P2}$ formed by the load portion L may be passages formed in respective shoulder straps $L_S$ of the backpack or rucksack.

Once the first flexible finger portion 25*b* and the second flexible finger portion 25*c* are arranged within the first passage $L_{P1}$ and the second passage $L_{P2}$ formed by the shoulder straps $L_S$ of the load portion L, the first flexible finger portion 25*b* and the second flexible finger portion 25*c* may be bent or flexed from a substantially flat orientation (as seen, e.g., in FIG. 15) to a curved orientation (as seen in FIG. 16). Furthermore, as described above, the first flexible finger portion 25*b* and the second flexible finger portion 25*c* may be formed from a plastic or metal material that imparts a spring force to the load portion L such that the first flexible finger portion 25*b* and the second flexible finger portion 25*c* may lift or raise (according to the direction of the arrows X in FIG. 16) the shoulder straps $L_S$ of the load portion L away from shoulders S (see, e.g., FIG. 17D) of a user U; as a result of the first flexible finger portion 25*b* and the second flexible finger portion 25*c* imparting a spring force X for lifting or raising the shoulder straps $L_S$ of the load portion L away from the shoulders S of the user U, the first flexible finger portion 25*b* and the second flexible finger portion 25*c* may divert at least some of the weight of the load portion L away from the shoulder straps $L_S$ and along the load-interfacing portion 12, the spine portion 14 and cradle portion 16 and ultimately to the hips H (see, e.g., FIGS. 17A-17D) of the user U.

Although the carrier system 10 has been heretofore described to include one vertical adjustment system 80 at FIG. 13 defined by the plurality of vertically-aligned male portions 28 extending from the load-interfacing portion 12 cooperating with the plurality of vertically-aligned passages 38 formed by the spine portion 14, the carrier system 10 is not limited to the vertical adjustment system 80. In an example, an alternative (or, in some configurations, an additional) vertical adjustment system is shown generally at 82 in FIGS. 19A-20E.

Furthermore, the vertical adjustment system 80 may be referred to as a "coarse" vertical adjustment system due to the pre-defined locations of the plurality of vertically-aligned male portions 28 extending from the load-interfacing portion 12 and the pre-defined locations of the plurality of vertically-aligned passages 38 formed by the spine portion 14. Conversely, the vertical adjustment system 82, which includes a rail portion 84 and a clamping portion 86, may be referred to as a "fine" vertical adjustment system due to the cooperation of the rail portion 84 and the clamping portion 86 (i.e., the clamping portion 86 is slidably-adjustable along the length of the rail portion 84 to an infinite number of positions bound by opposing ends of the rail portion 84).

In use, the coarse vertical adjustment system 80 is manipulated (for accommodating an approximated height of the user U) prior to disposing the carrier system 10 upon the user U (because once the carrier system 10 is arranged upon the user U, the coarse vertical adjustment system 80 is located opposite the user's back, thereby making it difficult for the user U to manipulate the coarse vertical adjustment system 80) whereas, conversely, the fine vertical adjustment system 82 may be manipulated at any time before or after the carrier system 10 is disposed upon the user U. In some instances, as described above, the carrier system 10 may include both of the coarse vertical adjustment system 80 and the fine vertical adjustment system 82; in the event that both of the course and fine vertical adjustment systems 80, 82 are provided by the carrier system 10, the carrier system 10 may be vertically adjusted as follows: (1) firstly, the user U may select a first vertical adjustment of the coarse vertical adjustment system 80 as described above by arranging one or more of the male portions 28*a*-28*d* of the plurality of vertically-aligned male portions 28 within one or more of the passages 38*a*-38*d* of the plurality of vertically-aligned passages 38, then (2) secondly, the user U may dispose the carrier system 10 upon her/her person, and then (3) if the user U determines that the selected vertical adjustment of the carrier system 10 provided by the selected arrangement of the coarse vertical adjustment system 80 needs to be "fine-tuned" or adjusted "on the fly" after the carrier system 10 has already been disposed upon his/her person, the user U may manipulate the fine vertical adjustment system 82 for further vertically adjusting the carrier system 10 while the carrier system 10 is disposed upon his/her person. Manipulation of the fine vertical adjustment system 82 is described in greater detail below.

Referring to FIGS. 20A-20E, in an example, the rail portion 84 may be fixed to the load distribution assembly 18, and the clamping portion 86 may be fixed to the cradle portion 16. However, in implementations when the load distribution assembly 18 is not optionally included in the design of the carrier system 10, the rail portion 84 may be fixed to the cradle portion 16, and the clamping portion 86 may be fixed to the spine portion 14. In the exemplary implementation seen at FIGS. 20A-20E, the rail portion 84 may be attached to the load distribution assembly 18 with an adhesive, fasteners, ultrasonic welding or the like).

As seen in FIGS. 20A-20E, the clamping portion 86 may be attached to the front surface 40*b* of the first cradle portion half 16*a* of the cradle portion 16. The clamping portion 86 may be attached to the front surface 40*b* of the first cradle portion half 16*a* with an adhesive, fasteners, ultrasonic welding or the like).

The clamping portion 86 may include a non-movable portion 86*a* (that is attached to the front surface 40*b* of the first cradle portion half 16*a*) and a movable portion 86*b*. The movable portion 86*b* may be connected to the non-movable portion 86*a* by one or more pins 88. One or more biasing members 90 (e.g., one or more springs) may be disposed between opposing surfaces of the non-movable portion 86*a* and the movable portion 86*b* for biasing the movable portion 86*b* away from the non-movable portion 86*a*.

Referring to FIGS. 19A-19E and 20A-20E, the clamping portion 86 may further include a cam lever 92. The cam lever 92 is rotatably connected to and interfaced with the movable portion 86*b*. The cam lever 92 may be rotatably adjusted for arranging the clamping portion 86 in one of a clamped orientation (see, e.g., FIGS. 19A, 19E) and an unclamped orientation (see, e.g., FIGS. 19B-19D).

Figure 19A:
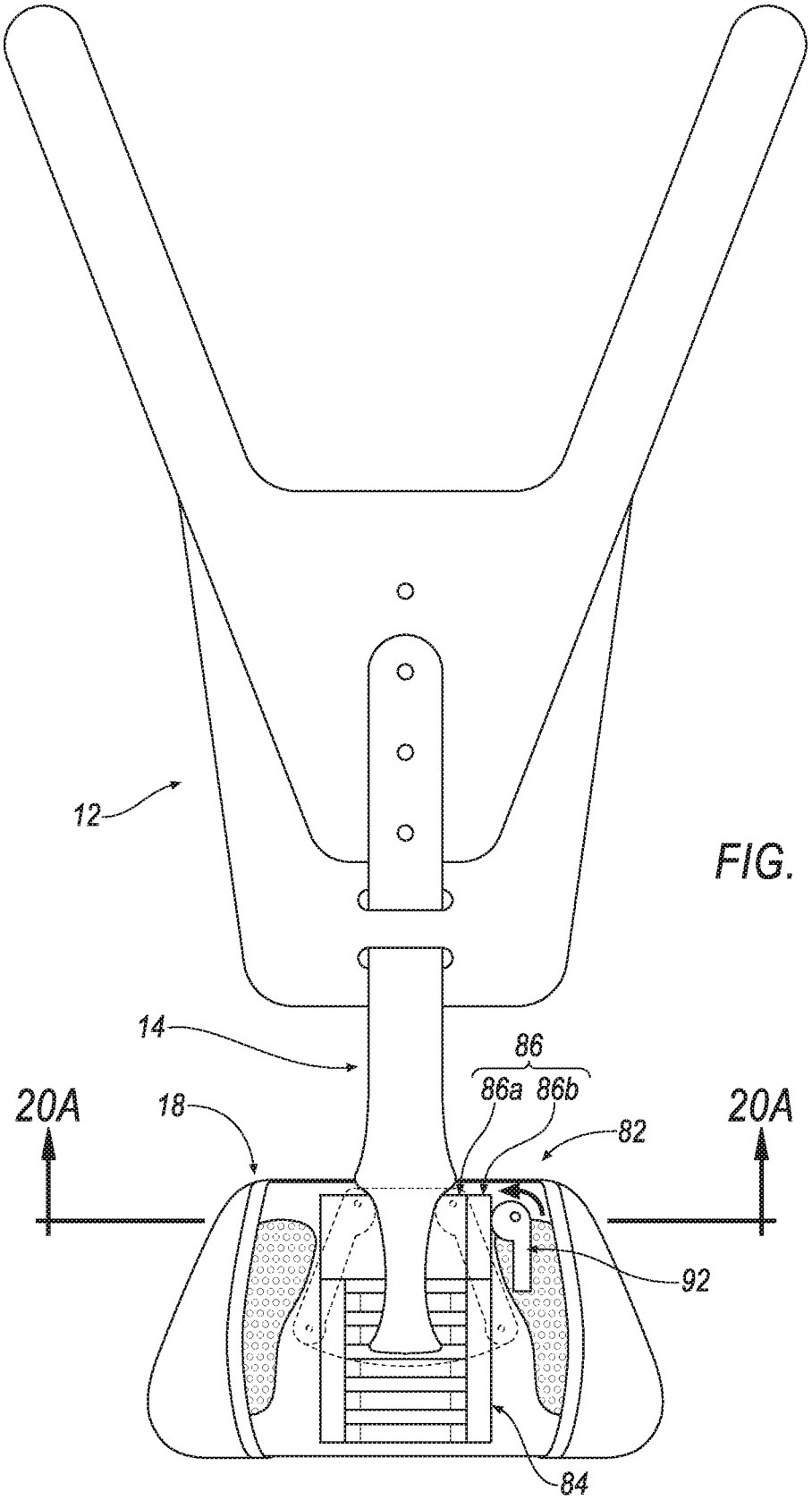
FIGS. 19A-19E are rear views of a portion of an exemplary carrier system including a vertical adjustment system.
Figure 19B:
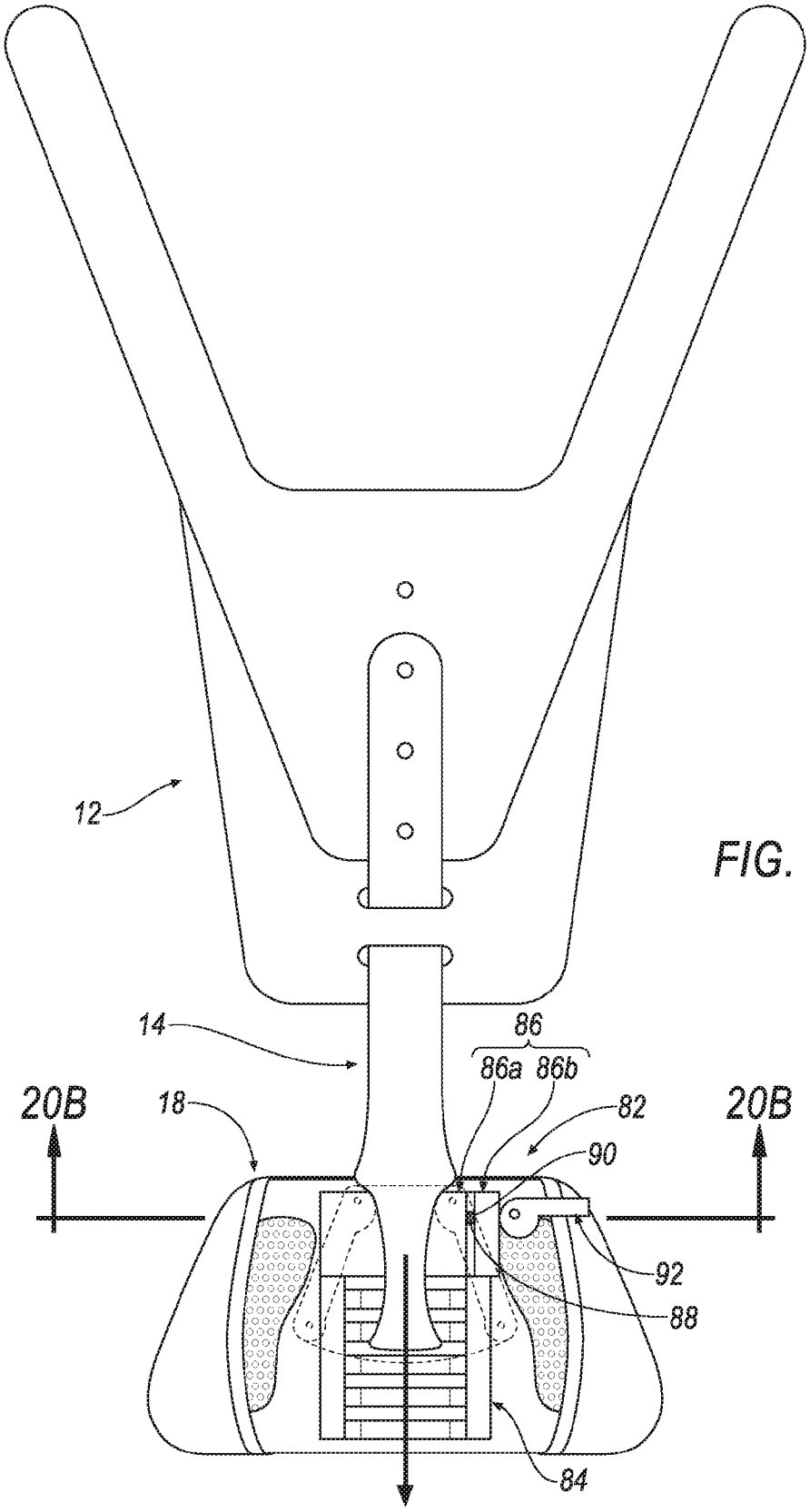
Figure 19C:
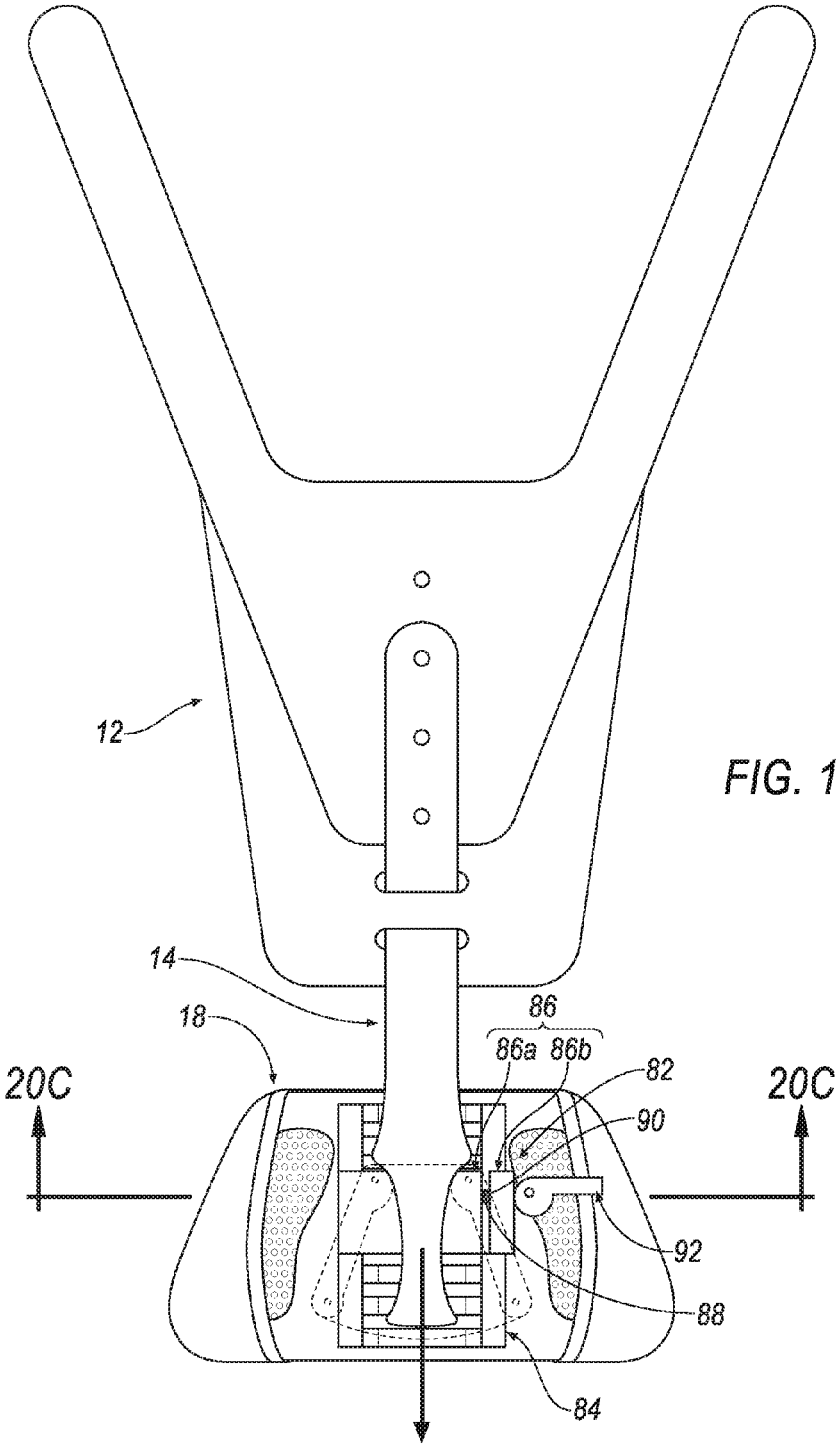
Figure 19D:
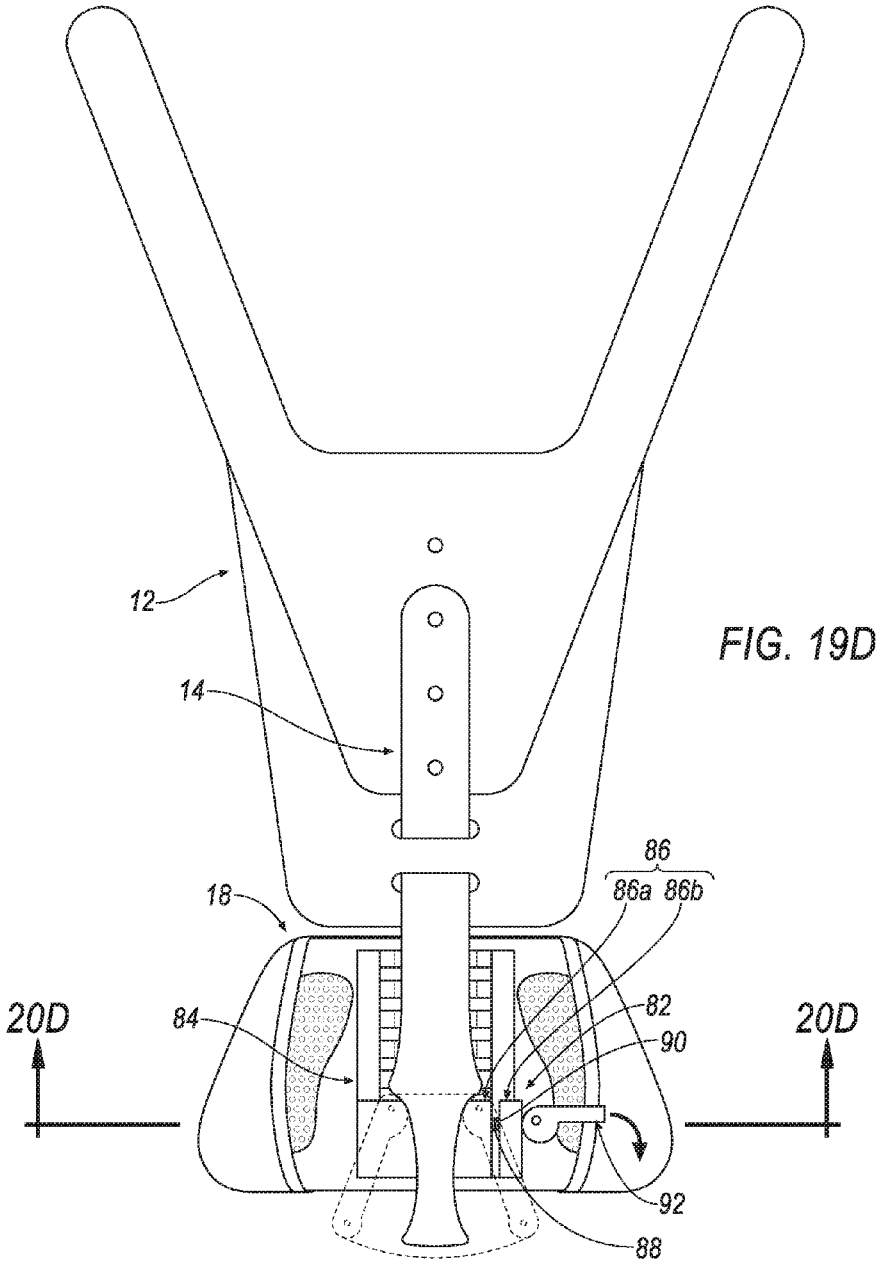
Figure 19E:
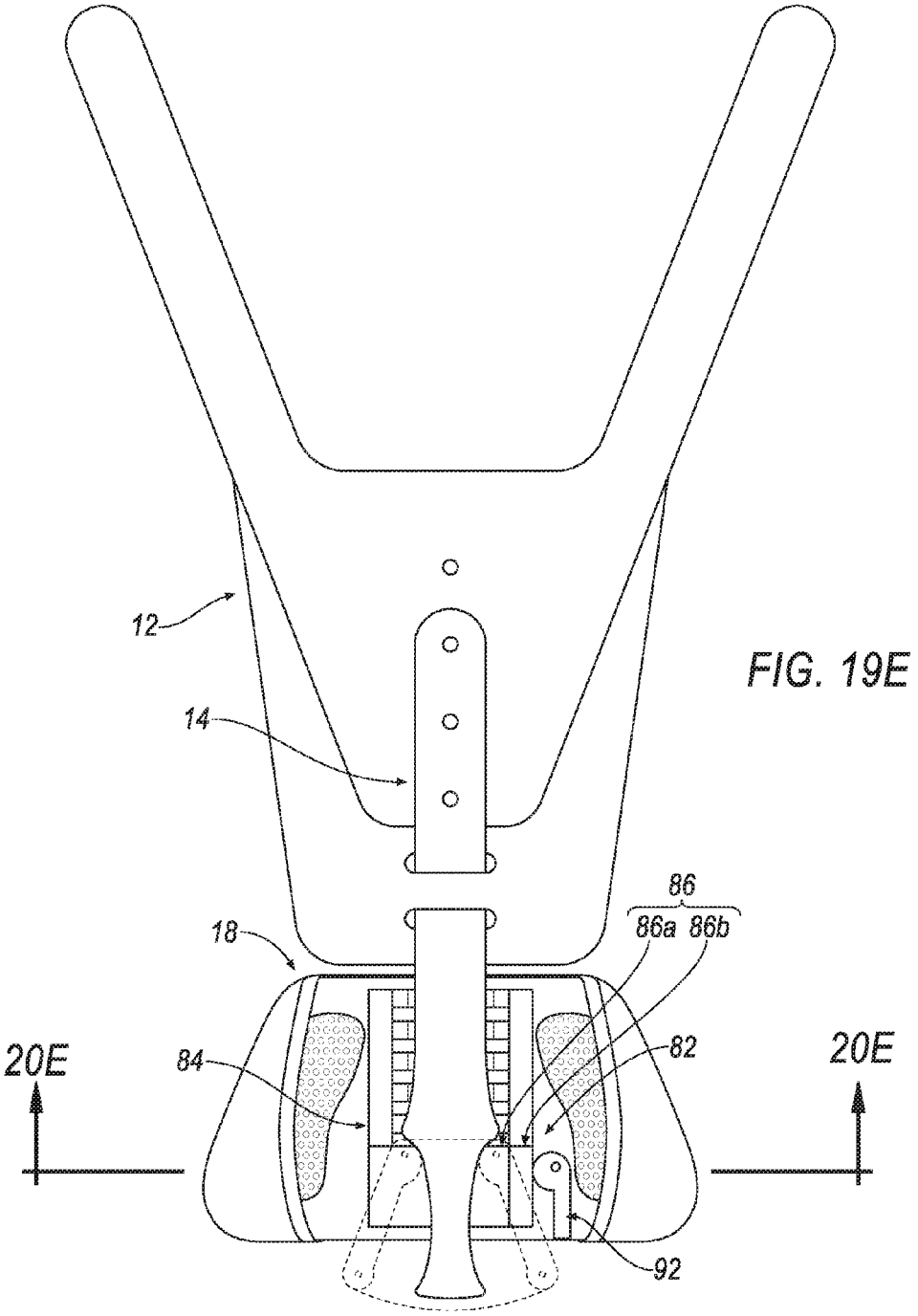
Figure 20A:
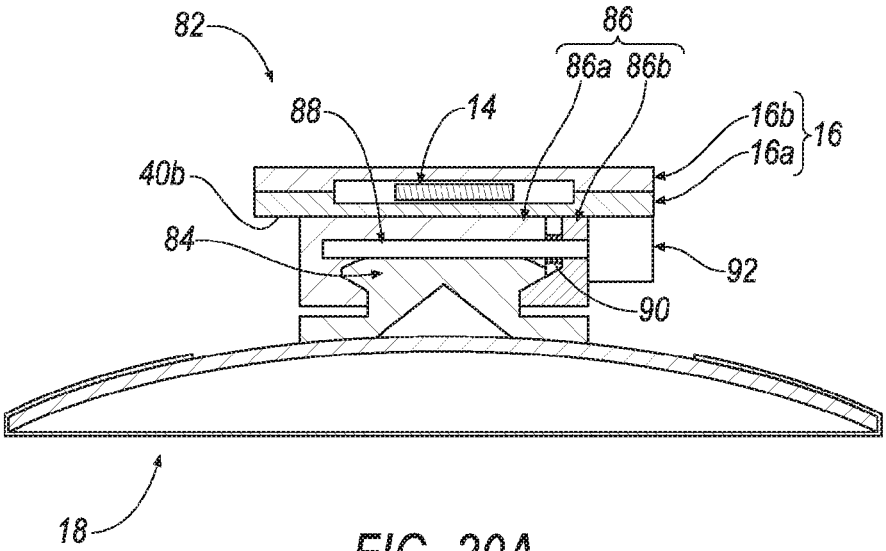
FIGS. 20A-20E are cross-sectional views according to lines 20A-20A through 20E-20E of FIGS. 19A through 19E.
Figure 20B:
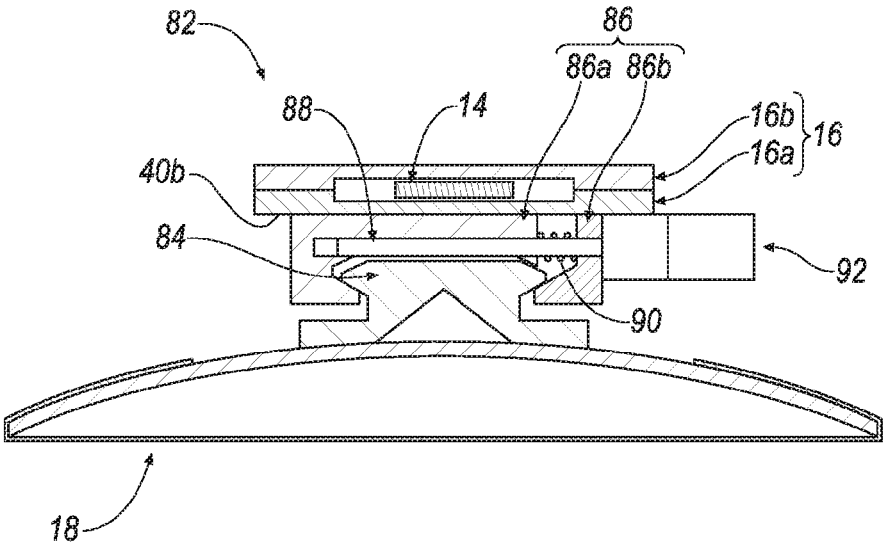
Figure 20C:
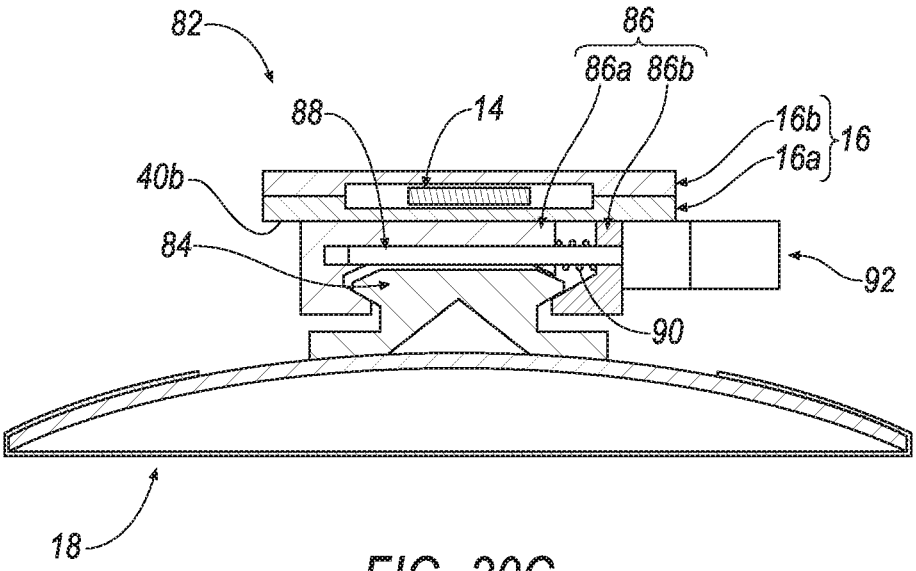
Figure 20D:
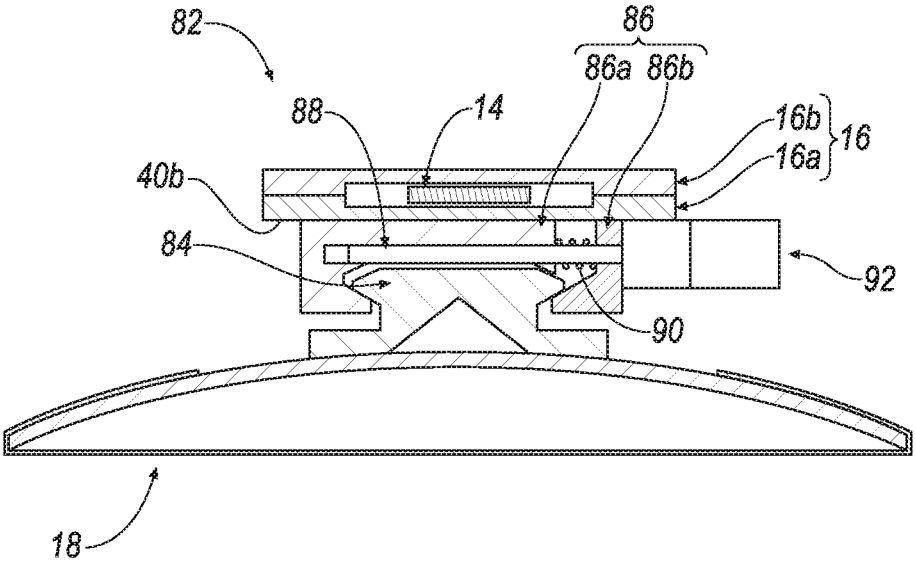
Figure 20E:
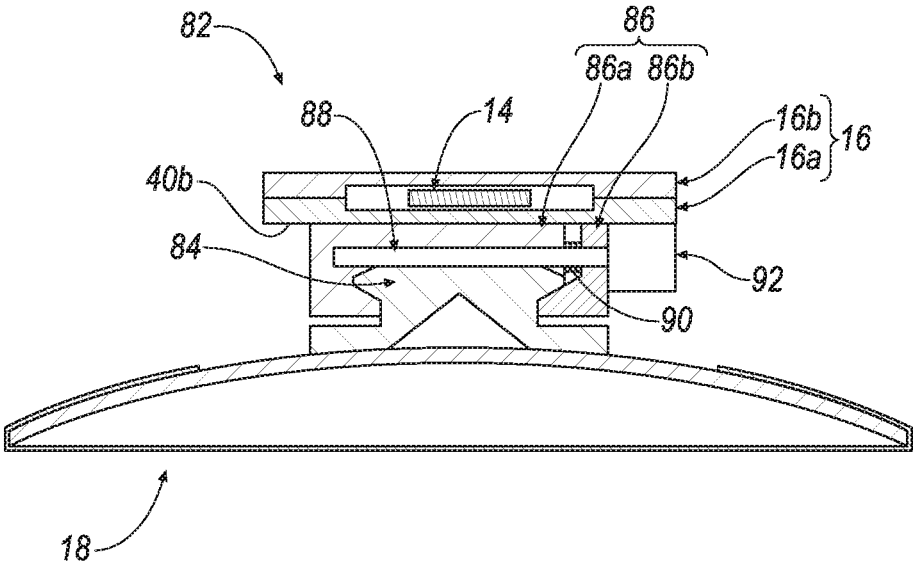

When the cam lever 92 is rotated for arranging the clamping portion 86 in the clamped orientation as seen in FIGS. 19A and 19E, the one or more biasing members 90 is/are compressed between opposing surfaces of the non-movable portion 86*a* and the movable portion 86*b*, and, as a result, the clamping portion 86 is selectively vertically fixed with respect to the rail portion 84. Conversely, as seen in FIGS. 19B-19D, when the cam lever 92 is rotated for arranging the clamping portion 86 in the unclamped orientation, the one or more biasing members 90 is/are permitted to expand, thereby urging the movable portion 86*b* away from the non-movable portion 86*a*, and, as a result, the clamping portion 86 is permitted to be selectively vertically adjusted relative to the rail portion 84. Accordingly, when a user U wishes to utilize the fine vertical adjustment system 82 for vertically adjusting the carrier system 10, the user U may: (1) rotate the cam lever 92 for selectively adjusting the clamping portion 86 from a clamped orientation to an unclamped orientation (see, e.g., FIGS. 19A-19B), (2) vertically adjust the carrier system 10 (see, e.g., FIGS. 19B-19D) as a result of the clamping portion 86 being permitted to be selectively vertically adjusted relative to the rail portion 84, and (3) rotate the cam lever 92 for selectively adjusting the clamping portion 86 from the unclamped orientation back to the clamped orientation (see, e.g., FIGS. 19D-19E).

In some instances, the rail portion 84 may be defined by a dovetail geometry. In other examples, the rail portion 84 may be defined by a Picatinny rail geometry.

Figure 21:
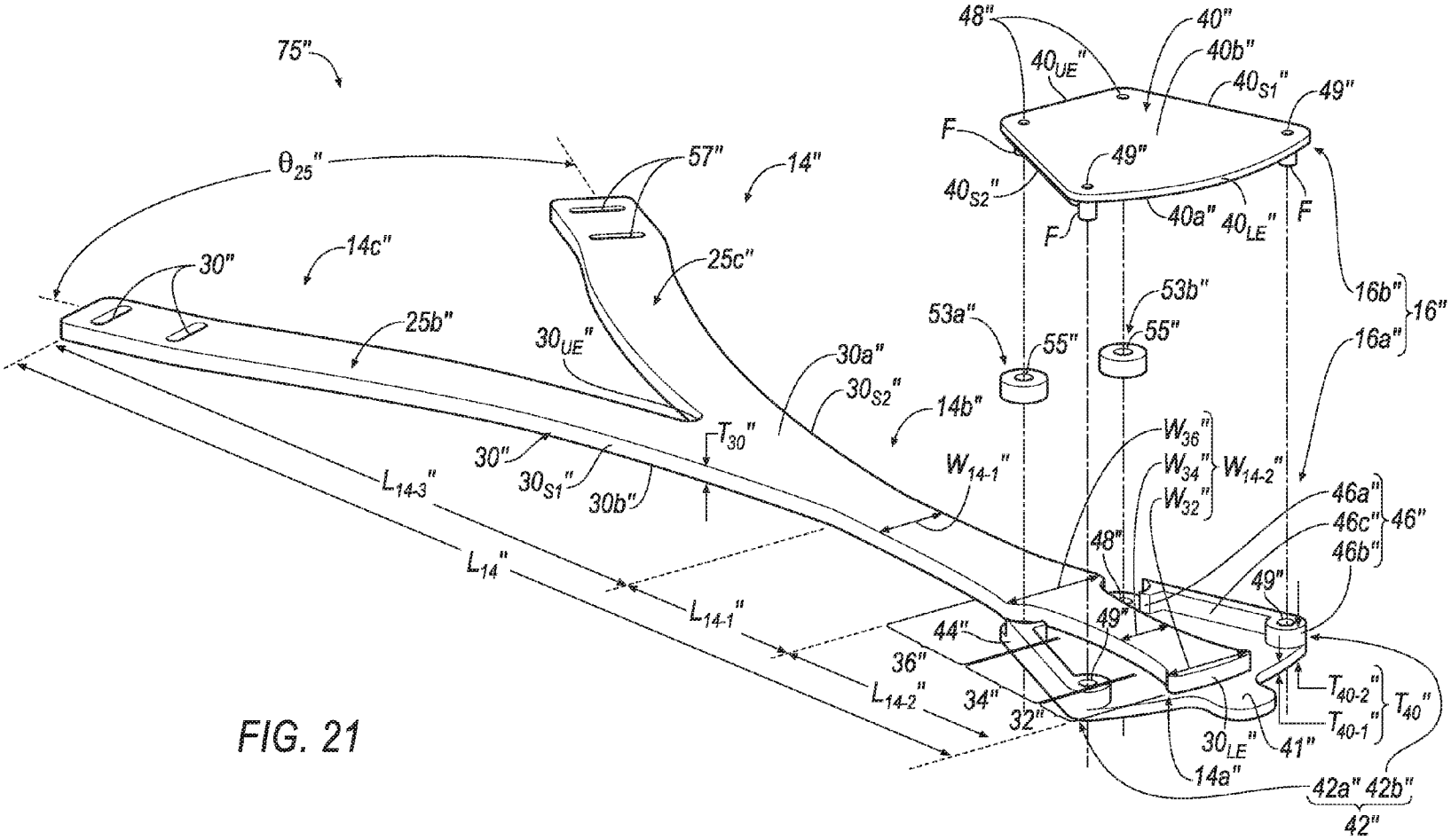
FIG. 21 is an exploded perspective view of an exemplary subassembly including an exemplary spine portion and an exemplary cradle portion.
Figure 22:
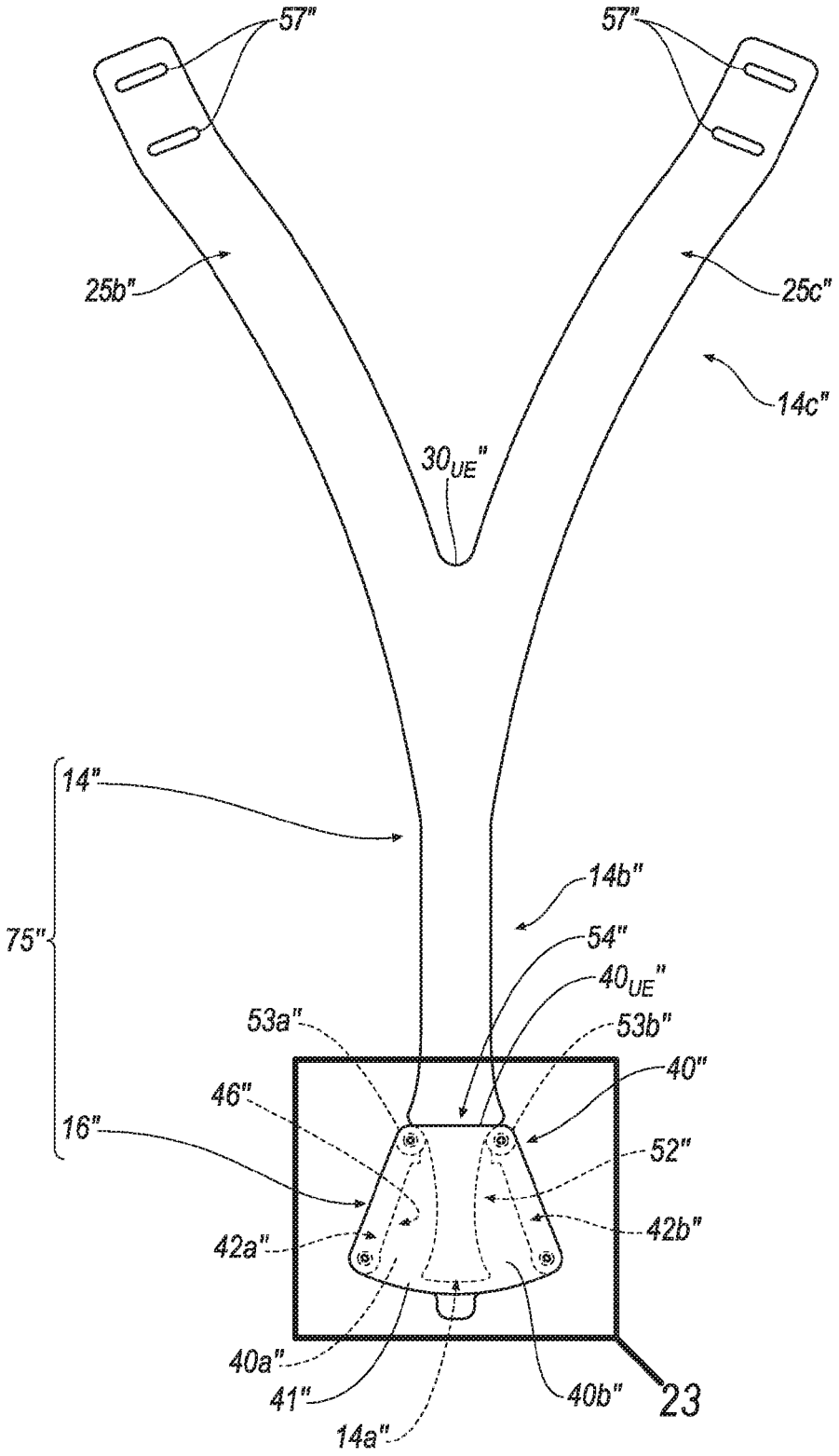
FIG. 22 is an assembled plan view of the subassembly of FIG. 21.

As seen in FIGS. 21-22, a plurality of interconnected components defining an exemplary subassembly 75" is shown. The subassembly 75" may include a spine portion 14" and a cradle portion 16". Although the subassembly 75" does not include a separate component defining a load-interfacing portion (see, e.g., reference numeral 12 in FIG. 1), the subassembly 75" may be considered to define a load-interfacing portion (see, e.g., a first flexile finger portion **25*b*" and a second flexible finger portion 25*c*") integrally connected to (or integrally extending from) the spine portion 14"**.

Optionally, the plurality of interconnected components may also include a load distribution assembly (see, e.g., reference numeral 18 in FIG. 1) and a belt (see, e.g., reference numeral 20 in FIG. 1) for defining a carrier system 10. If included, the load distribution assembly 18 may be sized for arrangement over a lumbar area of the torso T of the user U. With reference to FIGS. 1-3, the belt 20 is shown coupled to the load distribution assembly 18 by inserting the belt 20 through openings 19 (see, e.g., FIGS. 1, 2A, 3) formed by the load distribution assembly 18. If, however, the load distribution assembly 18 is not optionally included in the design of the carrier system 10, the belt 20 may be connected to the cradle portion 16"; the connection of the belt 20 to the cradle portion 16" may be conducted in any desirable manner (e.g., passing the belt 20 through passages formed by the cradle portion 16" or with an adhesive, fasteners, ultrasonic welding or the like).

Referring to FIG. 21, the spine portion 14" includes a substantially flexible body portion 30". In some examples, the substantially flexible body portion 30" may be defined by a rectangular-shaped geometry having a rear surface **30*a*" and a front surface 30*b*". The substantially flexible body portion 30" may be defined by a thickness $T_{30}$" extending between the rear surface 30*a*" and the front surface 30*b*"**.

The substantially flexible body portion 30" may be defined by a lower edge $\mathbf{30}_{LE}$" and an upper edge $\mathbf{30}_{UE}$"; the lower edge $\mathbf{30}_{LE}$" is arranged opposite the upper edge $\mathbf{30}_{UE}$". The substantially flexible body portion 30" may also be defined by a first side edge $\mathbf{30}_{S1}$" and a second side edge $\mathbf{30}_{S2}$"; the first side edge $\mathbf{30}_{S1}$" is arranged opposite the second side edge $\mathbf{30}_{S2}$". Each of the first side edge $\mathbf{30}_{S1}$" and the second side edge $\mathbf{30}_{S2}$" connect the lower edge $\mathbf{30}_{LE}$" to the upper edge $\mathbf{30}_{UE}$".

The first side edge $\mathbf{30}_{S1}$" and the second side edge $\mathbf{30}_{S2}$" define the substantially flexible body portion 30" to have a first, substantially constant width $W_{14-1}$" extending along a first portion $L_{14-1}$" of a length $L_{14}$" of the spine portion 14" and a second, non-constant width $W_{14-2}$" extending along a second portion $L_{14-2}$" of the length $L_{14}$" of the spine portion 14". The first portion $L_{14-1}$" of the length $L_{14}$" of the spine portion 14" extends away from the upper edge $\mathbf{30}_{UE}$" of the substantially flexible body portion 30". The second portion $L_{14-2}$" of the length $L_{14}$" of the spine portion 14" extends away from the lower edge $\mathbf{30}_{LE}$" of the substantially flexible body portion 30".

The second, non-constant width $W_{14-2}$" defines the second portion $L_{14-2}$" of the length $L_{14}$" of the spine portion 14" to form a head portion 32", a neck portion 34" and a shoulder portion 36". The head portion 32" extends away from the lower edge $\mathbf{30}_{LE}$" of the substantially flexible body portion 30" and may be defined by a non-constant width $W_{32}$". The neck portion 34" extends away from the head portion 32" and may be defined by a non-constant width $W_{34}$". The shoulder portion 36" extends away from the neck portion 34" and may be defined by a non-constant width $W_{36}$".

The non-constant width $W_{36}$" of the shoulder portion 36" may be greater than the non-constant width $W_{32}$" of the head portion 32", and, the non-constant width $W_{32}$" of the head portion 32" may be greater than the non-constant width $W_{34}$" of the neck portion 34". The non-constant widths $W_{32}$", $W_{34}$", $W_{36}$" of the head portion 32", the neck portion 34" and the shoulder portion 36" collectively defines the second, non-constant width $W_{14-2}$" extending along the second portion $L_{14-2}$" of the length $L_{14}$" of the spine portion 14".

Unlike the exemplary spine portions 14, 14' described above at FIGS. 7-9 and 7'-9', the substantially flexible body portion 30" of the spine portion 14" does not define a plurality of vertically-aligned passages (see, e.g., reference numerals 38 and 38') for removably-connecting the spine portion 14" to a load-interfacing portion (see, e.g., reference numerals 12 and 12'); rather, the spine portion 14" integrally includes a first flexible finger portion **25*b*" extending diagonally away from the upper edge $\mathbf{30}_{UE}$" of the substantially flexible body portion 30" of the spine portion 14" and a second flexible finger portion 25*c*" extending diagonally away from the upper edge $\mathbf{30}_{UE}$" of the substantially flexible body portion 30" of the spine portion 14" (as described above, substantially equivalent structure defining a load-interfacing portion is provided by the first flexible finger portion 25*b*" and the second flexible finger portion 25*c*" are integrally connected to (or integrally extending from) the spine portion 14"). The first flexible finger portion 25*b*" and the second flexible finger portion 25*c*" may divergently diagonally extend from the upper edge $\mathbf{30}_{UE}$" of the substantially flexible body portion 30" of the spine portion 14" at an angle $\theta_{25}$". Furthermore, each of the first flexible finger portion 25*b*" and the second flexible finger portion 25*c*" may be defined by a thickness substantially equal to the thickness $T_{30}$" extending between the rear surface 30*a*" and the front surface 30*b*" of the substantially flexible body portion 30" of the spine portion 14". The thickness $T_{30}$" of the first flexible finger portion 25*b*" and the second flexible finger portion 25*c*" may be selectively sized in order to permit each of the first flexible finger portion 25*b*" and the second flexible finger portion 25*c*" to bend, imparting a spring force to a load portion L (see, e.g., FIG. 15) when the first flexible finger portion 25*b*" and the second flexible finger portion 25*c*" are removably-interfaced with the load portion L (as similarly seen in, e.g., FIGS. 15-16). Yet even further, as seen in FIG. 21, the first flexible finger portion 25*b*" and the second flexible finger portion 25*c*" may define a third portion $L_{14-3}$" of the length $L_{14}$" of the spine portion 14" that extends away from the first portion $L_{14-1}$" of the length $L_{14}$" of the spine portion 14"**.

As described above, the subassembly 75" may be a portion of the carrier system 10 that may be removably-joined to the load portion L for forming the assembly 50. In an example, the carrier system 10 (including the subassembly 75") is removably-joined to the load portion L by inserting: (1) the first flexible finger portion **25*b*" of the spine portion 14" into a first passage $L_{P1}$ formed by the load portion L and (2) the second flexible finger portion 25*c*" of the spine portion 14"** into a second passage $L_{P2}$ formed by the load portion L. In an example, when the load portion L is a backpack, rucksack or the like, the first passage $L_{P1}$ and the second passage $L_{P2}$ formed by the load portion L may be passages formed in respective shoulder straps $L_S$ of the backpack or rucksack.

As seen in FIG. 21, a first cradle portion half 16*a*" and a second cradle portion half 16*b*" of the cradle portion 16" are shown. The first cradle portion half 16*a*" and the second cradle portion half 16*b*" may be joined together, by, for example, fasteners F extending from one of the first cradle portion half 16*a*" or the second cradle portion half 16*b*". In some instances, as described in the following disclosure, the first cradle portion half 16*a*" and the second cradle portion half 16*b*" may be defined to have some similarities; therefore, the following disclosure may refer to a "cradle portion half 16*a*"/16*b*" "when describing similarly-related subject matter of the first cradle portion half 16*a*" and the second cradle portion half 16*b*".

The cradle portion half 16*a*"/16*b*" is defined by a substantially rigid body portion 40". In some examples, the substantially rigid body portion 40" is defined by a substantially trapezoidal-shaped geometry having a rear surface 40*a*" and a front surface 40*b*". The substantially rigid body portion 40" may be defined by a lower edge $\mathbf{40}_{LE}$" and an upper edge $\mathbf{40}_{UE}$"; the lower edge $\mathbf{40}_{LE}$" is arranged opposite the upper edge $\mathbf{40}_{UE}$".

The substantially rigid body portion 40" may also be defined by a first side edge $\mathbf{40}_{S1}$" and a second side edge $\mathbf{40}_{S2}$"; the first side edge $\mathbf{40}_{S1}$" is arranged opposite the second side edge $\mathbf{40}_{S2}$". Each of the first side edge $\mathbf{40}_{S1}$" and the second side edge $\mathbf{40}_{S2}$" connect the lower edge $\mathbf{40}_{LE}$" to the upper edge $\mathbf{40}_{UE}$".

The substantially rigid body portion 40" may be defined by a thickness $T_{40}$" extending between the rear surface 40*a*" and the front surface 40*b*". The thickness $T_{40}$" of the first cradle portion half 16*a*" is defined by a first thickness portion $T_{40\text{-}1}$" and a second thickness portion $T_{40\text{-}2}$". The second thickness portion $T_{40\text{-}2}$" is greater than the first thickness portion $T_{40\text{-}1}$". The second cradle portion half 16*b*", however, is defined by the first thickness portion $T_{40\text{-}1}$".

In relation to the first cradle portion half 16*a*", the first thickness portion $T_{40\text{-}1}$" may define the substantially rigid body portion 40" to include a base portion 41", and the second thickness portion $T_{40\text{-}2}$" may define a pair of guide members 42" extending from the base portion 41". The pair of guide members 42" include a first guide member 42*a*" extending along the first side edge $\mathbf{40}_{S1}$" and a second guide member 42*b*" extending along the second side edge $\mathbf{40}_{S2}$". Yet even further, when first cradle portion half 16*a*" and the second cradle portion half 16*b*" are joined together by the fasteners F extending from the second cradle portion half 16*a*", the difference of the thicknesses $T_{40\text{-}1}$", $T_{40\text{-}2}$", and the arrangement of the first cradle portion half 16*a*" disposed adjacent the second cradle portion half 16*b*" results in the cradle portion 16" forming a cavity 52 (see, e.g., FIG. 22), which will be described in greater detail in the following disclosure.

In relation to the second cradle portion half 16*b*", the first thickness portion $T_{40\text{-}1}$" may define the substantially rigid body portion 40" to include a base portion 41" but not a pair of guide members which would be otherwise defined by a second thickness portion (see, e.g., $T_{40\text{-}2}$" described above with respect to the first cradle portion half 16*a*"). Rather, the second cradle portion half 16*b*" includes a plurality (e.g., four) fasteners extending from the base portion 41".

Each of the first guide member 42*a*" and the second guide member 42*b*" include an outer side surface 44" and an inner side surface 46". The inner side surface 46" of each of the first guide member 42*a*" and the second guide member 42*b*" is defined by: (1) an upper arcuate surface segment 46*a*" extending from the upper edge a lower arcuate surface segment 46*b*" extending from the lower edge $\mathbf{40}_{LE}$", $\mathbf{40}_{UE}$", (2) and (3) a substantially linear surface segment 46*c*" connecting the upper arcuate surface segment 46*a*" to the lower arcuate surface segment 46*b*".

Each of the first guide member 42*a*" and the second guide member 42*b*" may define an upper fastener passage 48" and a lower fastener passage 49". The upper fastener passage 48" may be formed proximate the upper arcuate surface segment 46*a*". The lower fastener passage 49" may be formed proximate the lower arcuate surface segment 46*b*". Each of the upper fastener passage 48" and the lower fastener passage 49" may extend through the first thickness portion $T_{40\text{-}1}$" defined by the base portion 41" and the second thickness portion $T_{40\text{-}2}$" defined by each of the first guide member 42*a*" and the second guide member 42*b*". As seen in FIG. 21, the fasteners F extending from the base portion 41" of the second cradle portion half 16*b*" are axially aligned with the upper fastener passages 48" and the lower fastener passages 49".

The first guide member 42*a*" and the second guide member 42*b*" are arranged in an opposing, spaced apart relationship, converging at an angle (see, e.g., in a substantially similar manner, reference numeral $\theta_{42}$ at FIG. 10) as the first guide member 42*a*" and the second guide member 42*b*" extend from the lower edge $\mathbf{40}_{LE}$" toward the upper edge $\mathbf{40}_{UE}$". In some examples, the first guide member 42*a*" and the second guide member 42*b*" define a non-constant gap or spacing (see, e.g., in a substantially similar manner, reference numeral $S_{42}$ at FIG. 10) between the inner side surface 46" of each of the first guide member 42*a*" and the second guide member 42*h*".

The non-constant gap or spacing is generally defined by a first non-constant spacing (see, e.g., $S_{42\text{-}1}$ at FIG. 23A-23B), a second non-constant spacing (see, e.g., in a substantially similar manner, reference numeral $S_{42\text{-}2}$ at FIG. 10) and a third non-constant spacing (see, e.g., in a substantially similar manner, reference numeral $S_{42\text{-}3}$ at FIG. 10). The first non-constant spacing $S_{42\text{-}1}$ is defined by a spaced-apart, opposing relationship of the upper arcuate surface segment 46*a*" of each of the first guide member 42*a*" and the second guide member 42*b*". The second non-constant spacing is defined by a spaced-apart, opposing relationship of the lower arcuate surface segment 46*b*" of each of the first guide member 42*a*" and the second guide member 42*b*". The third non-constant spacing is defined by a spaced-apart, opposing relationship of the substantially linear surface segment 46*c*" of each of the first guide member 42*a*" and the second guide member 42*h*". The second non-constant spacing is greater than third non-constant spacing, and, the third non-constant spacing is greater than the first non-constant spacing $S_{42\text{-}1}$.

As see in FIG. 21, the spine portion 14" generally includes a lower portion 14*a*", an intermediate portion 14*b*" and an upper portion 14*c*". The intermediate portion 14*b*" is located between the lower portion 14*a*" and the upper portion 14*c*".

Referring to FIG. 22, the subassembly 75" is generally defined by a connection of the spine portion 14" to the cradle portion 16". In an example, the lower portion 14*a*" of the spine portion 14" is non-removably-coupled to and free-floatingly-disposed within the cavity 52" formed by the cradle portion 16". The cavity 52" may be generally defined by: (1) opposing inner side surfaces 46" of each of the first guide member 42*a*" and the second guide member 42*b*" of both of the first cradle portion half 16*a*" and the second cradle portion half 16*b*" and (2) opposing rear surfaces 40*a*" of the base portion 41" of each of the first cradle portion half 16*a*" and the second cradle portion half 16*b*". Furthermore, the cavity 52" may be defined by a substantially constant spacing (see, e.g., in a substantially similar manner, reference numeral $S_{52}$ at FIG. 18) extending between the opposing rear surfaces 40*a*" of the base portion 41" of each of the first cradle portion half 16*a*" and the second cradle portion half 16*b*"; in order to permit the free-floating arrangement of the spine portion 14" relative the cradle portion 16", the substantially constant spacing extending between the opposing rear surfaces 40*a*" of the base portion 41" of each of the first cradle portion half 16*a*" and the second cradle portion half 16*b*" is greater than the thickness $T_{30}$" extending between the rear surface 30*a*" and the front surface 30*b*" of the spine portion 14".

Access to the cavity 52" is permitted by an upper opening 54" formed by the cradle portion 16". In an example, the upper opening 54" is defined by: (1) the upper edge $\mathbf{40}_{UE}$" of the substantially rigid body portion 40" defined by the base portion 41" of each of the first cradle portion half 16*a*" and the second cradle portion half 16*b*" and (2) a portion of the upper arcuate surface segment 46*a*" of each of the first guide member 42*a*" and the second guide member 42*b*" that extends from the upper edge $\mathbf{40}_{UE}$".

In an example, as seen in FIGS. 21-22, at least a portion of each upper arcuate surface segment 46*a*" may be further defined by: (1) a first roller member 53*a*" rotatably-disposed between the base portion 41" of each of the first cradle portion half 16*a*" and the second cradle portion half 16*b*" and opposite the first guide member 42*a*" proximate the upper edge $\mathbf{40}_{UE}$" of the substantially rigid body portion 40" and (2) a second roller member 53*b*" rotatably-disposed between the base portion 41" of each of the first cradle portion half 16*a*" and the second cradle portion half 16*b*" and opposite the second guide member 42*b*" proximate the upper edge $\mathbf{40}_{UE}$" of the substantially rigid body portion 40". Each of the first roller member 53*a*" and the second roller member 53*b*" may be defined by a thickness approximately equal to the second thickness portion $T_{40\text{-}2}$" defined by each of the first guide member 42*a*" and the second guide member 42*b*". Furthermore, as seen in FIG. 21, each of the first roller member 53*a*" and the second roller member 53*b*" may include a central passage 55" that is axially aligned with the upper fastener passage 48" of each of the first guide member 42*a*" and the second guide member 42*b*" to permit the fastener F extending from the base portion 41" of the second cradle portion half 16*b*" to be axially extended therethrough.

Figure 23A:
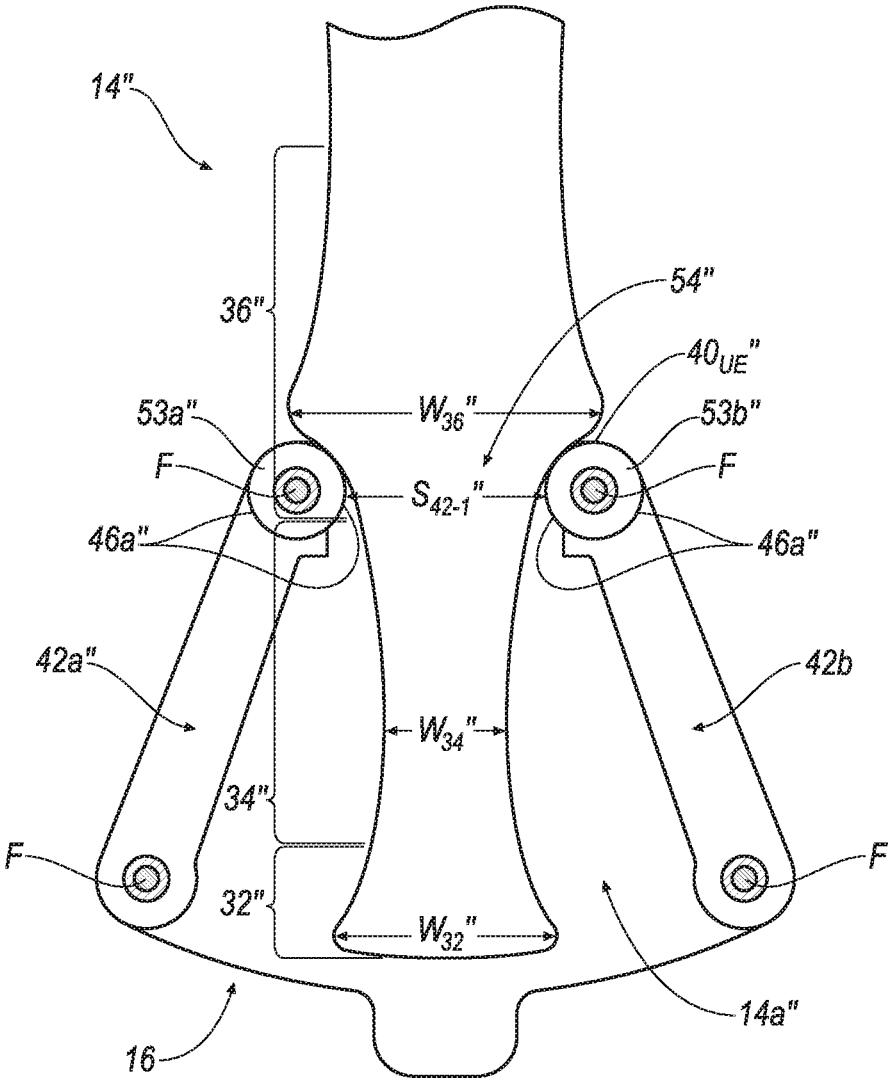
FIGS. 23A-23B are views of a lower portion of the spine portion of the subassembly of FIGS. 21-22 movably-interfaced with the cradle portion of the subassembly of FIGS. 21-22.
Figure 23B:
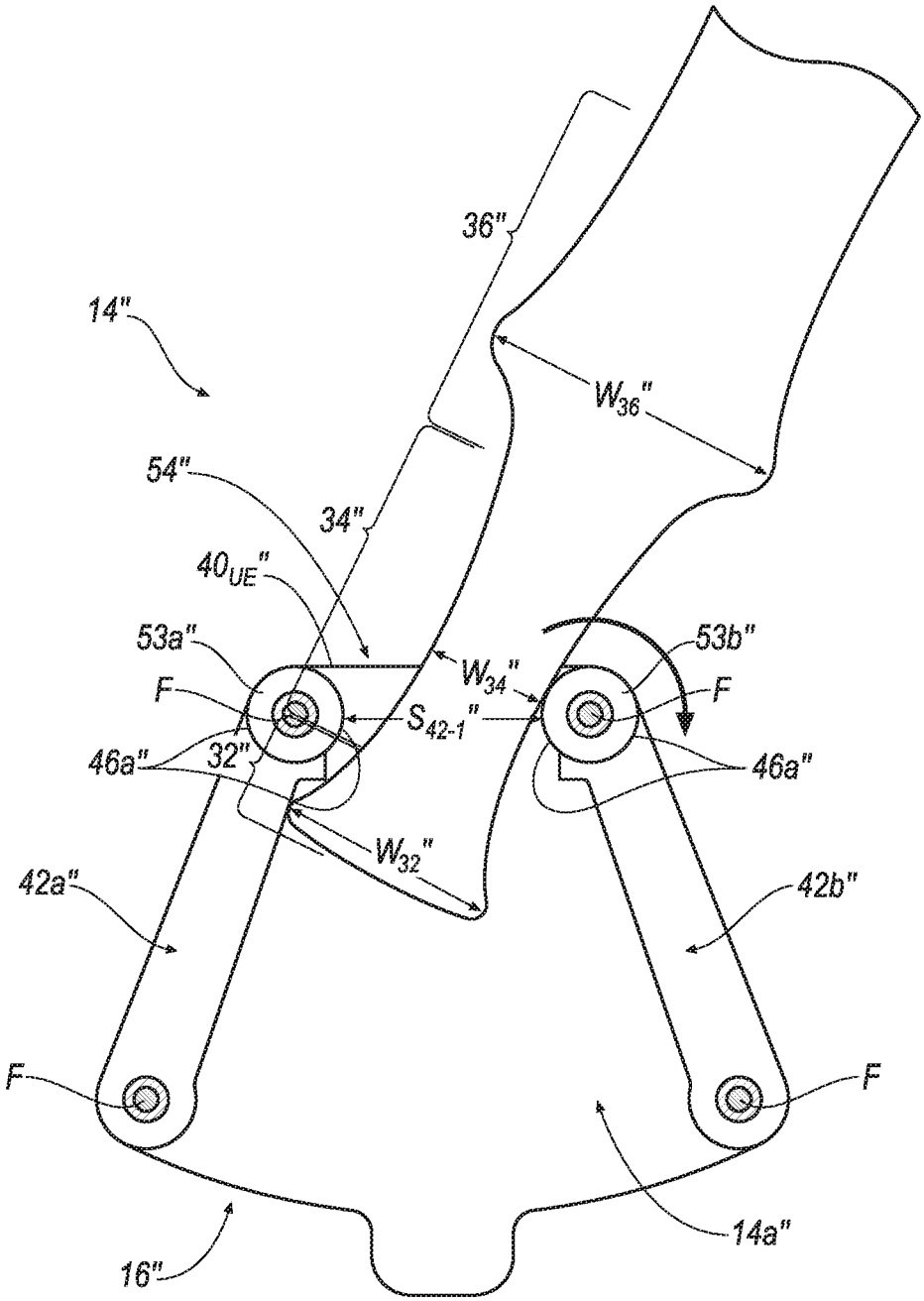

As seen in each of FIGS. 23A-23B, because the upper opening 54" is defined, in part, by the first roller member 53*a*", the second roller member 53*b*" and a portion of the upper arcuate segment 46*a*" of each of the first guide member 42*a*" and the second guide member 42*b*" that extends from the upper edge $\mathbf{40}_{UE}$", the upper opening 54" may be defined by a dimension substantially equal to the first non-constant spacing $S_{42\text{-}1}$". Comparatively, as seen in FIGS. 23A-23B, a largest width of the non-constant width $W_{32}$" defined by the head portion 32" of the of the spine portion 14" is greater than the smallest spacing of the first non-constant spacing $S_{42\text{-}1}$" that defines the upper opening 54". Further, comparatively, as seen in FIGS. 23A-23B, a largest width of the non-constant width $W_{36}$" defined by the shoulder portion 36" of the of the spine portion 14" is greater than the smallest spacing of the first non-constant spacing $S_{42\text{-}1}$" that defines the upper opening 54". Yet even further, any portion of the non-constant width $W_{34}$" of the neck portion 34" of the spine portion 14" is less than the smallest spacing of the first non-constant spacing $S_{42\text{-}1}$" that defines the upper opening 54".

As a result of the relative dimensions of the smallest spacing of the first non-constant spacing $S_{42\text{-}1}$" that defines the upper opening 54" of the cradle portion 16" and: (1) the largest width of the non-constant width $W_{32}$" of the head portion 32" and (2) any portion of the non-constant width $W_{34}$" of the neck portion 34", the neck portion 34" is permitted to be movably-disposed within the upper opening 54" (as seen in FIGS. 23A-23B) while the head portion 32" is not permitted to pass through the upper opening 54" (as seen in, e.g., FIG. 23B) such that the head portion 32" is retained within the cavity 52". Furthermore, as a result of the relative dimensions of the smallest spacing of the first non-constant spacing $S_{42\text{-}1}$ that defines the upper opening 54" of the cradle portion 16" and: (1) the largest width of the non-constant width $W_{36}$" of the shoulder portion 36" and (2) any portion of the non-constant width $W_{34}$" of the neck portion 34", the neck portion 34" is permitted to be movably-disposed within the upper opening 54" (as seen in FIGS. 23A-23B) while the shoulder portion 36" is not permitted to pass through the upper opening 54" and into the cavity 52" (as seen in, e.g., FIG. 23A).

The spine portion 14 may comprise any desirable material. In some instances, the spine portion 14 may include plastic. In other examples, the spine portion 14 may include metal. In yet other examples, the spine portion 14 may include plastic and metal (e.g., the first portion $L_{14\text{-}1}$" and the second portion $L_{14\text{-}2}$" of the length $L_{14}$" of the spine portion 14" may include plastic and the third portion $L_{14\text{-}3}$" defining the first flexible finger portion 25*b*" and the second flexible finger portion 25*c*" may include metal that imparts a spring force; conversely, in some examples, the first portion $L_{14\text{-}1}$" and the second portion $L_{14\text{-}2}$" of the length $L_{14}$" of the spine portion 14" may include metal and the third portion $L_{14\text{-}3}$" defining the first flexible finger portion 25*b*" and the second flexible finger portion 25*c*" may include plastic that imparts a spring force).

Referring to FIGS. 21-22, each of the first flexible finger portion 25*b*" and the second flexible finger portion 25*c*" may include at least one passage 57" extending through the thickness $T_{30}$" of each of the first flexible finger portion 25*b*" and the second flexible finger portion 25*c*". The at least one passage 57" may provide any desirable number of functions; in an example, the at least one passage 57" may decrease the weight of each of the first flexible finger portion 25*b*" and the second flexible finger portion 25*c*" while permitting each of the first flexible finger portion 25*b*" and the second flexible finger portion 25*c*" to have an increased bendability as a result of the absence of material in the regions of the at least one passage 57" formed by each of the first flexible finger portion 25*b*" and the second flexible finger portion 25*c*". In another example, the at least one passage 57" may provide a connection point for connecting each of the first flexible finger portion 25*b*" and the second flexible finger portion 25*c*" to another object (e.g., a load distribution assembly 18 arranged over a shoulder region S of a user U as seen in, e.g., FIGS. 26A-26B by inserting a connecting belt 20 therethrough.

Figure 25:
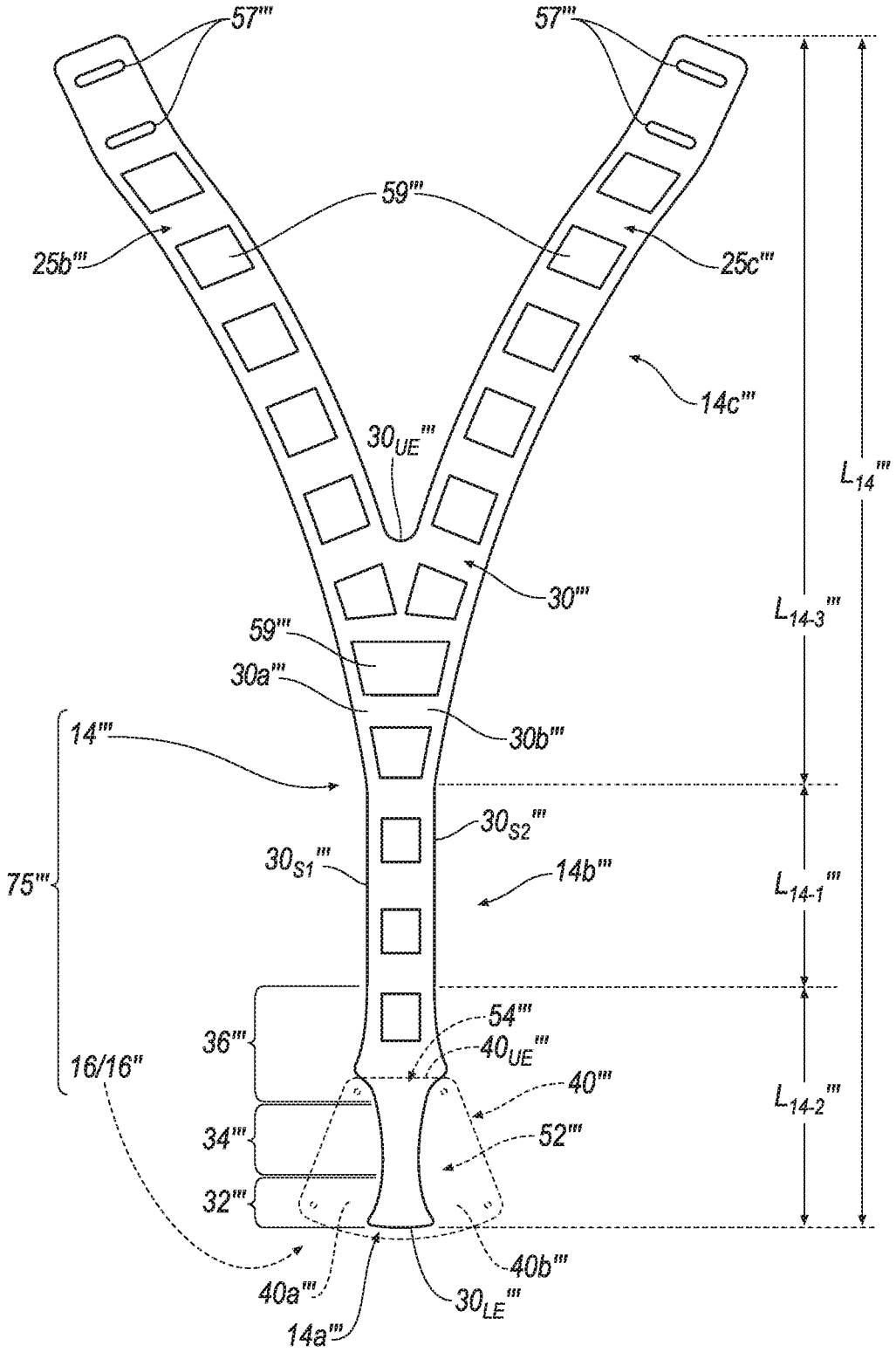
FIG. 25 is an assembled plan view of an exemplary subassembly.

As seen in FIG. 25, a plurality of interconnected components defining an exemplary subassembly 75' is shown. The subassembly 75'" may include a spine portion 14'" and a cradle portion 16/16". Although the subassembly 75'" does not include a separate component defining a load-interfacing portion (see, e.g., reference numeral 12 in FIG. 1), the subassembly 75'" may be considered to define a load-interfacing portion (see, e.g., a first flexile finger portion

25*b*''' and a second flexible finger portion 25*c*''') integrally connected to (or integrally extending from) the spine portion 14'''.

Optionally, the plurality of interconnected components may also include a load distribution assembly (see, e.g., reference numeral 18 in FIG. 1) and a belt (see, e.g., reference numeral 20 in FIG. 1) for defining a carrier system 10. If included, the load distribution assembly 18 may be sized for arrangement over a lumbar area of the torso T of the user U. With reference to FIGS. 1-3, the belt 20 is shown coupled to the load distribution assembly 18 by inserting the belt 20 through openings 19 (see, e.g., FIGS. 1, 2A, 3) formed by the load distribution assembly 18. If, however, the load distribution assembly 18 is not optionally included in the design of the carrier system 10, the belt 20 may be connected to the cradle portion 16/16''; the connection of the belt 20 to the cradle portion 16/16'' may be conducted in any desirable manner (e.g., passing the belt 20 through passages formed by the cradle portion 16/16'' or with an adhesive, fasteners, ultrasonic welding or the like).

The spine portion 14''' includes a substantially flexible body portion 30'. In some examples, the substantially flexible body portion 30''' may be defined by a rectangular-shaped geometry having a rear surface 30*a*' and a front surface 30*b*'''. The substantially flexible body portion 30''' may be defined by a thickness (see, as similarly described, e.g., reference numerals $T_{30}$, $T_{30}$' or $T_{30}$'' in the preceding written description and FIGS.) extending between the rear surface 30*a*''' and the front surface 30*b*'''.

The substantially flexible body portion 30''' may be defined by a lower edge $\mathbf{30}_{LE}$''' and an upper edge $\mathbf{30}_{UE}$'''; the lower edge $\mathbf{30}_{LE}$''' is arranged opposite the upper edge $\mathbf{30}_{UE}$'''. The substantially flexible body portion 30''' may also be defined by a first side edge $\mathbf{30}_{S1}$''' and a second side edge $\mathbf{30}_{S2}$'''; the first side edge $\mathbf{30}_{S1}$''' is arranged opposite the second side edge $\mathbf{30}_{S2}$'''. Each of the first side edge $\mathbf{30}_{S1}$''' and the second side edge $\mathbf{30}_{S2}$''' connect the lower edge $\mathbf{30}_{LE}$''' to the upper edge $\mathbf{30}_{UE}$'''.

The first side edge $\mathbf{30}_{S1}$''' and the second side edge $\mathbf{30}_{S2}$''' define the substantially flexible body portion 30''' to have a first, substantially constant width (see, as similarly described, e.g., reference numerals $W_{14-1}$, $W_{14-1}$' or $W_{14-1}$'' in the preceding written description and FIGS.) extending along a first portion $L_{14-1}$''' of a length $L_{14}$''' of the spine portion 14''' and a second, non-constant width (see, as similarly described, e.g., reference numerals $W_{14-2}$, $W_{14-2}$' or $W_{14-2}$'' in the preceding written description and FIGS.) extending along a second portion $L_{14-2}$''' of the length $L_{14}$''' of the spine portion 14'''. The first portion $L_{14-1}$''' of the length $L_{14}$''' of the spine portion 14''' may extend away from the upper edge $\mathbf{30}_{UE}$''' of the substantially flexible body portion 30'''. The second portion $L_{14-2}$''' of the length $L_{14}$''' of the spine portion 14''' may extend away from the lower edge $\mathbf{30}_{LE}$''' of the substantially flexible body portion 30'''.

The second, non-constant width (see, as similarly described, e.g., reference numerals $W_{14-2}$, $W_{14-2}$' or $W_{14-2}$'' in the preceding written description and FIGS.) defines the second portion $L_{14-2}$''' of the length $L_{14}$''' of the spine portion 14''' to form a head portion 32''', a neck portion 34''' and a shoulder portion 36'''. The head portion 32''' extends away from the lower edge $\mathbf{30}_{LE}$''' of the substantially flexible body portion 30''' and may be defined by a non-constant width (see, as similarly described, e.g., reference numerals $W_{32}$, $W_{32}$' or $W_{32}$'' in the preceding written description and FIGS.). The neck portion 34''' extends away from the head portion 32''' and may be defined by a non-constant width (see, as similarly described, e.g., reference numerals $W_{34}$, $W_{34}$' or $W_{34}$'' in the preceding written description and FIGS.). The shoulder portion 36''' extends away from the neck portion 34''' and may be defined by a non-constant width (see, as similarly described, e.g., reference numerals $W_{36}$, $W_{36}$' or $W_{36}$'' in the preceding written description and FIGS.).

The non-constant width (see, as similarly described, e.g., reference numerals $W_{36}$, $W_{36}$' or $W_{36}$'' in the preceding written description and FIGS.) of the shoulder portion 36''' may be greater than the non-constant width (see, as similarly described, e.g., reference numerals $W_{32}$, $W_{32}$' or $W_{32}$'' in the preceding written description and FIGS.) of the head portion 32''', and, the non-constant width (see, as similarly described, e.g., reference numerals $W_{32}$, $W_{32}$' or $W_{32}$'' of the head portion 32'' in the preceding written description and FIGS.) may be greater than the non-constant width (see, as similarly described, e.g., reference numerals $W_{34}$, $W_{34}$' or $W_{34}$'' in the preceding written description and FIGS.) of the neck portion 34'''. The non-constant widths of the head portion 32''', the neck portion 34''' and the shoulder portion 36''' collectively defines the second, non-constant width (see, as similarly described, e.g., reference numerals $W_{14-2}$, $W_{14-2}$' or $W_{14-2}$'' in the preceding written description and FIGS.) extending along the second portion $L_{14-2}$''' of the length $L_{14}$''' of the spine portion 14'''.

Unlike the exemplary spine portions 14, 14' described above at FIGS. 7-9 and 7'-9', the substantially flexible body portion 30''' of the spine portion 14''' does not define a plurality of vertically-aligned passages (see, e.g., reference numerals 38 and 38') for removably-connecting the spine portion 14''' to a load-interfacing portion (see, e.g., reference numerals 12 and 12'); rather, the spine portion 14''' integrally includes a first flexible finger portion 25*b*''' extending diagonally away from the upper edge $\mathbf{30}_{UE}$''' of the substantially flexible body portion 30''' of the spine portion 14''' and a second flexible finger portion 25*c*''' extending diagonally away from the upper edge $\mathbf{30}_{UE}$''' of the substantially flexible body portion 30''' of the spine portion 14''' (as described above, substantially equivalent structure defining a load-interfacing portion is provided by the first flexible finger portion 25*b*''' and the second flexible finger portion 25*c*''' are integrally connected to (or integrally extending from) the spine portion 14'''). The first flexible finger portion 25*b*''' and the second flexible finger portion 25*c*''' may divergently diagonally extend from the upper edge $\mathbf{30}_{UE}$''' of the substantially flexible body portion 30''' of the spine portion 14''' at an angle $\theta_{25}$'''. Furthermore, each of the first flexible finger portion 25*b*''' and the second flexible finger portion 25*c*''' may be defined by a thickness substantially equal to the thickness (see, as similarly described, e.g., reference numerals $T_{30}$, $T_{30}$' or $T_{30}$'' in the preceding written description and FIGS.) extending between the rear surface 30*a*''' and the front surface 30*b*''' of the substantially flexible body portion 30''' of the spine portion 14'''. The thickness (see, as similarly described, e.g., reference numerals $T_{30}$, $T_{30}$' or $T_{30}$'' in the preceding written description and FIGS.) of the first flexible finger portion 25*b*''' and the second flexible finger portion 25*c*''' may be selectively sized in order to permit each of the first flexible finger portion 25*b*''' and the second flexible finger portion 25*c*''' to bend, imparting a spring force to a load portion L (see, e.g., FIG. 15) when the first flexible finger portion 25*b*''' and the second flexible finger portion 25*c*''' are removably-interfaced with the load portion L (as similarly seen in, e.g., FIGS. 15-16). Yet even further, the first flexible finger portion 25*b*''' and the second flexible finger portion 25*c*''' may define a third portion $L_{14-3}$''' of the length $L_{14}'''$ of the spine portion 14''' that extends away from the first portion $L_{14\text{-}1}'''$ of the length $L_{14}'''$ of the spine portion 14'''.

As described above, the subassembly 75''' may be a portion of the carrier system 10 that may be removably-joined to the load portion L for forming the assembly 50. In an example, the carrier system 10 (including the subassembly 75') is removably-joined to the load portion L by inserting: (1) the first flexible finger portion 25*b*''' of the spine portion 14''' into a first passage $L_{P1}$ formed by the load portion L and (2) the second flexible finger portion 25*c*''' of the spine portion 14''' into a second passage $L_{P2}$ formed by the load portion L. In an example, when the load portion L is a backpack, rucksack or the like, the first passage $L_{P1}$ and the second passage $L_{P2}$ formed by the load portion L may be passages formed in respective shoulder straps $L_S$ of the backpack or rucksack.

The spine portion 14''' generally includes a lower portion 14*a*''', an intermediate portion 14*b*''' and an upper portion 14*c*'''. The intermediate portion 14*b*''' is located between the lower portion 14*a*''' and the upper portion 14*c*'''.

Figure 24:
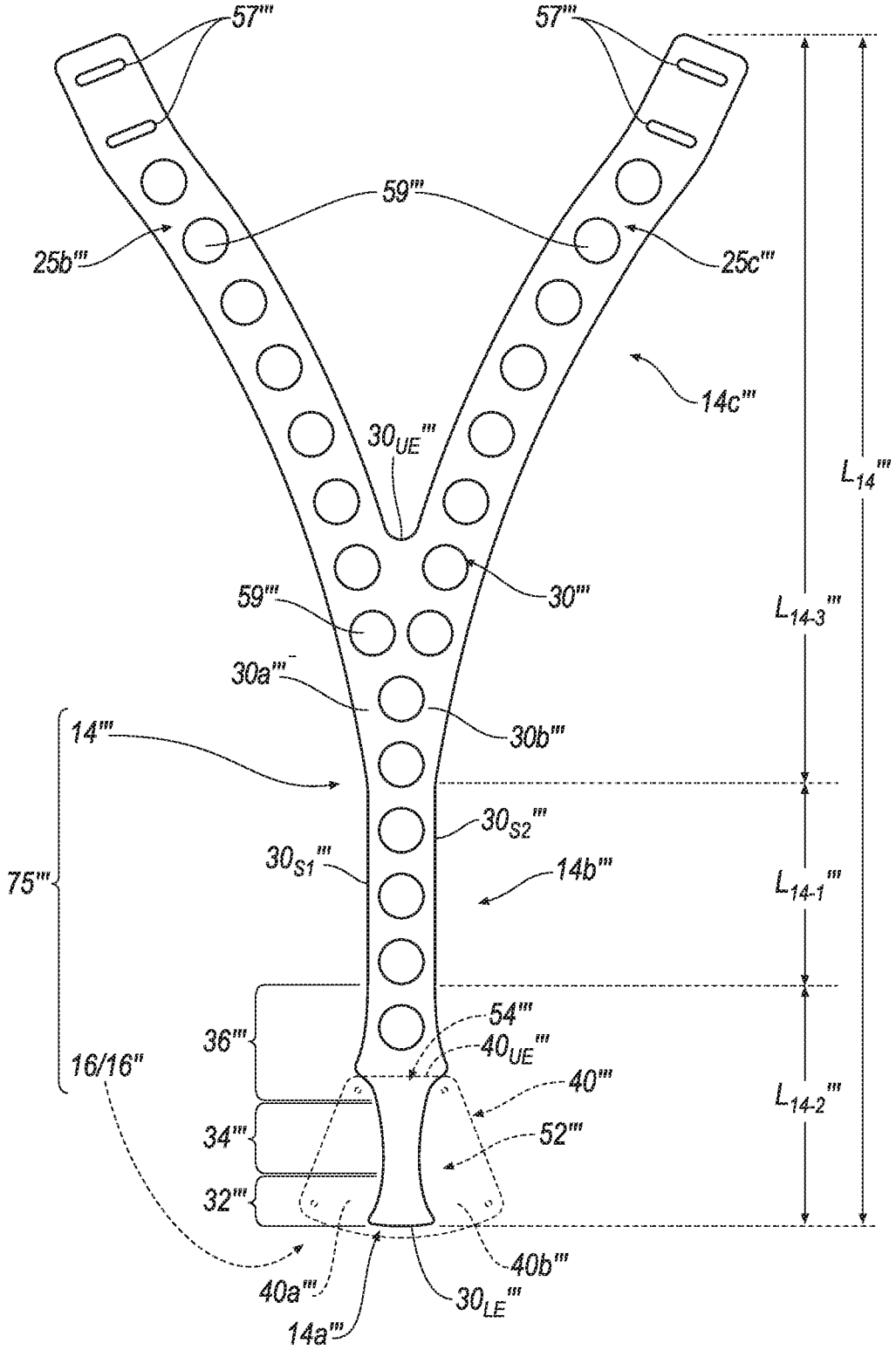
FIG. 24 is an assembled plan view of an exemplary subassembly.

As seen in FIG. 24 or 25, the subassembly 75''' is generally defined by a connection of the spine portion 14' to the cradle portion 16/16". In an example, the lower portion 14*a*''' of the spine portion 14''' is non-removably-coupled to and free-floatingly-disposed within the cavity 52''' formed by the cradle portion 16". In order to permit the free-floating arrangement of the spine portion 14''' relative the cradle portion 16/16", the substantially constant spacing extending between the opposing rear surfaces 40*a*''' of the base portion 41''' of each of the first cradle portion half (see, as similarly described, e.g., reference numerals 16*a*/16*a*" in the preceding written description and FIGS.) and the second cradle portion half (see, as similarly described, e.g., reference numerals 16*b*/16*b*" in the preceding written description and FIGS.) is greater than the thickness (see, as similarly described, e.g., reference numerals $T_{30}$, $T_{30}'$ or $T_{30}''$ in the preceding written description and FIGS.) extending between the rear surface 30*a*''' and the front surface 30*b*''' of the spine portion 14'''.

Access to the cavity 52''' is permitted by an upper opening 54''' formed by the cradle portion 16/16". In an example, the upper opening 54''' is defined by: (1) the upper edge $\mathbf{40}_{UE}'''$ of the substantially rigid body portion 40''' defined by the base portion 41''' of each of the first cradle portion half (see, as similarly described, e.g., reference numerals 16*a*/16*a*" in the preceding written description and FIGS.) and the second cradle portion half (see, as similarly described, e.g., reference numerals 16*b*/16*b*" in the preceding written description and FIGS.) and (2) a portion of the upper arcuate surface segment (see, as similarly described, e.g., reference numerals 46*a*/46*a*" in the preceding written description and FIGS.) of each of the first guide member (see, as similarly described, e.g., reference numerals 42*a*/42*a*" in the preceding written description and FIGS.) and the second guide member (see, as similarly described, e.g., reference numerals 42*b*/42*b*" in the preceding written description and FIGS.) that extends from the upper edge $\mathbf{40}_{UE}'''$.

The spine portion 14''' may comprise any desirable material. In some instances, the spine portion 14''' may include plastic. In other examples, the spine portion 14''' may include metal. In yet other examples, the spine portion 14''' may include plastic and metal (e.g., the first portion $L_{14\text{-}1}'''$ and the second portion $L_{14\text{-}2}'''$ of the length $L_{14}'''$ of the spine portion 14''' may include plastic and the third portion $L_{14\text{-}3}'''$ defining the first flexible finger portion 25*b*''' and the second flexible finger portion 25*c*''' may include metal that imparts a spring force; conversely, in some examples, the first portion $L_{14\text{-}1}'''$ and the second portion $L_{14\text{-}2}'''$ of the length $L_{14}'''$ of the spine portion 14''' may include metal and the third portion $L_{14\text{-}3}'''$ defining the first flexible finger portion 25*b*''' and the second flexible finger portion 25*c*''' may include plastic that imparts a spring force).

Each of the first flexible finger portion 25*b*''' and the second flexible finger portion 25*c*''' may include at least one first passage 57''' extending through the thickness (see, as similarly described, e.g., reference numerals $T_{30}$, $T_{30}'$ or $T_{30}''$ in the preceding written description and FIGS.) of each of the first flexible finger portion 25*b*''' and the second flexible finger portion 25*c*'''. The at least one first passage 57''' may provide any desirable number of functions; in an example, the at least one first passage 57''' may decrease the weight of each of the first flexible finger portion 25*b*''' and the second flexible finger portion 25*c*''' while permitting each of the first flexible finger portion 25*b*''' and the second flexible finger portion 25*c*''' to have an increased bendability as a result of the absence of material in the regions of the at least one first passage 57''' formed by each of the first flexible finger portion 25*b*''' and the second flexible finger portion 25*c*'''. In another example, the at least one first passage 57''' may provide a connection point for connecting each of the first flexible finger portion 25*b*''' and the second flexible finger portion 25*c*''' to another object (e.g., a load distribution assembly 18 arranged over a shoulder region S of a user U as seen in, e.g., FIGS. 26A-26B by inserting a connecting belt 20 there-through).

Furthermore, as seen in FIG. 24 or 25, substantially flexible body portion 30''' may define at least one second passage 59'''. The at least one second passage 59''' may include a plurality of second passages 59''' arranged along one or more of the first portion $L_{14\text{-}1}'''$, the second portion $L_{14\text{-}2}'''$ and the third portion $L_{14\text{-}3}'''$ of the length $L_{14}'''$ of the spine portion 14'''. The at least one second passage 59''' may provide any desirable number of functions; in an example, the at least one second passage 59''' may decrease the weight of the spine portion 14''' while permitting each of the first flexible finger portion 25*b*''' and the second flexible finger portion 25*c*''' to have an increased bendability as a result of the absence of material in the regions of the at least one first passage 57''' formed by each of the first flexible finger portion 25*b*''' and the second flexible finger portion 25*c*'''. The at least one second passage 59''' may include any desirable geometry such as, for example, a circular geometry (see, e.g., FIG. 24), a rectangular or square geometry (see, e.g., FIG. 25) or any combination thereof.

Although a plurality of exemplary subassemblies 75, 75' 75", 75''' have been described above to include respective combinations of an exemplary spine portion and an exemplary cradle portion at reference numerals 14 & 16, 14' & 16', 14" & 16" and 14''' & 16/16", the respective combination of a particular spine portion is not limited to a particular cradle portion as shown and described above. For example, any of the spine portions 14, 14', 14", 14''' may be interfaced with any of the cradle portions 16, 16', 16". Accordingly, in some instances, if, for example, any of the spine portions 14, 14", 14''' were formed from a bendable material, the spine portion 14, 14", 14''' may be interfaced with the cradle portion 16'(see, e.g., FIGS. 10'-12') such that the spine portion 14, 14", 14''' may bend about the cradle portion 16' in a substantially similar manner as the spine portion 14'.

Figure 26A:
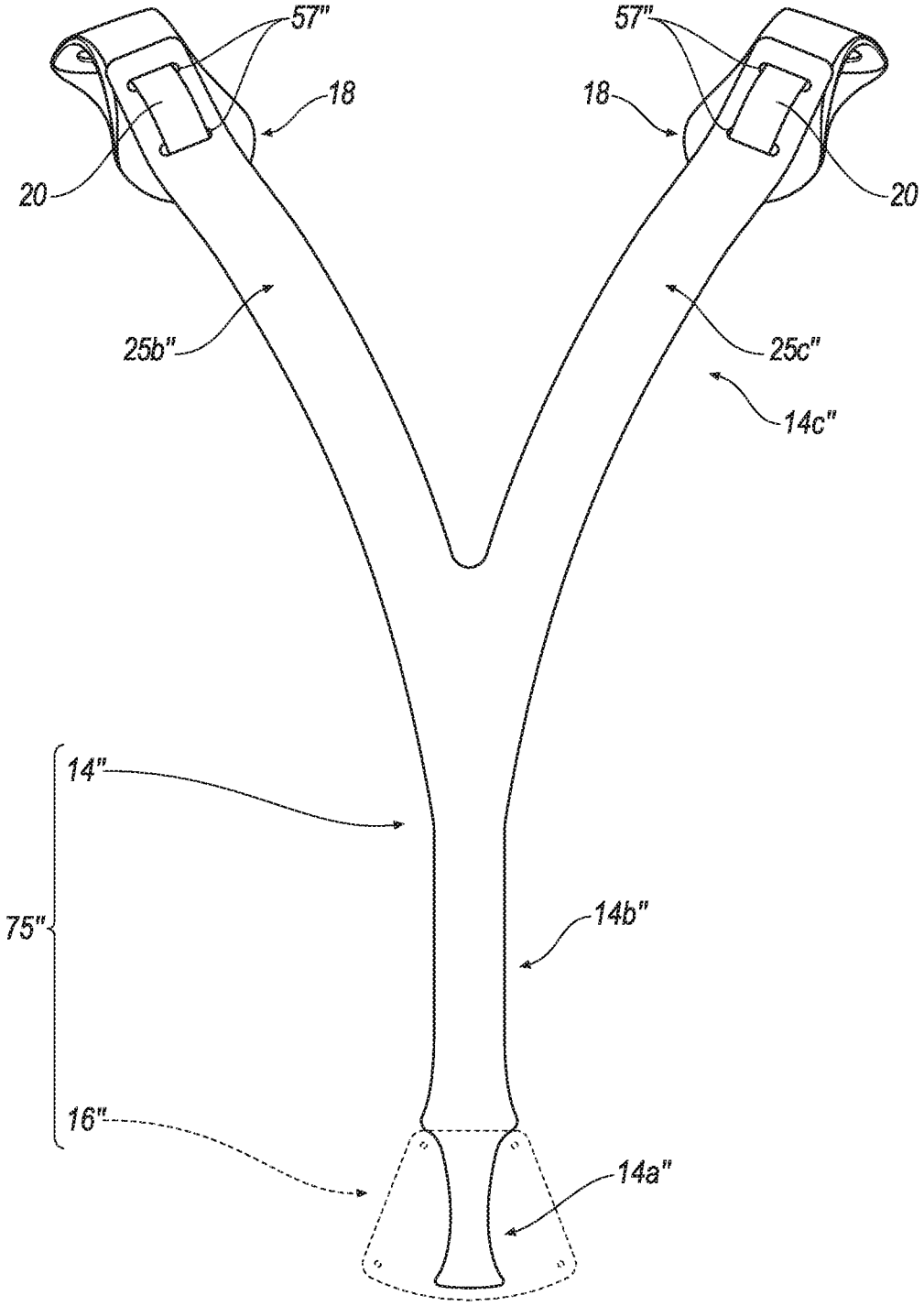
FIGS. 26A-26B are views of the subassembly of FIG. 22 including a pair of load distribution assemblies attached to first and second finger portions of the spine portion.
Figure 26B:
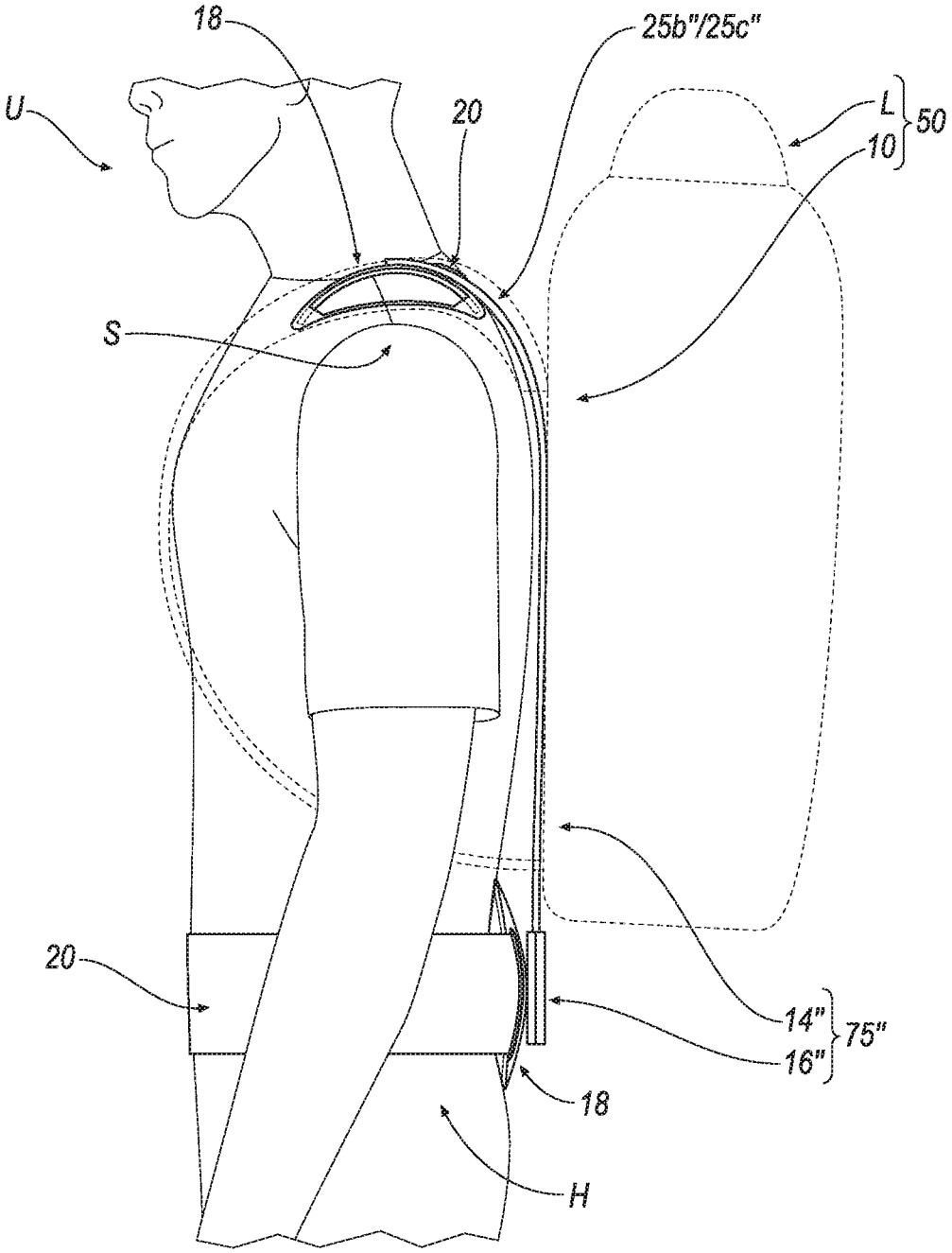

Referring to FIGS. 26A-26B, another view of the exemplary subassembly 75" including the spine portion 14" is shown. Unlike the substantially similar view of the subassembly 75" including the spine portion 14" of FIG. 22, the view of the subassembly 75" including the spine portion 14" of FIGS. 26A-26B is shown to include a load distribution assembly 18 connected to each flexible finger portion 25*b*", 25*c*" by a connecting belt 20. As seen in FIG. 26A, the connecting belt 20 is passed through the at least one passage 57" extending through the thickness $T_{30}$" of each of the first flexible finger portion 25*b*" and the second flexible finger portion 25*c*" and through openings (not shown but substantially similar to reference numeral 19 in FIG. 1) for connecting the load distribution assembly 18 to each flexible finger portion 25*b*", 25*c*".

As seen in FIG. 26B, the load distribution assembly 18 attached to each of the flexible finger portion 25*b*", 25*c*" is, for example, sized for arrangement over a shoulder S of the torso T of the user U. Furthermore, the load distribution assembly 18 may similarly be attached to each of the flexible finger portion 25*b*'", 25*c*'" of the spine portion 14'" by way of the at least one passage 57'".

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A carrier system, comprising: a cradle portion defining a cavity; a spine portion including an end portion extending into the cavity by way of an opening formed by the cradle portion, wherein the end portion of the spine is coupled to and floatingly-disposed within the cavity of the cradle portion whereby the end portion of the spine portion is configured for movement through the opening of the cradle portion such that the end portion of the spine portion is arrangeable in at least two dimensions relative the cradle portion in a plurality of configurations including at least: a first configuration whereby the end portion of the spine portion is disposed within the cavity of the cradle portion; and a second configuration whereby the end portion of the spine portion is at least partially extended through the opening of the cradle portion and at least partially out of the cavity of the cradle portion; and a load-interfacing portion connected to the spine portion, wherein the cradle portion includes: a first cradle portion joined to a second cradle portion, wherein each of the first cradle portion and the second cradle portion includes a substantially rigid body portion having a base portion and a pair of guide members extending from the base portion, wherein the pair of guide members includes a first guide member and a second guide member arranged in a spaced-apart relationship defining a non-constant spacing that defines the cavity; and a belt connected to the cradle portion.

2. The carrier system of claim 1, wherein each of the first cradle portion and the second cradle portion is defined by a rear surface, a front surface, a lower edge, an upper edge, a first side edge and a second side edge, wherein the first guide member extends away from the base portion along the first side edge, wherein the second guide member extends away from the base portion along the second side edge, wherein the cavity is further defined by a substantially constant spacing extending between the rear surface of the first cradle portion and the rear surface of the second cradle portion.

3. The carrier system of claim 2, wherein the substantially rigid body portion is defined by a thickness extending between the rear surface and the front surface, wherein the thickness is defined by a first thickness portion and a second thickness portion, wherein the second thickness portion is greater than the first thickness portion, wherein the first thickness portion is defined by the base portion, wherein the second thickness portion is defined by each of the first guide member and the second guide member extending away from the base portion.

4. The carrier system of claim 2, wherein the substantially rigid body portion is defined by a thickness extending between the rear surface and the front surface, wherein the thickness is defined by a first thickness portion, a second thickness portion and a third thickness portion, wherein the second thickness portion is greater than the first thickness portion, wherein the third thickness portion is greater than the second thickness portion, wherein the first thickness portion is defined by the base portion, wherein the second thickness portion defines a pair of opposing intermediate step portions arranged respectively between the base portion and each of the first guide member and the second guide member, wherein the third thickness portion is defined by each of the first guide member and the second guide member extending away from the base portion, wherein an inner side surface of each intermediate step portion defines a substantially constant gap or spacing therebetween to define a substantially linear guide channel for the spine portion.

5. The carrier system of claim 2, wherein each of the first guide member and the second guide member include an outer side surface and an inner side surface, wherein the inner side surface of each of the first guide member and the second guide member is defined by: an upper arcuate surface segment extending from the upper edge, a lower arcuate surface segment extending from the lower edge, and a substantially linear surface segment connecting the upper arcuate surface segment to the lower arcuate surface segment.

6. The carrier system of claim 5, wherein the first guide member and the second guide member are arranged in an opposing, spaced apart relationship, converging at an angle or arranged in a substantially parallel relationship as the first guide member and the second guide member extend from the lower edge toward the upper edge to define the non-constant spacing between the inner side surface of each of the first guide member and the second guide member.

7. The carrier system of claim 6, wherein the non-constant spacing is defined by: a first non-constant spacing defined by a spaced-apart, opposing relationship of the upper arcuate surface segment of each of the first guide member and the second guide member, a second non-constant spacing defined by a spaced-apart, opposing relationship of the substantially linear surface segment of each of the first guide member and the second guide member and a third non-constant spacing defined by a spaced-apart, opposing relationship of the substantially linear surface segment of each of the first guide member and the second guide member, wherein the second non-constant spacing is greater than third non-constant spacing, wherein the third non-constant spacing is greater than the first non-constant spacing.

8. The carrier system of claim 7, wherein the opening is defined by the upper edge of the substantially rigid body portion defined by the base portion of each of the first cradle portion and the second cradle portion and a portion of the upper arcuate surface segment of each of the first guide member and the second guide member that extends from the upper edge.

9. The carrier system of claim 8, wherein the opening is defined by a dimension substantially equal to the first non-constant spacing defined by the spaced-apart, opposing relationship of the upper arcuate surface segment of each of the first guide member and the second guide member, wherein the first non-constant spacing is less than a width dimension defined by a head portion of the of the spine portion to prevent the head portion of the spine portion to be removed from the cavity, wherein the first non-constant spacing is less than a width dimension defined by a shoulder portion of the of the spine portion to prevent the shoulder portion spine portion to be inserted into the cavity, wherein the first non-constant spacing is greater than a width dimension defined by a neck portion of the of the spine portion to permit the neck portion of the spine portion to be movably-disposed within the opening.

10. The carrier system of claim 6, wherein at least a portion of each upper arcuate surface segment is further defined by: a first roller member rotatably-disposed between the base portion of each of the first cradle portion and the second cradle portion and opposite the first guide member proximate the upper edge of the substantially rigid body portion; and a second roller member rotatably-disposed between the base portion of each of the first cradle portion and the second cradle portion and opposite the second guide member proximate the upper edge of the substantially rigid body portion.

11. The carrier system of claim 1, wherein an intermediate portion of the spine portion is removably-connected to a substantially rigid body of the load-interfacing portion by arranging the intermediate portion of the spine portion within at least one passage formed by the substantially rigid body portion.

12. The carrier system of claim 1, wherein an upper portion of the spine portion is removably-connected to a substantially rigid body of the load-interfacing portion, wherein the spine portion defines a plurality of vertically-aligned passages, wherein each of the plurality of vertically-aligned passages is sized for receiving at least one male portion of a plurality of vertically-aligned male portions extending from the substantially rigid body portion of the load-interfacing portion for removably-connecting the spine portion to the load-interfacing portion for defining a vertical adjustment system that permits the spine to be removably-connected to the substantially rigid body portion of the load-interfacing portion in a selectively-fixed vertical orientation of a plurality of vertically-fixed orientations.

13. The carrier system of claim 12, wherein the load-interfacing portion further includes a substantially flexible portion connected to the substantially rigid body, wherein the substantially flexible portion includes a base portion, a first flexible finger portion extending from the base portion, and a second flexible finger portion extending from the base portion.

14. The carrier system of claim 13, wherein the first flexible finger portion extends substantially diagonally away from the base portion, wherein the second flexible finger portion extends substantially diagonally away from the base portion, wherein the first flexible finger portion and the second flexible finger portion divergently extend from an upper edge of the base portion of the substantially flexible portion at an angle thereby defining the substantially flexible portion to have a V-shaped geometry.

15. The carrier system of claim 1, further comprising a vertical adjustment system connected to the cradle portion, wherein the vertical adjustment system includes: a rail portion; and a clamping portion that is slidably-adjustable along the rail portion.

16. The carrier system of claim 15, the rail portion is fixed to the cradle portion, wherein the clamping portion is fixed to the spine portion.

17. The carrier system of claim 1, wherein the load-interfacing portion further includes a first flexible finger portion integrally connected to and extending away from the upper edge of the substantially flexible body portion of the spine portion, and a second flexible finger portion integrally connected to and extending away from the upper edge of the substantially flexible body portion of the spine portion.

18. The carrier system of claim 17, wherein the first flexible finger portion extends substantially diagonally away from the upper edge of the substantially flexible body portion of the spine portion, wherein the second flexible finger portion extends substantially diagonally away from the upper edge of the substantially flexible body portion of the spine portion, wherein the first flexible finger portion and the second flexible finger portion divergently extend from the upper edge of the substantially flexible body portion of the spine portion at an angle.

19. The carrier system of claim 1, further comprising: a load distribution assembly connected to the belt, wherein the belt is at least indirectly connected to the cradle portion by way of the load distribution assembly.

20. The carrier system of claim 19, further comprising a vertical adjustment system including: a rail portion; and a clamping portion that is slidably-adjustable along the rail portion.

21. The carrier system of claim 20, the rail portion is fixed to the load distribution assembly, wherein the clamping portion is fixed to the cradle portion.

* * * * *